US009311765B2

(12) United States Patent
Akamatsu et al.

(10) Patent No.: US 9,311,765 B2
(45) Date of Patent: Apr. 12, 2016

(54) BANKNOTE DEPOSIT APPARATUS

(75) Inventors: Toru Akamatsu, Himeji (JP); Masaki Inoue, Himeji (JP); Masakazu Sakata, Himeji (JP)

(73) Assignee: GLORY LTD., Himeji-Shi, Hyogo-Ken (JP)

( * ) Notice: Subject to any disclaimer, the term of this patent is extended or adjusted under 35 U.S.C. 154(b) by 0 days.

(21) Appl. No.: 13/508,178

(22) PCT Filed: Nov. 5, 2010

(86) PCT No.: PCT/JP2010/069675

§ 371 (c)(1),
(2), (4) Date: Jun. 29, 2012

(87) PCT Pub. No.: WO2011/055777

PCT Pub. Date: May 12, 2011

(65) Prior Publication Data

US 2012/0285788 A1 Nov. 15, 2012

(30) Foreign Application Priority Data

Nov. 5, 2009 (JP) ..... 2009-254194

(51) Int. Cl.
*G07F 7/04* (2006.01)
*G07D 11/00* (2006.01)
(Continued)

(52) U.S. Cl.
CPC ..... *G07D 11/00* (2013.01); *B65H 29/12* (2013.01); *B65H 29/125* (2013.01);
(Continued)

(58) Field of Classification Search
CPC . G07D 7/00; G07D 11/0003; G07D 11/0021; G07D 11/0024; G07D 11/0081; G07D 11/0084; G07D 11/0087; G07D 11/009; G07D 13/00; G07D 2207/00; G07D 224/00; G07D 11/00; G07F 7/00; G07F 7/005; G07F 7/04; G07F 17/3246; G07F 19/00; G07F 19/20; G07F 19/202; G07F 19/203; B65G 57/306; B65G 57/02; B65G 57/06; B65H 33/06; B65H 33/08; B65H 33/16; B65H 31/30; B65H 31/3009; B65H 31/3027; B65H 29/145; B65H 29/125; B65H 29/12
USPC ..... 194/206, 207; 209/534; 271/187; 235/379
See application file for complete search history.

(56) References Cited

U.S. PATENT DOCUMENTS 4,462,509 A * 7/1984 Adelberger ..... 221/259
4,510,380 A * 4/1985 Uchida et al. ..... 194/206
(Continued)

FOREIGN PATENT DOCUMENTS

CN 1436342 A 8/2003
CN 1645421 A 7/2005
(Continued)

OTHER PUBLICATIONS

European Search Report (Application No. 10828336.7—PCT/JP2010/069675) (7 pages—dated Oct. 7, 2013).
(Continued)

*Primary Examiner* — Jeffrey Shapiro
(74) *Attorney, Agent, or Firm* — Renner, Kenner, Greive, Bobak, Taylor & Weber

(57) ABSTRACT

A banknote deposit apparatus includes: a storing box 70 configured to receive the banknote stacked in a stacking unit 60 so as to store the banknote; and a clamping and transporting mechanism 10 configured to clamp surfaces of the banknote stacked in the stacking unit 60 and to transport the banknote to a direction parallel to the surfaces of the clamped banknote so as to store the banknote in the storing box. A front opening 61 through which the stacked banknote is taken out from outside, and a front shutter unit 62 configured to open and close the front opening are disposed on a front surface of the stacking unit 60.

7 Claims, 31 Drawing Sheets

(51) Int. Cl.

| | |
|---|---|
| ***B65H 29/12*** | (2006.01) |
| ***B65H 33/16*** | (2006.01) |
| ***B65H 31/30*** | (2006.01) |

(52) U.S. Cl.

CPC ..... *B65H 31/3009* (2013.01); *B65H 31/3027* (2013.01); *B65H 33/16* (2013.01); *G07D 11/0003* (2013.01); *G07D 11/0009* (2013.01); *G07D 11/0018* (2013.01); *G07D 11/0021* (2013.01); *G07D 11/0024* (2013.01); *G07D 11/0084* (2013.01)

(56) References Cited

U.S. PATENT DOCUMENTS

| | | | | |
|---|---|---|---|---|
| 4,733,765 | A * | 3/1988 | Watanabe | 194/206 |
| 4,905,839 | A * | 3/1990 | Yuge | G07D 11/0072 209/534 |
| 7,464,928 | B2 * | 12/2008 | Ko | 271/187 |
| 7,789,389 | B2 * | 9/2010 | Ko | 271/315 |
| 8,205,874 | B2 * | 6/2012 | Kruger | 271/145 |
| 2003/0173402 | A1 * | 9/2003 | Ogawa | B65H 1/00 235/381 |
| 2005/0189693 | A1 * | 9/2005 | Ko | 271/9.02 |
| 2006/0012114 | A1 * | 1/2006 | Ko | 271/315 |
| 2008/0060906 | A1 * | 3/2008 | Fitzgerald et al. | 194/207 |
| 2008/0061497 | A1 | 3/2008 | Ishikawa et al. | |

FOREIGN PATENT DOCUMENTS

| | | | |
|---|---|---|---|
| CN | 1904952 | A | 1/2007 |
| CN | 101123014 | A | 2/2008 |
| EP | 1 926 057 | A1 | 5/2008 |
| JP | 3868677 | | 1/2007 |
| JP | 2009-110084 | | 5/2009 |
| JP | 2009-282559 | | 12/2009 |

OTHER PUBLICATIONS

Chinese Office Action with English Translation (Chinese Application No. 2010800606670) (17 pages—Issued Mar. 4, 2014).

Japanese Office Action issued Jan. 14, 2014 with English translation (JP Application No. 2010-057352).

Chinese Office Action with English Translation (Chinese Patent Application No. 201080060667.0) (22 pages—dated Oct. 24, 2014).

* cited by examiner

| ◇SETTING OF THE NUMBER OF PREPARATION MONEY | PREPARATION NUMBER | BATCH NUMBER (BUNDLE) |
|---|---|---|
| 1000-YEN BANKNOTE | 100 | 20(5) |
| 2000-YEN BANKNOTE | – | – |
| 5000-YEN BANKNOTE | 10 | 5(2) |
| 10000-YEN BANKNOTE | – | – |

5a

| | COUNTED SUM (NUMBER) | PREPARATION NUMBER (BUNDLE) | STORED NUMBER |
|---|---|---|---|
| 1000-YEN BANKNOTE | 157, 000 (157) | 100 (5) | 57 |
| 2000-YEN BANKNOTE | 2, 000 ( 1) | | 2 |
| 5000-YEN BANKNOTE | 85, 000 ( 17) | 10 (2) | 7 |
| 10000-YEN BANKNOTE | 820, 000 ( 82) | | 82 |
| SUM | 1, 064, 000 | CASSETTE AMOUNT-OF-MONEY DATA | = 914, 000 |

FIG. 9

BANKNOTE DEPOSIT APPARATUS

FIELD OF THE INVENTION

The present invention relates to a banknote deposit apparatus to which a banknote is deposited.

BACKGROUND ART

There has been conventionally known a banknote deposit apparatus including: a transport path (transport unit) that transports a banknote fed out from a banknote insertion unit (reception unit); a banknote judgment means (recognition unit) disposed on a certain point of the transport path so as to judge a denomination of the banknote; a banknote escrow unit (stacking unit) that stacks the banknotes having been judged by the judgment means in an up and down direction and escrows the banknotes; and a banknote storing cassette (storing box) that collectively lets down the stacked banknotes as they are in the stacking direction, based on a storing command, and receives the stacked banknotes (see, for example, JP3868677B, JP2009-110084A, etc.).

Such a conventional banknote deposit apparatus has, between the banknote escrow unit and the banknote storing cassette, an opening larger than a banknote in a plane direction. By letting down a banknote through the opening, the banknote is moved from the banknote escrow unit to the banknote storing cassette.

DISCLOSURE OF THE INVENTION

However, in the conventional banknote deposit apparatus, since the large opening is provided as described above, there is a possibility that a banknote in the banknote storing cassette (storing box) might be picked out through the opening.

The present invention has been made in view of the above circumstances, and the object of the present invention is to provide a banknote deposit apparatus having a high thief-proof property, which can prevent picking-out of a banknote in a storing box.

The banknote deposit apparatus of the present invention is a banknote deposit apparatus including:

a reception unit configured to take in, one by one, a plurality of banknotes;

a transport unit configured to transport the banknote having been taken in by the reception unit;

a stacking unit configured to stack the banknote having been transported by the transport unit;

a recognition unit disposed on the transport unit, the recognition unit being configured to recognize and count the banknote being transported by the transport unit;

a storing box configured to receive the banknote stacked in the stacking unit so as to store the banknote; and a clamping and transporting mechanism configured to clamp surfaces of the banknote stacked in the stacking unit and to transport the banknote to a direction parallel to the surfaces of the clamped banknote so as to store the banknote in the storing box;

and that a front opening through which the stacked banknote is taken out from outside, and a front shutter unit configured to open and close the front opening are disposed on a front surface of the stacking unit.

According to such a banknote deposit apparatus, there is provided the clamping and transporting mechanism configured to clamp surfaces of a banknote stacked in the stacking unit and to transport the banknote to a direction parallel to the surfaces of the clamped banknote so as to store the banknote into the storing box. As a result, the banknote in the storing box can be prevented from being picked out, whereby the banknote deposit apparatus with improved thief-proof property can be provided.

In addition, according to such a banknote deposit apparatus, the front opening through which the stacked banknote is taken out from outside is disposed on the front surface of the stacking unit. Thus, during the counting operation, the banknote having been transported to the stacking unit can be taken out through the front opening. Thus, the one apparatus can have both the function of counting banknotes and the function of storing the banknotes.

In the banknote deposit apparatus, the clamping and transporting mechanism may be configured to clamp surfaces of banknotes located on outermost positions of the plurality of banknotes stacked in the stacking unit, and to collectively transport the plurality of banknotes to the storing box.

In the banknote deposit apparatus, the storing box may be provided with a slit opening through which the banknote being transported by the clamping and transporting mechanism is taken in.

In the banknote deposit apparatus, the storing box may be provided with a slit shutter unit configured to open and close the slit opening.

In the banknote deposit apparatus, the stacking unit may be configured to stack the banknote having been transported by the transport unit in a forwardly inclined standing state.

In the banknote deposit apparatus, when the banknote is transported by the clamping and transporting mechanism to the storing box, the front shutter unit may be unopenable.

The banknote deposit apparatus of the present invention may further include a control unit configured to switch a storing mode in which the banknote having been taken in by the reception unit is transported to the stacking unit by the transport unit, and then the banknote having been transported to the stacking unit is transported to the storing box by the clamping and transporting mechanism, and a counting mode in which the banknote having been taken in by the reception unit is transported to the stacking unit by the transport unit, and the banknote having been transported to the stacking unit is taken out from outside through the front opening, without actuating the clamping and transporting mechanism.

In addition, the present invention may be a banknote deposit apparatus including:

a reception unit configured to take in, one by one, a banknote having been put thereinto to an inside of the apparatus;

a transport unit configured to transport the banknote having been taken to the inside of the apparatus by the reception unit;

a recognition unit disposed on the transport unit, the recognition unit being configured to recognize the banknote being transported by the transport unit;

a stacking unit connected to the transport unit, the stacking unit being configured to stack the banknote having been sent from the transport unit;

a storing box to which the banknote having been stacked in the stacking unit is sent from the stacking unit, the storing box being configured to receive and store the banknote having been sent thereto;

a moving mechanism configured to move the banknote stacked in the stacking unit to the storing box;

a shutter unit configured to open and close an opening through which the banknote stacked in the stacking unit is taken out from outside the apparatus;

a setting unit configured to set a denomination of a taken-out banknote(s) to be taken out to the outside of the apparatus, and the number of the taken-out banknote(s) for each denomination; and a control unit configured to control at least the shutter unit and the moving mechanism, such that when a banknote, whose denomination has been set by the setting unit and the number corresponds to the set number, is stacked in the stacking unit, the opening is opened by the shutter unit, and that, when a banknote, whose denomination is other than the denomination having been set by the setting unit, is stacked in the stacking unit, the banknote stacked in the stacking unit is moved to the storing box by the moving mechanism.

In such a banknote deposit apparatus, the setting unit is configured to set a denomination of a taken-out banknote(s) to be taken out to the outside of the apparatus, and the number of the taken-out banknote(s) for each denomination. When a banknote, whose denomination has been set by the setting unit and the number corresponds to the set number, is stacked in the stacking unit, the opening is opened by the shutter unit. On the other hand, when a banknote, whose denomination is other than the denomination having been set by the setting unit, is stacked in the stacking unit, the banknote stacked in the stacking unit is moved to the storing box by the moving mechanism. Thus, even when most of denominations of deposited banknotes are a specific denomination (e.g., 1000-yen or 5000-yen), since the banknotes of this specific denomination can be taken out from the outside of the apparatus, the volume of the storing box can be reduced. In addition, since the deposit process and the change-fund preparation process can be simultaneously performed, the process time can be decreased as a whole.

In the aforementioned banknote deposit apparatus, the control unit may be configured to calculate a deposit sum by adding a sum of the banknote(s) that has been taken out from the stacking unit to the outside of the apparatus through the opening, and a sum of the banknote(s) that is stored in the storing box.

In the aforementioned banknote deposit apparatus, the control unit may be configured to perform a control such that, when a banknote, whose denomination has been set by the setting unit but the number exceeds the number having been set by the setting unit, is stacked in the stacking unit, the surplus banknote is moved to the storing box by the moving mechanism.

In the aforementioned banknote deposit apparatus, the setting unit may be configured to set the batch number of taken-out banknotes to be taken out in a batch to the outside of the apparatus, and the control unit may be configured to perform a control such that for each time when banknotes, whose denomination has been set by the setting unit and the number corresponds to the set batch number, are stacked in the stacking unit, the opening is opened by the shutter unit.

The aforementioned banknote deposit apparatus may further include a display unit configured to display the number of banknote(s) for each denomination, which has been taken out from the stacking unit to the outside of the apparatus through the opening, and the number of banknote(s) for each denomination, which is stored in the storing box, wherein in the process of stacking banknote(s) whose denomination has been set by the setting unit in the stacking unit, when the number of banknote(s) stacked in the stacking unit does not reach the number having been set by the setting unit, the display unit may display this information.

The aforementioned banknote deposit apparatus may further include a printing unit configured to print the number of banknote(s) for each denomination, which has been taken out from the stacking unit to the outside of the apparatus through the opening, and the number of banknote(s) for each denomination, which is stored in the storing box, wherein in the process of stacking banknote(s) whose denomination has been set by the setting unit in the stacking unit, when the number of banknote(s) stacked in the stacking unit does not reach the number having been set by the setting unit, the printing unit may print this information.

In addition, the present invention may be a banknote deposit apparatus including:

a reception unit configured to take in, one by one, a banknote having been put thereinto to an inside of the apparatus;

a transport unit configured to transport the banknote having been taken to the inside of the apparatus by the reception unit;

a recognition unit disposed on the transport unit, the recognition unit being configured to recognize the banknote being transported by the transport unit;

a stacking unit connected to the transport unit, the stacking unit being configured to stack the banknote having been sent from the transport unit;

a storing box to which the banknote having been stacked in the stacking unit is sent from the stacking unit, the storing box being configured to receive and store the banknote having been sent thereto;

a moving mechanism configured to move the banknote stacked in the stacking unit to the storing box;

a shutter unit configured to open and close an opening through which the banknote stacked in the stacking unit is taken out from outside the apparatus;

a setting unit configured to set a sum of a stored banknote(s) to be stored into the storing box; and a control unit configured to control at least the shutter unit and the moving mechanism, such that until a sum of banknote(s) stored in the storing box reaches the sum having been set by the setting unit, the banknote stacked in the stacking unit is moved to the storing box by the moving mechanism, and that when the sum of banknote(s) stored in the storing box reaches the sum having been set by the setting unit, the opening is opened by the shutter unit;

wherein the control unit is configured to calculate a deposit sum by adding the sum of the banknote(s) that has been taken out from the stacking unit to the outside of the apparatus through the opening, and the sum of the banknote(s) that is stored in the storing box.

According to such a banknote deposit apparatus, since the control unit is configured to calculate a deposit sum by adding the sum of the banknote(s) that has been taken out from the stacking unit to the outside of the apparatus through the opening, and the sum of the banknote(s) that is stored in the storing box, the sum of the banknote(s) that has been taken out to the outside of the apparatus can be included in the deposit sum.

The aforementioned banknote deposit apparatus may further include a display unit configured to display the number of banknote(s) for each denomination, which has been taken out from the stacking unit to the outside of the apparatus through the opening, and the number of banknote(s) for each denomination, which is stored in the storing box, wherein when the sum of banknote(s) stored in the storing box does not reach the sum having been set by the setting unit, the display unit may display this information.

The aforementioned banknote deposit apparatus may further include a printing unit configured to print the number of banknote(s) for each denomination, which has been taken out from the stacking unit to the outside of the apparatus through the opening, and the number of banknote(s) for each denomination, which is stored in the storing box, wherein when the sum of banknote(s) stored in the storing box does not reach the sum having been set by the setting unit, the printing unit may print this information.

In the aforementioned banknote deposit apparatus, the setting unit may be configured to set a denomination of a taken-out banknote(s) to be taken out in a batch to the outside of the apparatus, and the batch number of the taken-out banknote(s), after a banknote(s) whose sum has been set by the setting unit has been stored into the storing box, and the control unit may be configured to perform a control such that for each time when banknotes, whose denomination has been set by the setting unit and the number corresponds to the set batch number, are stacked in the stacking unit, the opening is opened by the shutter unit.

In addition, the present invention may be a money deposit apparatus into which at least any one of a plurality of money storing cassettes each having recognition information is loaded, the money deposit apparatus including:

a reception unit configured to take in, one by one, money having been put thereinto;

a recognition unit configured to recognize and count the taken-in money;

a transport unit configured to transport the recognized and counted money to the loaded money storing cassette;

a detecting unit configured to detect the recognition information of the loaded money storing cassette;

a memory unit configured to store amount-of-money information of the money stored in the respective plurality of money storing cassettes; and a control unit configured to write, based on the detected recognition information, a count result by the recognition unit into a memory area in the memory unit corresponding to the loaded money storing cassette.

According to such a banknote deposit apparatus, data of the money in the money storing cassette removed from the apparatus body can be stored, so that deposit data after reloading of the money storing cassette can be handled succeedingly to deposit data before the removal of the money storing cassette.

In the aforementioned banknote deposit apparatus, the control unit may be configured to add the count result by the recognition result to the amount-of-money information corresponding to the loaded money storing cassette.

In the aforementioned banknote deposit apparatus, when the memory unit does not store amount-of-money information of the money storing cassette corresponding to the recognition information detected by the detecting unit, the control unit may newly create a memory area corresponding to the recognition information in the memory unit, and may write the count result by the recognition unit into the memory unit.

The aforementioned banknote deposit apparatus may further include a display unit configured to display a message showing that the memory unit does not store the amount-of-money information of the money storing cassette corresponding to the recognition information detected by the detecting unit.

The aforementioned banknote deposit apparatus may further include a command receiving unit configured to receive a command for deleting or not deleting the amount-of-money information stored in the memory unit corresponding to the money storing cassette in accordance with removal of the loaded money storing cassette, wherein the control unit may be configured to, upon receipt of a command for deleting the amount-of-money information through the command receiving unit, delete the amount-of-money information stored in the memory unit corresponding to the money storing cassette in accordance with removal of the money storing cassette, and upon receipt of a command for not deleting the amount-of-money information, maintain the amount-of-money information corresponding to the money storing cassette in accordance with removal of the money storing cassette.

In the aforementioned banknote deposit apparatus, the command receiving unit may include a reading unit configured to read out ID information of an operator, and the control unit may be configured to maintain the amount-of-money information corresponding to the money storing cassette in the memory unit in accordance with removal of the money storing cassette, when the ID information read out by the reading unit indicates a clerk, and delete the amount-of-money information corresponding to the money storing cassette in accordance with removal of the money storing cassette, when the ID information read out by the reading unit indicates a collecting staff.

In addition, the present invention may be a money deposit apparatus including:

a reception unit configured to take in, one by one, money having been put thereinto;

a recognition unit configured to recognize and count the taken-in money;

a storing cassette capable of being removed and loaded, the storing cassette being configured to store the recognized and counted money;

a memory unit configured to store a count result of money stored in the storing cassette as amount-of-money information;

a command receiving unit configured to receive a command for deleting or not deleting the amount-of-money information stored in the memory unit in accordance with removal of the storing cassette; and a control unit configured to, upon receipt of a command for deleting the amount-of-money information through the command receiving unit, delete the amount-of-money information from the memory unit in accordance with removal of the sting cassette, and, upon receipt of a command for not deleting the amount-of-money information through the command receiving unit, maintain the amount-of-money information in the memory unit.

According to such a banknote deposit apparatus, data of the money in the money storing cassette removed from the apparatus body can be stored, so that deposit data after reloading of the money storing cassette can be handled succeedingly to deposit data before the removal of the money storing cassette.

In the aforementioned banknote apparatus, when the storing cassette corresponding to the command for not deleting the amount-of-money information is reloaded after removal thereof, the control unit may be configured to add a count result by the recognition unit about the money having been taken in from the reception unit to the amount-of-money information, and to cause the memory unit to store this.

In the aforementioned banknote deposit apparatus, the command receiving unit may include a reading unit configured to read out ID information of an operator, and the control unit may be configured to maintain the amount-of-money information corresponding to the money storing cassette in the memory unit in accordance with removal of the money storing cassette, when the ID information read out by the reading unit indicates a clerk, and delete the amount-of-money information corresponding to the money storing cassette in accordance with removal of the money storing cassette, when the ID information read out by the reading unit indicates a collecting staff.

In addition, the present invention may be a banknote deposit apparatus including:

a reception unit configured to take in, one by one, a banknote having been put thereinto to an inside of the apparatus;

a transport unit configured to transport the banknote having been taken in by the reception unit to the inside of the apparatus;

a recognition unit disposed on the transport unit, the recognition unit being configured to recognize the banknote being transported by the transport unit;

a stacking unit connected to the transport unit, the stacking unit being configured to stack the banknote having been sent from the transport unit;

a shutter unit configured to open and close an opening through which the banknote stacked in the stacking unit is taken out from outside the apparatus;

an imaging unit configured to image a banknote stacked position in the stacking unit; and a control unit configured to judge whether the banknote is normally stacked or not with the use of an image obtained by the imaging unit, which shows the banknote stacked in the stacking unit, and to perform a predetermined process based on the judgment result.

According to such a banknote deposit apparatus, the banknote stacked state can be detected, so that it is possible to prevent occurrence of problem in that a banknote to be moved remains, etc.

The aforementioned banknote apparatus may further include:

a storing box to which the banknote stacked in the stacking unit is sent from the stacking unit, the storing box being configured to receive and store the banknote having been sent thereto; and a moving unit configured to move the banknote stacked in the stacking unit to the storing box;

wherein the control unit may be configured to, when it is judged that the banknote is normally stacked in the stacking unit, to move the banknote stacked in the stacking unit to the storing box, and configured to, when it is judged that the banknote is abnormally stacked in the stacking unit, control the shutter unit such that the opening is opened.

In the aforementioned banknote apparatus:

a predetermined pattern may be drawn on a surface of the shutter unit on a side facing the inside of the apparatus;

the imaging unit may be configured to image at least a part of the pattern, when the banknote is stacked in the stacking unit; and the control unit may be configured to judge whether the banknote is normally stacked or not, based on the predetermined pattern on the image obtained by the imaging unit.

In the aforementioned banknote apparatus, the predetermined pattern may be a dot pattern, and the control unit may be configured to judge whether the banknote is normally stacked or not, based on the number of dots on the image.

In the aforementioned banknote apparatus, the control unit may be configured to compare an image obtained by the imaging unit, which shows a state before a banknote is stacked in the stacking unit, and an image obtained by the imaging unit, which shows a state after the moving unit has moved the banknote stacked in the stacking unit to the storing box, with each other, and configured to judge whether there remains a banknote in the stacking unit based on the comparison result.

In the aforementioned banknote apparatus, when the shutter unit is opened, the imaging unit may be configured to image the outside of the apparatus through the opening.

In the aforementioned banknote apparatus:

the imaging unit may be configured to image recognition information described on an envelope that has been put into the stacking unit from outside the apparatus through the opening when the shutter is opened, and the control unit may be configured to compare the recognition information imaged by the imaging unit and information inputted through an input unit with each other, and to output an alarm signal, when the recognition information and the inputted information mismatch.

In addition, the present invention may be a banknote deposit apparatus including:

a reception unit configured to take in, one by one, a banknote having been put thereinto to an inside of the apparatus;

a transport unit configured to transport the banknote having been taken in by the reception unit;

a recognition unit disposed on the transport unit, the recognition unit being configured to recognize and count the banknote being transported by the transport unit;

a stacking unit connected to the transport unit, the stacking unit being configured to stack the banknote having been sent from the transport unit and a payment-information specifying medium on which payment information including a payment destination and a payment sum is described;

a reading unit configured to read out the payment information described on the payment-information specifying medium;

a shutter unit configured to open and close an opening through which the banknote stacked in the stacking unit can be taken out from outside the apparatus;

a storing box to which the banknote and the payment-information specifying medium stacked in the stacking unit are sent, the storing box being configured to receive and store the banknote and the payment-information specifying medium having been sent thereto;

a moving unit configured to move the banknote and the payment-information specifying medium stacked in the stacking unit to the storing box;

an output unit configured to output the payment information read out by the reading unit to the outside; and a control unit configured to control the shutter unit and the moving unit.

According to such a banknote deposit apparatus, occurrence of mistake when deposited cash is paid can be prevented, and an operation load required for managing a debit note can be reduced.

In the aforementioned banknote apparatus, the reading unit may be a bar-code reader configured to read out the payment information described as a bar code on the payment-information specifying medium, and the stacking unit may be configured to receive the payment-information specifying medium from which the payment information has been read out by the bar-code reader, through the opening.

In the aforementioned banknote apparatus, the stacking unit may be configured to receive the payment-information specifying medium through the opening, and the reading unit may include:

an imaging unit configured to image the payment-information specifying medium in the stacking unit; and an extracting unit configured to extract the payment information from an image of the payment-information specifying medium obtained by the imaging unit.

In the aforementioned banknote apparatus:

the reception unit may be configured to take in, one by one, payment-information specifying media to the inside of the apparatus;

the transport unit may be configured to transport the payment-information specifying medium having been taken to the inside of the apparatus by the reception unit to the stacking unit; and the reading unit may be included in the recognition unit, and configured to read out the payment information from the payment-information specifying medium being transported by the transport unit.

In the aforementioned banknote apparatus:

the control unit may be configured to calculate payment sums for each payment destination, based on the payment information read out by the reading unit, the output unit may be configured to print and output the calculated payment sums for each payment destination.

In the aforementioned banknote apparatus:

the storing box may be provided with a storage medium; and the output unit may be configured to write the payment information into the storage medium.

In the aforementioned banknote apparatus, the control unit may calculate a sales proceed and a payment sum, based on a deposit sum to the storing box and the payment information read out by the reading unit.

BRIEF DESCRIPTION OF THE DRAWINGS

FIG. 4 is a structural view showing a display and input unit of the banknote deposit apparatus shown in FIG. 1 and so on.

FIG. 5 is a functional block view of the banknote deposit apparatus shown in FIG. 1 and so on.

FIG. 9 is a view showing the screen image (upon displaying a count result) of the monitor of the display and input unit in the banknote deposit apparatus shown in FIG. 1, when the number of denominations of banknotes placed on the placement unit is more than one.

DETAILED DESCRIPTION OF THE INVENTION

First Embodiment

Figure 1:
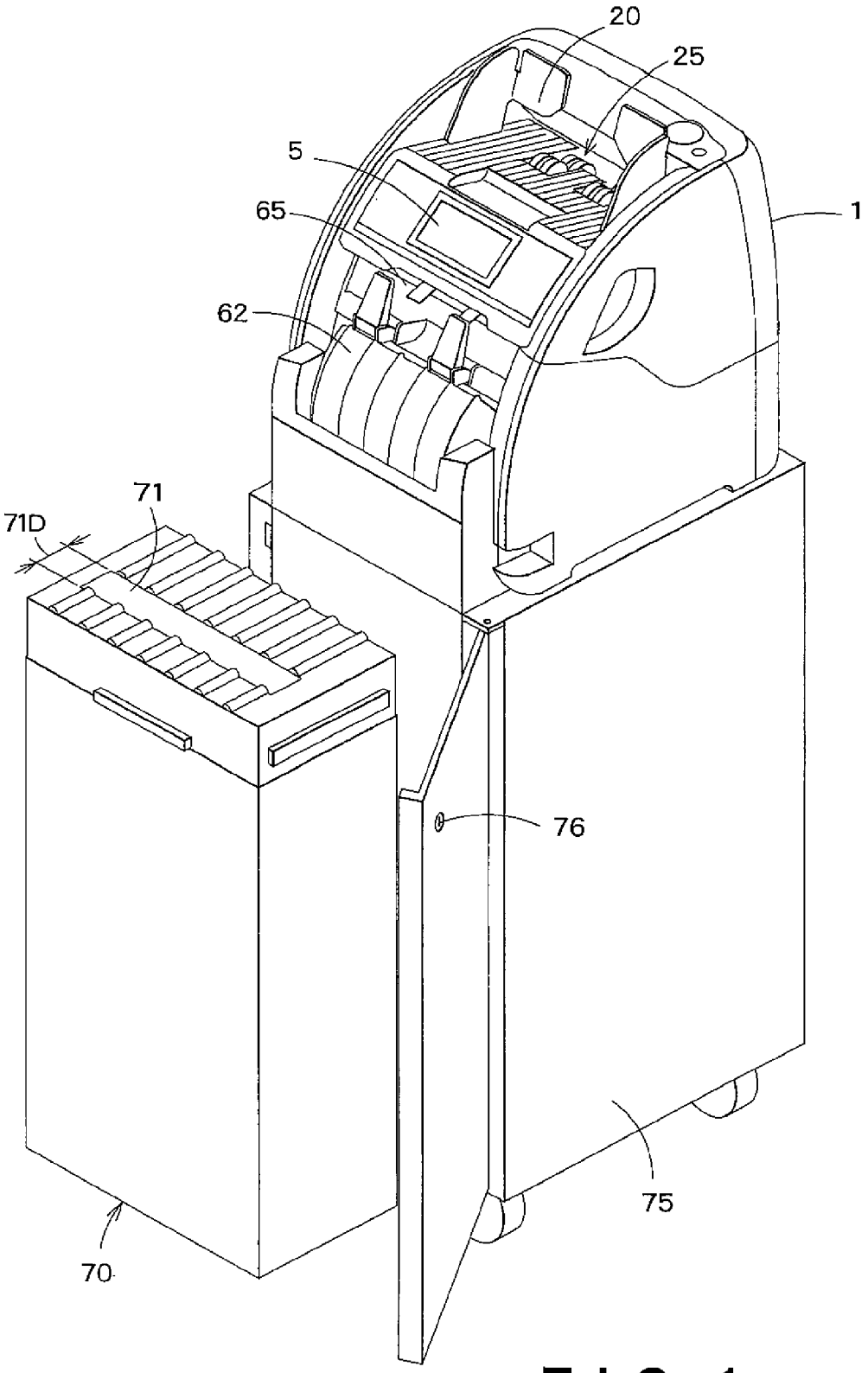
FIG. 1 is a perspective view of a banknote deposit apparatus according to a first embodiment and a second embodiment of the present invention.
Figure 2:
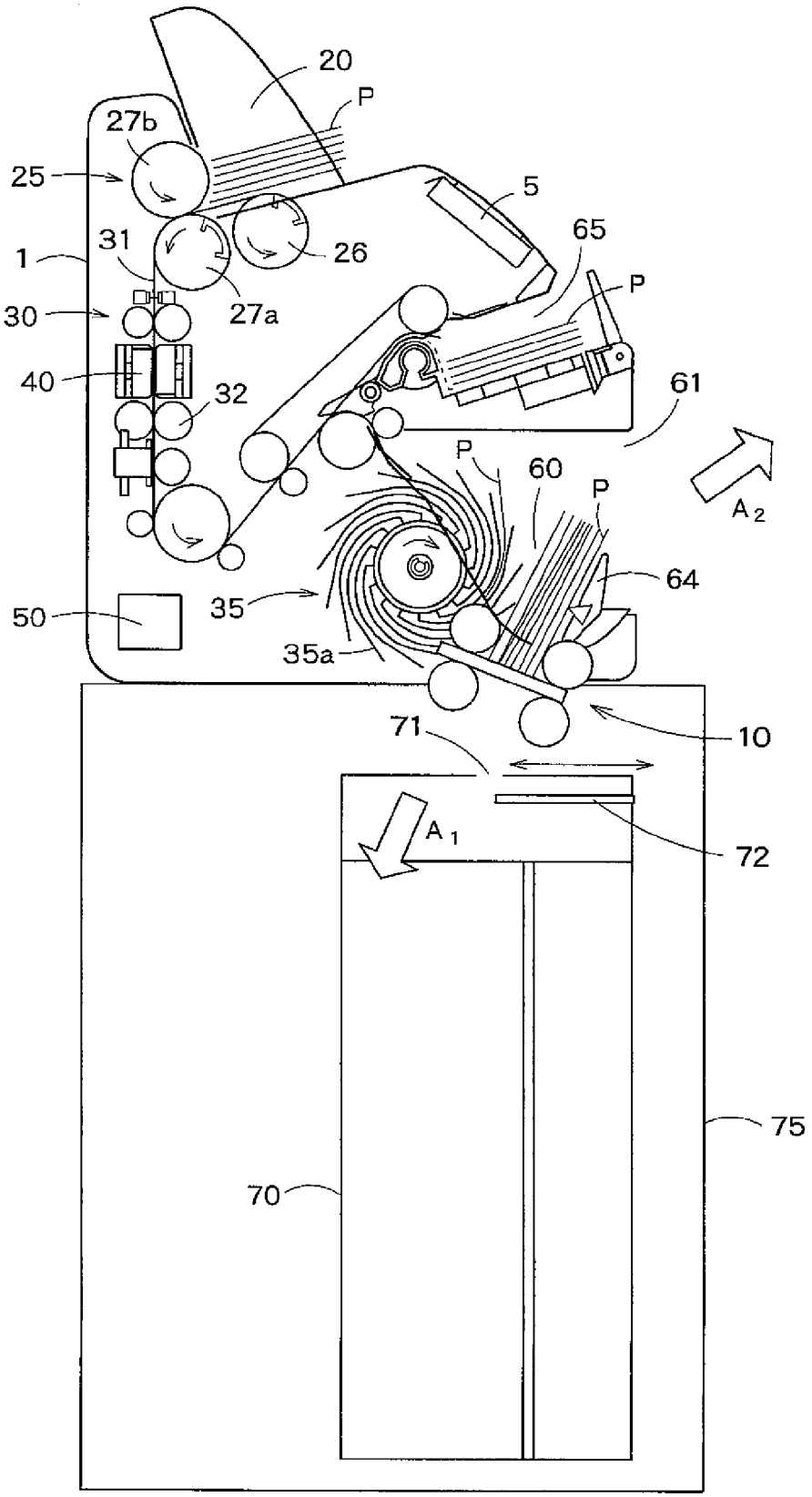
FIG. 2 is a lateral sectional view showing a structure of the banknote deposit apparatus shown in FIG. 1.
Figure 3:
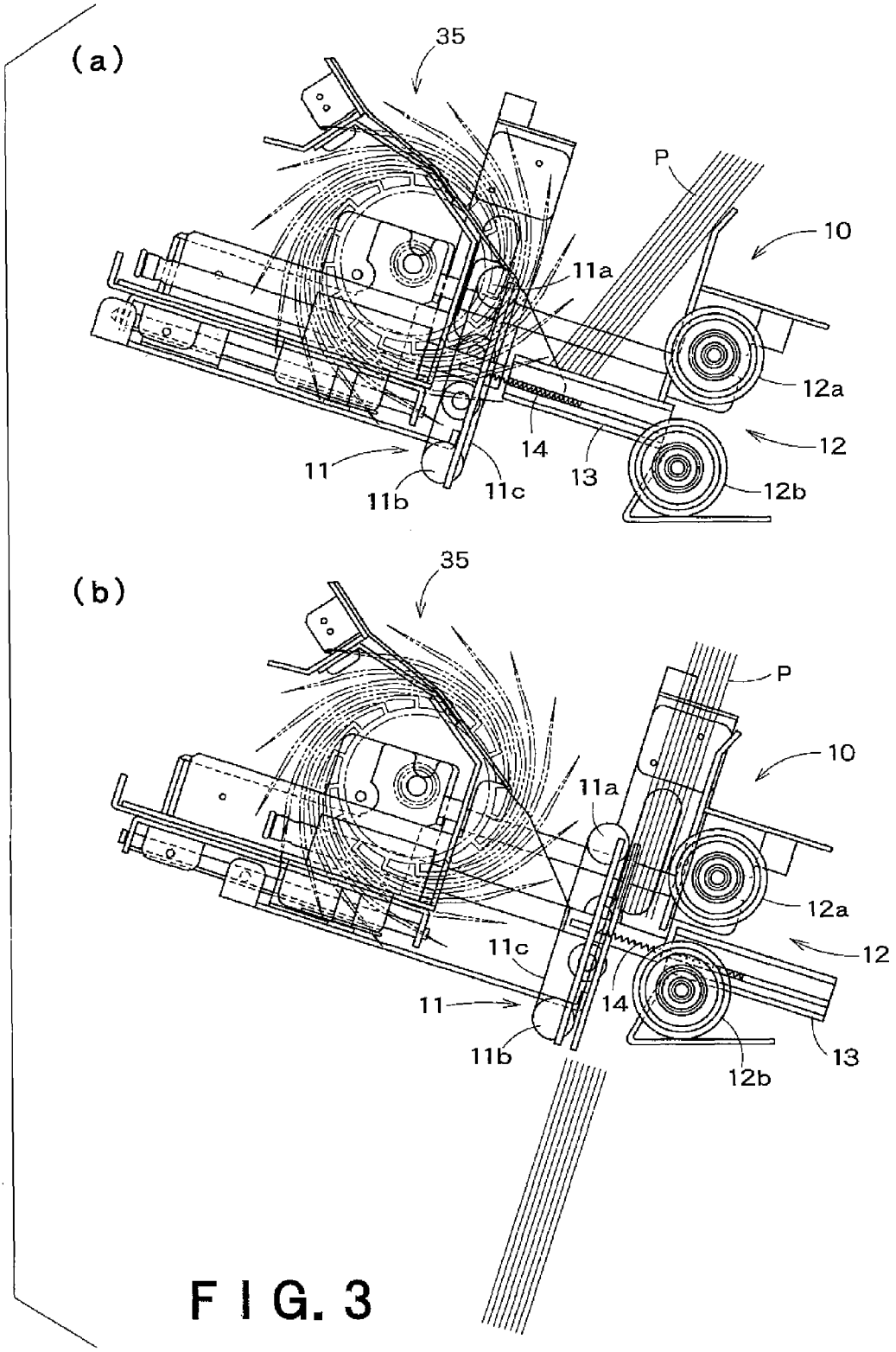
FIG. 3 is a lateral sectional view showing a concrete structure of a clamping and transporting mechanism of the banknote deposit apparatus shown in FIG. 1.

A first embodiment of the present invention will be described herebelow with reference to the drawings. FIGS. 1 to 3 are views showing a banknote deposit apparatus according to this embodiment.

As shown in FIG. 2, the banknote deposit apparatus includes: a housing 1; a placement unit 20 disposed on the housing 1, on which a plurality of banknotes P are placed; a reception unit 25 configured to take in, one by one, the plurality of banknotes P placed on the placement unit 20; a transport unit 30 configured to transport the banknotes P that have been taken in by the reception unit 25; a stacking unit 60 configured to stack the banknotes P that have been transported by the transport unit 30; a recognition unit 40 disposed on the transport unit 30, and configured to recognize a denomination and an authenticity of the banknotes P that are being transported by the transport unit 30 and to count the number of the banknotes P; and a storing box (storing cassette) 70 configured to receive and store the banknotes P that have been stacked in the stacking unit 60.

As shown in FIG. 2, the reception unit 25 includes: a kicker roller 26 configured to give a drive force to the banknote P that is located on the lowermost position of the plurality of banknotes P placed on the placement unit 20; and a feed roller 27*a* located on a downstream side of the kicker roller 26 in a feeding direction of the banknote P, and configured to feed the banknote having been kicked by the kicker roller 26 to an inside of the housing 1. In addition, a gate roller (reverse roller) 27*b* is disposed opposedly to the feed roller 27*a*, and a gate unit is formed between the feed roller 27*a* and the gate roller 27*b*.

In addition, as shown in FIG. 2, the transport unit 30 is composed of a transport belt 31 configured to transport the banknote P, a transport roller 32 and so on. In addition, on a most downstream part of the transport unit 30 and near to the stacking unit 60, there is provided a stacking wheel 35 configured to receive, one by one, the banknotes P, which have been transported by the transport unit 30, between fins 35*a*, and to align and stack the banknotes P in the stacking unit 60.

In addition, as shown in FIG. 2, the stacking unit 60 has a such a shape that the banknotes P are stacked in a forwardly inclined state. The stacking unit 60 is configured to support the banknotes P, which have been sent from the transport unit 30, by a support unit 64, such that the banknotes P are stacked in a forwardly inclined standing state. Herein, the forward (front) side means a side on which an operator places the banknote P on the placement unit 20 and takes out the banknote P from the stacking unit 60 through a front opening 61 which will be described below, and means the right side of FIG. 2. On the other hand, a rear side herein means a side opposed to the front side, and means the left side of FIG. 2.

In addition, on the front side of the stacking unit 60, there are provided the front opening 61 (see FIG. 2) through which the stacked banknotes P are taken out from outside, and a front shutter unit 62 (see FIG. 1) configured to open and close the front opening 61. Thus, the front shutter unit 62 is controlled to be unopenable by a below-described control unit 50, at least when the banknote P is transported to the storing box 70 by a clamping and transporting mechanism 10 (described hereafter).

In addition, as shown in FIG. 2, disposed on the stacking unit 60 is the clamping and transporting mechanism 10 configured to clamp surfaces of the banknotes P stacked in the stacking unit 60, and to transport the banknotes P to a direction parallel with the surfaces, thereby to store the banknotes P into the storing box 70. More specifically, the clamping and transporting mechanism 10 is configured to clamp the surface of the banknote P located on the frontmost side of the plurality of banknotes P stacked in the stacking unit 60 and the surface of the banknote P located on the rearmost side, and to collectively transport the plurality of banknotes P to the storing box 70 (see the arrow $A_1$ in FIG. 2).

As shown in FIGS. 3(*a*) and 3(*b*), the clamping and transporting mechanism 10 includes: a slide unit 13 configured to support lower ends of the banknotes P that are stacked in the forwardly inclined standing state in the stacking unit 60, and configured to be slid to be opened when the banknotes P are stored into the storing box 70; a first contacting and transporting unit 11 configured to come into contact with the surface of the banknote P located on the rearmost side of the plurality of banknotes P, when the slide unit 13 is slid to be opened; and a second contacting and transporting unit 12 configured to come into contact with the surface of the banknote P located on the frontmost side of the plurality of banknotes P, when the slide unit 13 is slid to be opened.

The first contacting and transporting unit 11 is composed of a first upper roller 11*a* configured to come into contact with a lower part of the stacked banknotes P, a first lower roller 11*b* located above a below-described slit opening 71 of the storing box 70, a belt 11*c* extended between the rollers and so on. The first contacting and transporting unit 11 is rotatably disposed so as to transport the stacked banknotes P downward. The second contacting and transporting unit 12 is composed of a second upper roller 12*a* opposed to the first upper roller 11*a*, and a second lower roller 12*b* opposed to the first lower roller 11*b*. The second upper roller 12*a* and the second lower roller 12*b* are respectively configured to give a drive force to the stacked banknotes P such that the stacked banknotes P are transported downward.

Disposed between the slide unit 13 and the first contacting and transporting unit 11 is a resilient member 14, such as a spring, on a position where the lower part of the stacked banknotes P are avoided. When the slide unit 13 is moved forward (see FIG. 3(*b*)), the first contacting and transporting unit 11 is pulled forward. Since the first contacting and transporting unit 11 is pulled forward, the plurality of banknotes P are clamped between the first contacting and transporting unit 11 and the second contacting and transporting unit 12.

In this embodiment, although the second contacting and transporting unit 12 gives a drive force to the surface of the banknote P and the first contacting and transporting unit 11 is merely rotatable, the present invention is not limited thereto. For example, reversely to the above embodiment, the first contacting and transporting unit 11 may be configured to give a drive force to the surface of the banknote P and the second contacting and transporting unit 12 may be merely rotatable. Alternatively, both the first contacting and driving unit 11 and the second contacting and driving unit 12 may be configured to give a drive force to the surface of the banknote P.

In addition, as shown in FIG. 2, the storing box 70 includes the slit opening 71 through which the banknote P transported by the clamping and transporting mechanism 10 is taken in, and a slit shutter unit 72 for opening and closing the slit opening 71. As shown in FIG. 1, the storing box 70 is removably arranged in a storing housing 75 that can be locked by a lock member 76.

In addition, as shown in FIG. 2, the banknote deposit apparatus includes the control unit 50 configured to switch a storing mode and a counting mode. In the storing mode, while the banknote P, which has been taken in by the reception unit 25, is transported by the transport unit 30, a denomination and an authenticity of the banknote P is recognized by the recognition unit 40, then the banknote is transported to the stacking unit 60, and the banknote P, which has been transported to the stacking unit 60, is transported to the storing box 70 by the clamping and transporting mechanism 10. In the counting mode, while the banknote P, which has been taken in by the reception unit 25 is transported by the transport unit 30, a denomination and an authenticity of the banknote P is recognized by the recognition unit 40, then the banknote is transported to the stacking unit 60, and the banknote P, which has been transported to the stacking unit 60, can be taken out from outside through the front opening 61, without actuating the clamping and transporting mechanism 10.

As shown in FIG. 1, the housing 1 is provided with a display and input unit 5 having a function for displaying predetermined information and a function for enabling data inputting. As shown in FIG. 2, the transport unit 30 is provided with a reject unit 65 to which the banknote P, which is not transported to the stacking unit 60, is transported, when an abnormality occurs.

The abnormality herein means a recognition abnormality and a transport abnormality. The recognition abnormality means a case in which information recognized by the recognition unit 40 does not correspond to information previously stored in the control unit 50. Examples of this recognition abnormality are a case in which the banknote P was recognized as a banknote whose type is different from a foreordinated type, a case in which the type of the banknote P could not be recognized, etc.

The transport abnormality means an abnormality when the banknote P is transported by the transport unit 30. Examples of this transport abnormality are a case in which the banknote P is transported obliquely (skewed state), a case in which the plurality of banknotes P are transported without a predetermined interval therebetween (chained state), a case in which the plurality of banknotes P are transported overlappingly (overlapped state), etc.

Next, an operation of the banknote deposit apparatus in the first embodiment as structured above is described.

(Storing Mode)

Firstly, there is explained the storing mode in which a banknote P, which has been transported from the placement unit 20 to the stacking unit 60, is transported to the storing box 70 by the clamping and transporting mechanism 10. Unless otherwise specified, the following operations are performed based on signals transmitted from the control unit 50 to the respective units.

At first, an operator inputs a signal for selecting the storing mode to the control unit 50 through the display and input unit 5 (see FIG. 1). When the signal is received by the control unit 50, the front shutter unit 62 is controlled to be unopenable by the control unit 50.

Then, the operator places a plurality of banknotes P on the placement unit P (placing step) (see FIG. 2).

Then, the plurality of banknotes P placed on the placement unit 20 are taken in, one by one, by the reception unit 25 (taking-in step) (see FIG. 2). At this time, the banknote P located on the lowermost position of the plurality of banknotes P placed on the placement unit 20 is kicked by the kicker roller 26 and fed out by the feed roller 27*a*, so that the banknotes P are fed out, one by one, by the action of the gate roller 27*b*.

Then, the banknotes P, which have been taken in by the reception unit 25, are transported by the transport unit 30 (transporting step) (see FIG. 2). At this time, the banknotes P being transported by the transport unit 30 are recognized and counted by the recognition unit 40 disposed on the transport unit 30 (recognizing and counting step).

If the recognition abnormality and/or the transport abnormality occur while the banknotes P are transported by the transport unit 30, the banknote(s) P is (are) transported to the reject unit 65 (see FIG. 2) (rejecting step). On the other hand, when neither the recognition abnormality nor the transport abnormality occurs, the banknotes P being transported are transported to the stacking unit 60 (stacking step).

Namely, when the banknotes P are transported to the stacking unit 60, the banknotes P are received between the fins 35*a* of the stacking wheel 35 and are aligned and stacked in the stacking unit 60 (see FIG. 2). Then, the banknotes P, which have been transported by the stacking wheel 35, are stacked in the stacking unit 60 in the forwardly inclined standing state.

In the above manner, after all the plurality of banknotes P placed on the placement unit 20 have been transported to the stacking unit 60 so that there is no banknote P on the placement unit 20, a total sum of the banknotes P stacked in the stacking unit 60 is displayed on the display and input unit 5, and an accepting command to the total sum is inputted through the display and input unit 5 (accepting step).

If a banknote P is present in the reject unit 65, the operator places again the banknote P on the placement unit 20, and the same steps as above are repeated, such that all the banknotes P are transported to the stacking unit 60. However, if there is a banknote P which is nevertheless transported to the reject unit 65 after all trials, such a banknote P is judged as an unacceptable banknote P, and is eliminated from the banknotes to be stored. In addition, when the operator cannot accept the total sum, a returning command is inputted through the display and input unit 5. Thus, the front shutter 62 is opened so that the stacked banknotes P can be take out, and the process is finished.

As described above, when the accepting command is inputted through the display and input unit 5, the slide unit 13 is slid forward (to the right side of FIG. 3(*b*)) so as to be opened. At this time, the first contacting and transporting unit 11 is pulled forward by the resilient member 14 disposed between the slide unit 13 and the first contacting and transporting unit 11. As a result, the plurality of banknotes P stacked in the stacking unit 60 are clamped between the first contacting and transporting unit 11 and the second contacting and transporting unit 12 (clamping step).

Then, a drive force is given to the surface of the banknote P by the second contacting and transporting unit 12, and the plurality of banknotes P are collectively transported to the direction parallel with their surfaces (clamping and transporting step) (see FIG. 3(*b*)). At this time, the first contacting and transporting unit 11 is rotated along the moving direction of the banknotes P.

Then, the plurality of banknotes P, which have been transported to the direction parallel with their surfaces, are stored into the storing box 70 through the slit opening 71 (storing step) (see the arrow $A_1$ in FIG. 2). At this time, the slit shutter unit 72 has been moved forward, so that the slit opening 71 is opened. On the other hand, other than when the banknotes P are stored into the storing box 70, the slit shutter 72 has been moved rearward, so that the slit opening 71 is closed.

As described above, according to this embodiment, the plurality of banknotes P stacked in the stacking unit 60 are clamped and transported to the direction parallel with their surfaces by the clamping and transporting mechanism 10, so that the plurality of banknotes P can be stored into the storing box 70. Thus, the size of the transport path extending from the stacking unit 60 to the storing box 70 can be reduced (for example, to about 20 mm which does not allow entering of a human hand). As a result, the banknote P in the storing box 70 can be prevented from being picked out through the front opening 61, whereby the thief-proof property of the banknote deposit apparatus can be improved.

In addition, according to this embodiment, during the storing mode, the front shutter unit 62 is controlled to be unopenable by the control unit 50. Thus, the banknote P in the storing box 70 can be more reliably prevented from being picked out through the front opening 61.

In addition, since the storing box 70 does not have a large opening but has merely the slit opening 71, the banknote P in the storing box 70 can be further reliably prevented from being picked out.

In this embodiment, the plurality of banknotes P are clamped by the clamping and transporting mechanism 10, and the plurality of banknotes P are transported toward the storing box 70 while they are being clamped. Thus, the plurality of banknotes P can be transported toward the storing box 70 with a reduced thickness of the banknotes P, whereby a thickness 71D (see FIG. 1) of the slit opening 71 can be reduced. As a result, the thief-proof property of the banknote deposit apparatus can be further improved. In addition, since the plurality of banknotes P are clamped and transported to the storing box 70 by the clamping and transporting mechanism 10, even when banknotes of different types and various sizes are mixed, the banknotes can be reliably transported to the storing box 70.

Further, according to this embodiment, other than when the plurality of banknotes P in the stacking unit 60 are stored into the storing box 70, the slit shutter unit 72 is moved rearward so that the sit opening 71 is closed. Thus, the banknote P in the storing box 70 can be furthermore reliably prevented from being picked out through the front opening 61.

The above embodiment has been described by taking the example in which, when all the plurality of banknotes P placed on the placement unit 20 have been transported to either of the stacking unit 60 or the reject unit 65 so that there is no banknote P on the placement unit 20, the clamping step, the clamping and transporting step and the storing step are carried out. However, not limited thereto, the clamping step, the clamping and transporting step and the soring step may be carried out, when the predetermined number of banknotes P have been transported from the placement unit 20 to the stacking unit 60.

According to this embodiment, the number of the banknotes P to be clamped by the clamping and transporting mechanism 10 can be not more than the predetermined number (e.g., 200), whereby the thickness of the banknotes P clamped by the clamping and transporting mechanism 10 can be made not more than a certain value. Thus, the thickness 71D of the slit opening 71 can be made not more than a certain value. Namely, it is possible to needlessly increase the thickness 71D of the slit opening 71, which results in improvement of the thief-proof property of the banknote deposit apparatus.

(Counting Mode)

Next, there is explained the counting mode in which the banknote P placed on the placement unit 20 is transported to the stacking unit 60, and thereafter the banknote P can be taken out from outside through the front opening 61. Similarly to the storing mode, operations of the respective units in the counting mode are performed in principle based on signals transmitted from the control unit 50 to the respective units.

At first, an operator inputs a signal for selecting the counting mode to the control unit 50 through the display and input unit 5 (see FIG. 1). When the signal is received by the control unit 50, the front shutter unit 62 is controlled to be openable by the control unit 50.

The front shutter unit 62 may be automatically opened by a command from the control unit 50, or may be manually opened by releasing a lock (not shown) by a command from the control unit 50.

Then, the operator places a plurality of banknotes P on the placement unit 20 (placing step) (see FIG. 2).

Then, the plurality of banknotes P placed on the placement unit 20 are taken in, one by one, by the reception unit 25 (taking-in step) (see FIG. 2).

Then, the banknotes, which have been taken in by the reception unit 25, are transported by the transport unit 30 (transporting step). At this time, the banknotes P being transported by the transport unit 30 are recognized and counted by the recognition unit 40 disposed on the transport unit 30 (recognizing and counting step) (see FIG. 2).

If the recognition abnormality or the transport abnormality occur while the banknotes P are transported by the transport unit 30, the banknote P is transported to the reject unit 65 (see FIG. 2) (rejecting step). On the other hand, when neither the recognition abnormality nor the transport abnormality occurs, the banknotes P being transported are transported to the stacking unit 60 (stacking step).

Namely, when the banknotes P are transported to the stacking unit 60, the banknotes P are received between the fins 35*a* of the stacking wheel 35 and are aligned and stacked in the stacking unit 60. Then, the banknotes P are stacked in the stacking unit 60 in the forwardly inclined standing state.

In the above manner, after all the plurality of banknotes P placed on the placement unit 20 have been transported to either the stacking unit 60 and the reject unit 65 so that there is no banknote P on the placement unit 20, the operator takes out the plurality of banknotes P through the front opening 61, which has been opened by opening the front shutter unit 62 (see the arrow $A_2$ in FIG. 2).

At this time, according to this embodiment, the banknotes P having been transported to the stacking unit 60 are stacked in the stacking unit 60 in the forwardly inclined standing state. Thus, the plurality of banknotes P can be stacked such that the banknotes P are easily visible by the operator, and the banknotes P can be easily taken out from the stacking unit 60.

The above embodiment has been described by taking the example in which all the plurality of banknotes P placed on the placement unit 20 are transported to either of the stacking unit 60 or the reject unit 65 so that there is no banknote P on the placement unit 20. However, not limited thereto, an embodiment is possible where after the predetermined number of banknotes P have been transported from the placement unit 20 to the stacking unit 60 and the banknotes P have been removed from the stacking unit 60, the predetermined number of banknotes P are again transported from the placement unit 20 to the stacking unit 60. According to such an embodiment, bundles of banknotes containing the predetermined number of banknotes P can be obtained, which is advantageous.

As described above, according to the banknote deposit apparatus in this embodiment, not only the banknotes P can be recognized and counted in the counting mode, but also the banknotes P can be stored into the storing box 70 in the storing mode. When the one apparatus has both the function of counting the banknotes P and the function of storing the banknotes P, the thief-proof property becomes particularly important.

Regarding this viewpoint, this embodiment improves the thief-proof property, by reducing the size of the transport path extending from the stacking unit 60 to the storing box 70, by making the front shutter unit 62 unopenable during the storing mode, by providing, not a large opening, but the only slit opening 71 in the storing box 70, and by closing the slit opening 71 other than when the plurality of banknotes P in the stacking unit 60 are stored into the storing box 70. Therefore, the banknote deposit apparatus having both the function of counting the banknotes P and the function of storing the banknotes P can be provided with a sufficient practical usefulness.

According to this embodiment, since the stacking unit 60 carries out the escrowing function in the storing mode, and the function of stacking the counted banknotes P in the counting mode, the structure of the banknote deposit apparatus can be simplified. As a result, it is possible to provide the banknote deposit apparatus having both the function of counting the banknotes P and the function of storing the banknotes P, with a low manufacturing cost.

Second Embodiment

A second embodiment of the present invention will be described herebelow with reference to the drawings. FIGS. 1 to 11 are views showing a banknote deposit apparatus according to this embodiment. In the below description of the second embodiment, the same units as those of the first embodiment are shown by the same reference numbers, and description thereof is omitted.

Figure 4:
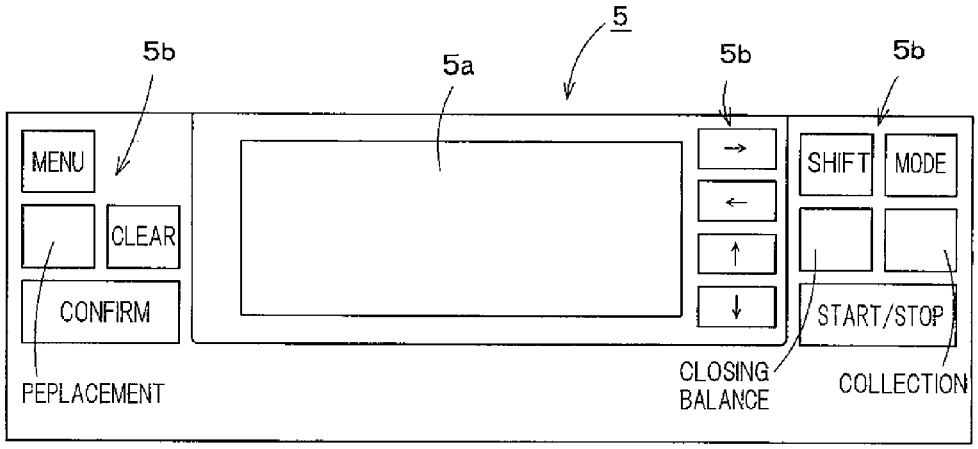

FIG. 4 shows a concrete structure of the display and input unit 5 disposed on the housing 1 of the banknote deposit apparatus. As shown in FIG. 4, the display and input unit 5 is composed of a monitor 5*a* configured to display a count result of banknotes P or the like, and a plurality of input keys 5*b* by which an operator can input various commands. The monitor 5*a* is configured to display, for example, the number of banknotes P for each denomination, which have been taken out from the stacking unit 60 to the outside of the housing 1 through the front opening 61, the number of banknotes P for each denomination, which are stored in the storing box 70. As shown in FIG. 4, the plurality of input keys 5*b* are composed of a menu key, a replacement key, a clear key, a confirm key, an upward arrow key, a downward arrow key, a rightward arrow key, a leftward arrow key, a shift key, a mode key, a closing balance key, a collection key, a start/stop key and so on.

Figure 5:
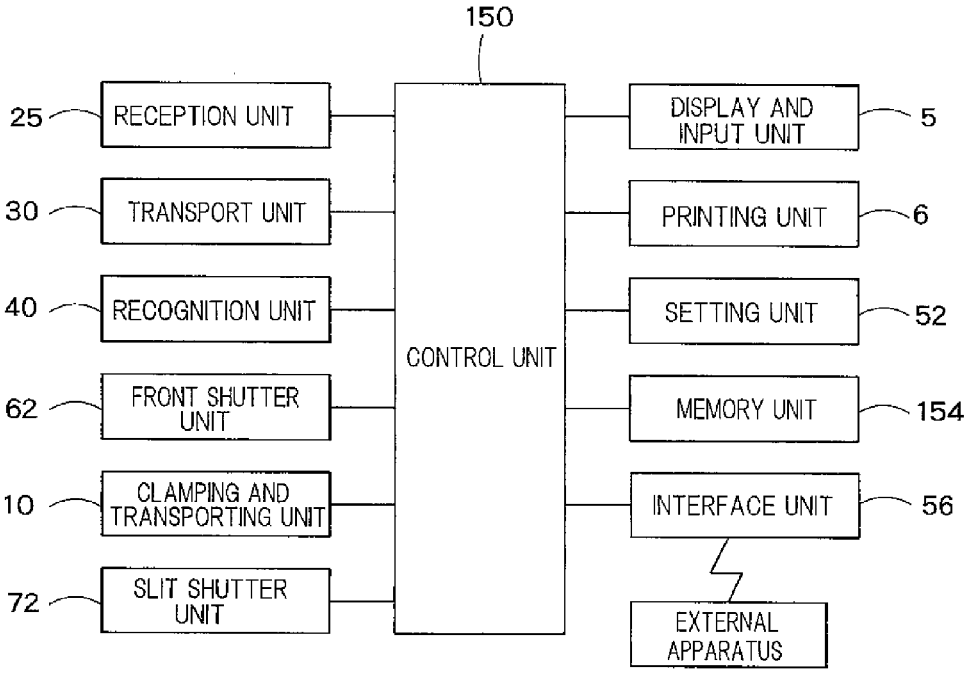

The banknote deposit apparatus in this embodiment is provided with a control unit 150 as shown in FIG. 5, in place of the control unit 50 of the banknote deposit apparatus according to the first embodiment. The control unit 150 is configured to control the respective constituent elements of the banknote deposit apparatus in the second embodiment. FIG. 5 shows a concrete structure of such a control unit 150. As shown in FIG. 5, connected to the control unit 150 are the reception unit 25, the transport unit 30, the recognition unit 40, the front shutter unit 62, the clamping and transporting mechanism 10, the slit shutter unit 72, the display and input unit 5 and so on. Recognition and count information of banknotes P, which have been recognized and counted by the recognition unit 40, is transmitted to the control unit 150. In addition, various commands from an operator, which have been inputted by the respective input keys 5*b* of the display and input unit 5, are transmitted to the control unit 150. The control unit 150 is configured to transmit control signals to the respective constituent elements such as the reception unit 25, the transport unit 30, the front shutter unit 62, the clamping and transporting mechanism 10, the slit shutter unit 72, the display and input unit 5 and so on, so as to control these constituent elements.

In addition, as shown in FIG. 5, a printing unit 6 such as a printer is connected to the control unit 150, for example. The printing unit 6 may be fixed on the housing 1 of the banknote deposit apparatus or may be provided separately from the housing 1. The printing unit 6 is configured to print a count result of banknotes P or the like. To be specific, the printing unit 6 is configured to print the number of banknotes P for each denomination, which have been taken out from the stacking unit 60 to the outside of the housing 1 through the front opening 61, and the number of banknotes P for each denomination, which are stored in the storing box 70.

In addition, as shown in FIG. 5, a setting unit 52 is connected to the control unit 150. The setting unit 52 is configured to set a denomination of a banknote P, which is to be taken out from the stacking unit 60 to the outside of the housing 1 through the front opening 61, and the number of the banknotes for each denomination, based on a command inputted by the operator through the respective input keys 5*b* of the display and input unit 5 and transmitted to the control unit 150. In addition, the setting unit 52 can set the batch number of taken-out banknotes P to be taken out from the stacking unit 60 to the outside of the housing 1 through the front opening 61 upon a batch taking-out operation. The batch taking-out operation herein means that, for each time when the banknotes P of the same denomination whose number becomes the predetermined batch number are stacked in the stacking unit 60, there is repeated an operation in which the banknotes P whose number is the batch number are collectively taken out to the outside of the housing 1. The setting unit 52 can also set the number of times of taking-out operations in the batch taking-out operation. In other words, the (total) number of taken-out banknotes P to be taken out to the outside of the housing 1 is equal to a product of the set batch number and the set number of times of taking-out operations.

As shown in FIG. 5, a memory unit 154 is connected to the control unit 150. The memory unit 154 is configured to store the setting contents set by the setting unit 52, a count result of banknotes P (specifically, e.g., the number of banknotes P for each denomination, which have been taken out from the stacking unit 60 to the outside of the housing 1 through the front opening 61, and the number of banknotes P for each denomination, which are stored in the storing box 70) and so on.

In addition, as shown in FIG. 5, an interface unit 56 is connected to the control unit 150. The control unit 150 can transmit and receive a signal to and from an external apparatus, such as a higher-level apparatus on the outside, through the interface unit 56.

Next, an operation of the banknote deposit apparatus in the second embodiment as structured above is described.

In the banknote deposit apparatus in this embodiment, while banknotes P, which have been taken in by the reception unit 25 to the inside of the housing 1, are transported one by one by the transport unit 30, a denomination, an authenticity and so on of the banknotes P are recognized by the recognition unit 40, and then the banknotes P are transported to the stacking unit 60. Thereafter, the banknotes P having been transported to the stacking unit 60 are either transported by the clamping and transporting mechanism 10 to the storing box 70 (see the arrow $A_1$ of FIG. 2), or are taken out from outside through the front opening 61 without actuating the clamping and transporting mechanism 10 (see the arrow $A_2$ of FIG. 2). Which process is performed is determined by the control unit 150, based on the set contents set by the setting unit 52. Herebelow, there are respectively described a case in which banknotes P of one denomination are placed on the placement unit 20, and a case in which banknotes P of plural denominations are placed on the placement unit 20.

Figure 6:
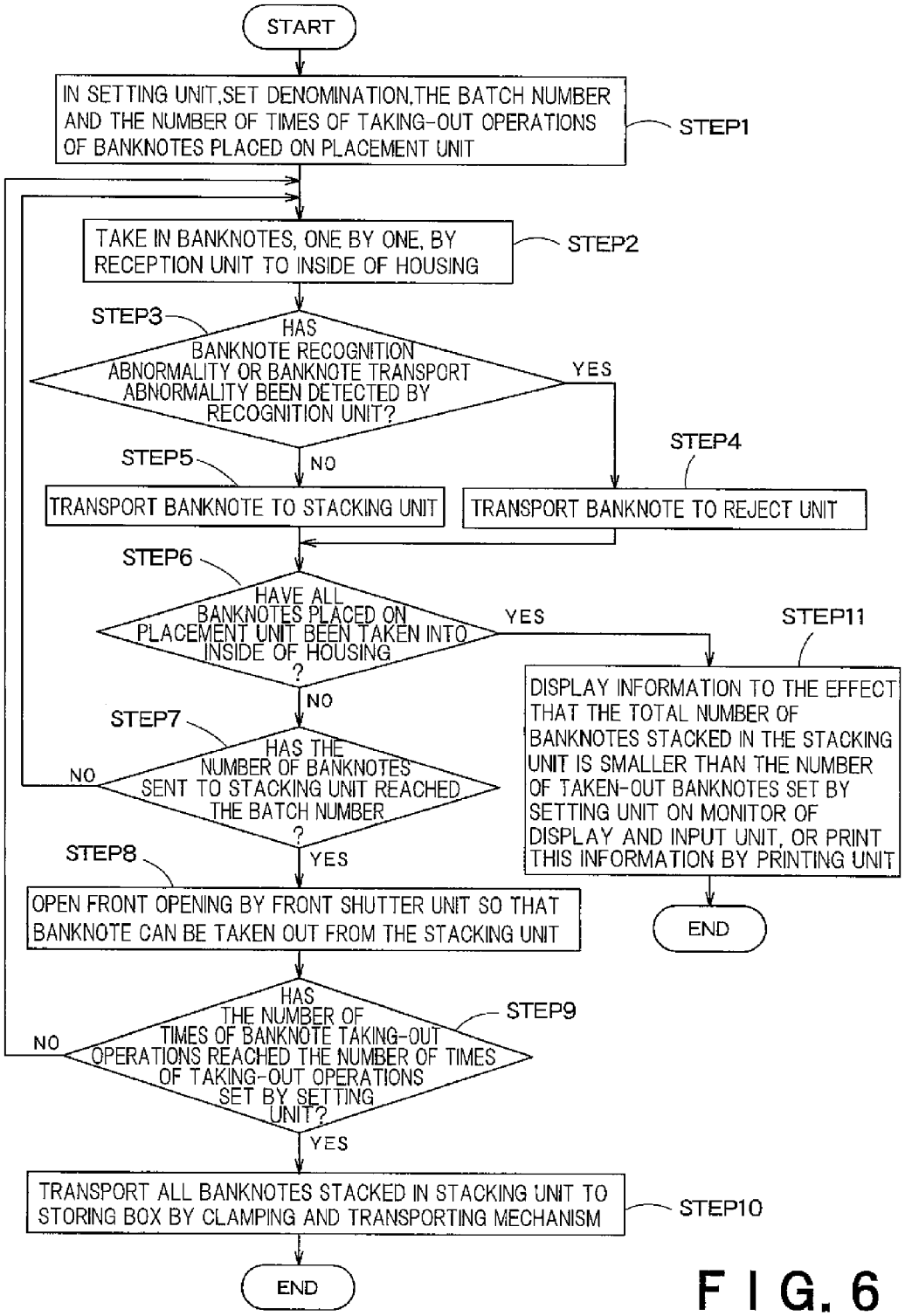
FIG. 6 is a flowchart showing an operation in the banknote deposit apparatus shown in FIG. 1 and so on, when the number of denominations of banknotes placed on a placement unit is one.

Firstly, there is described the case in which the number of denominations of banknotes P placed on the placement unit 20 is one, with reference to the flowchart shown in FIG. 6.

In the case where a deposit process of banknotes P of one denomination is performed in the banknote deposit apparatus, before the banknotes P placed on the placement unit 20 are taken in by the reception unit 25 to the inside of the housing 1, an operator inputs the denomination of the banknotes P placed on the placement unit 20, and the number of taken-out banknotes P to be taken out from the stacking unit 60 to the outside of the housing 1 through the front opening 61, through the respective input keys 5*b* of the display and input unit 5, and the setting unit 52 sets information of the taken-out banknotes P based on the inputted information. To be specific, the operator inputs the batch number and the number of times of taking-out operations when the taken-out banknotes P are taken out in a batch (STEP 1 in FIG. 6). At this time, the information of the taken-out banknotes P set by the setting unit 52 is displayed on the monitor 5*a* of the display and input unit 5. When the number of denominations of the banknotes P placed on the placement unit 20 is one, the denomination of the banknotes P placed on the placement unit 20, which has been inputted by the operator, is the same as the denomination of the taken-out banknotes P to be taken out from the stacking unit 60 to the inside of the housing 1 through the front opening 61. Hereafter, there is described a case in which the denomination of the banknotes P placed on the placement unit 20 is set as 1,000 yen, the batch number is set as ten, and the number of times of the taking-out operations is set as ten, for example.

Before the banknotes P placed on the placement unit 20 are taken in by the reception unit 25 to the inside of the housing 1, the front opening 61 is closed by the front shutter unit 62.

When the operator presses down the start/stop key of the display and input unit 5, the banknotes P placed on the placement unit 20 are taken in, one by one, by the reception unit 25 to the inside of the housing 1, and are transported by the transport unit 30 (STEP 2 in FIG. 6). At this time, the banknotes P being transported by the transport unit 30 are recognized and counted by the recognition unit 40 disposed on the transport unit 30 (STEP 3 in FIG. 6). If the recognition abnormality or the transport abnormality occurs ("YES" of STEP 3 in FIG. 6) during the transportation of the banknotes P by the transport unit 30, the banknote P is transported to the reject unit 65 (STEP 4 in FIG. 6). On the other hand, when neither the recognition abnormality nor the transport abnormality occurs ("NO" of STEP 3 in FIG. 6), the banknotes P being transported by the transport unit 30 are transported to the stacking unit 60 (STEP 5 in FIG. 6). Until the number of the banknotes P having been sent to the stacking unit 60 reaches the batch number having been set by the setting unit 52 (specifically, e.g., ten), the operations shown in the STEP 2 to STEP 5 in FIG. 6 are repeated ("NO" of STEP 7 in FIG. 6).

On the other hand, when the number of banknotes P having been sent to the stacking unit 60 reaches the batch number having been set by the setting unit 52 ("YES" of STEP 7 in FIG. 6), the front shutter unit 62 opens the front opening 61, so that the operator can take out the bundle of ten banknotes P from the stacking unit 60 through the front opening 61 (STEP 8 in FIG. 6). Then, when the taken-out banknotes P have been taken out by the operator from the stacking unit 60 to the outside of the housing 1 through the front opening 61, the front shutter unit 62 again closes the front opening 61. Thereafter, when the number of times of taking-out operations of the taken-out banknotes P does not reach the number of times of taking-out operations (specifically, e.g., 10 times) set by the setting unit 52 ("NO" of STEP 9 in FIG. 6), the operations shown in STEP 2 to STEP 8 in FIG. 6 are again performed.

When the number of times of taking-out operations of the taken-out banknotes P reaches the number of times of taking-out operations set by the setting unit 52 ("YES" of STEP 9 in FIG. 6), i.e., when the operation in which the bundle of ten taken-out banknotes P is taken out from the stacking unit 60 to the outside of the housing 1 through the front opening 61 is performed ten times, there is succeedingly performed an operation in which the banknotes P remaining on the placement unit 20 are taken in by the reception unit 25 to the inside of the hosing 1 and the banknotes P are transported to the stacking unit 60 via the transport unit 30. While this operation is being performed, the front shutter 62 keeps the front opening 61 closed. Then, after all the banknotes P placed on the placement unit 20 have been taken to the inside of the housing 1, all the banknotes P stacked in the stacking unit 60 are transported to the storing box 70 by the clamping and transporting mechanism 10 (STEP 10 in FIG. 6).

While the aforementioned operations shown in STEP 2 to STEP 10 are being performed, count information of the banknotes P is displayed on the monitor 5*a* of the display and input unit 5. To be specific, the monitor 5*a* is configured to display the number of taken-out banknotes P for each denomination, which have been taken out from the stacking unit 60 to the inside of the housing 1 through the front opening 61, and a sum of the taken-out banknotes P, and the number of stored banknotes P for each denomination, which are stored in the storing box 70, and a sum of the stored banknotes P. In addition, the monitor 5*a* is configured to display a total sum that is obtained by adding the sum of the taken-out banknotes P which have been taken out from the stacking unit 60 to the outside of the housing 1 through the front opening 61, and the sum of the stored banknotes P which are stored in the storing box 70.

Finally, the control unit 150 calculates a deposit sum by adding the sum of the banknotes which have been taken out from the stacking unit 60 to the outside of the housing 1 through the front opening 61 (specifically, 1000-yen banknote×10 (number of banknotes)×10 (number of times of operations)=100,000 yen) and the sum of the banknotes which are stored in the storing box 70. the calculated deposit sum is stored in the memory unit 154, displayed on the monitor 5*a* of the display and input unit 5, printed by the printing unit 6, or transmitted to the external apparatus by the interface unit 56.

A case in which, before the number of times of taking-out operations of the taken-out banknotes P reaches the number of times of taking-out operations set by the setting unit 52, all the banknotes P placed on the placement unit 20 are taken to the inside of the housing 1 ("YES" of STEP 6 in FIG. 6) means that the total number of the banknotes stacked in the stacking unit 60 is smaller than the number of taken-out banknotes P set by the setting unit 52. In this case, this information is displayed on the monitor 5*a* of the display and input unit 5. Specifically, the field of the number of taken-out banknotes P is inversely displayed on the monitor 5*a*. In addition, in this case, this information may be printed by the printing unit 6 (STEP 11 in FIG. 6).

Figures 7, 8:
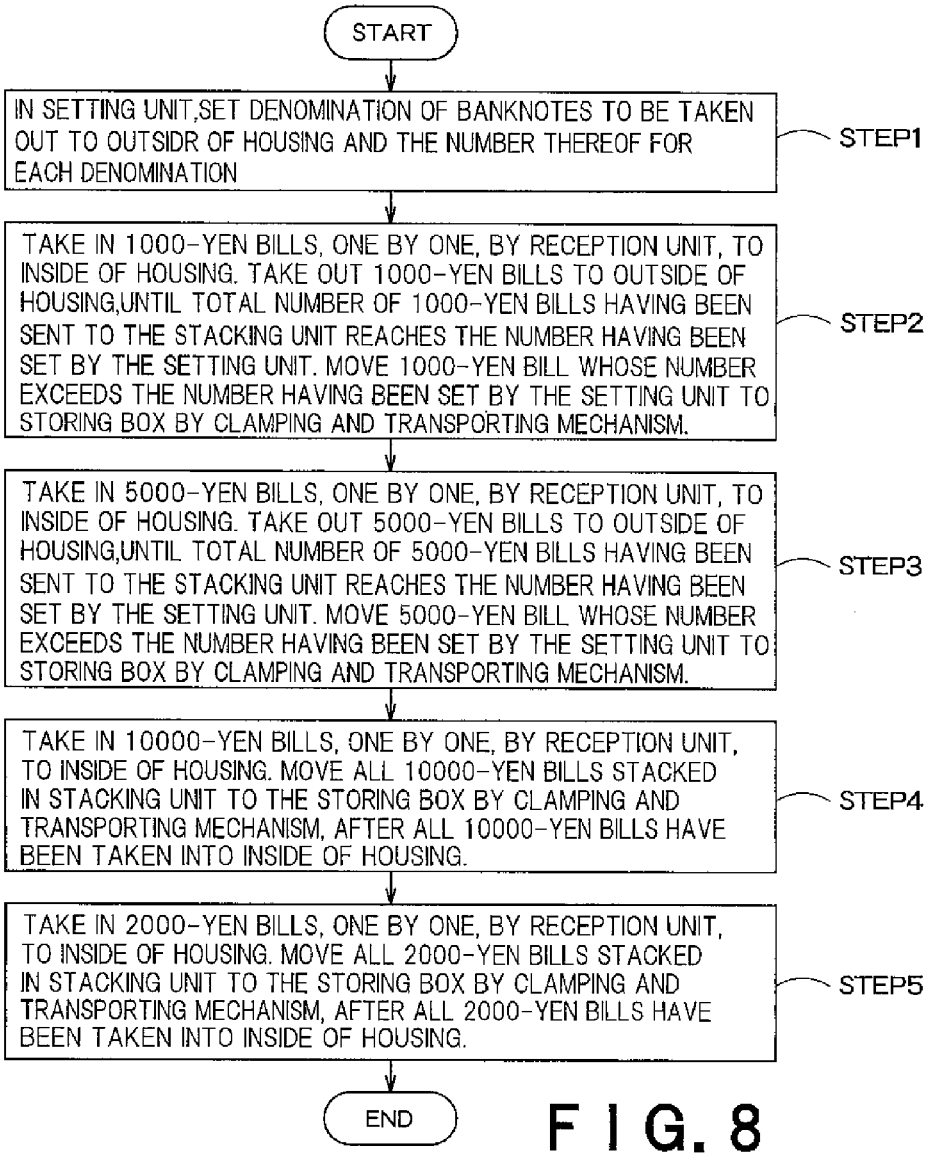
FIG. 7 is a view showing a screen image (upon setting) of a monitor of the display and input unit in the banknote deposit apparatus shown in FIG. 1 and so on, when the number of denominations of banknotes placed on the placement unit is more than one.
FIG. 8 is a flowchart showing an operation in the banknote deposit apparatus shown in FIG. 1 and so on, when the number of denominations of banknotes placed on the placement unit is more than one.

Next, there is described a case in which the number of denominations of the banknotes P placed on the placement unit 20 is plural, with reference to the screen image of the monitor 5*a* of the display and input unit 5 shown in FIGS. 7 and 9 and the flowchart shown in FIG. 8.

Figure 11:
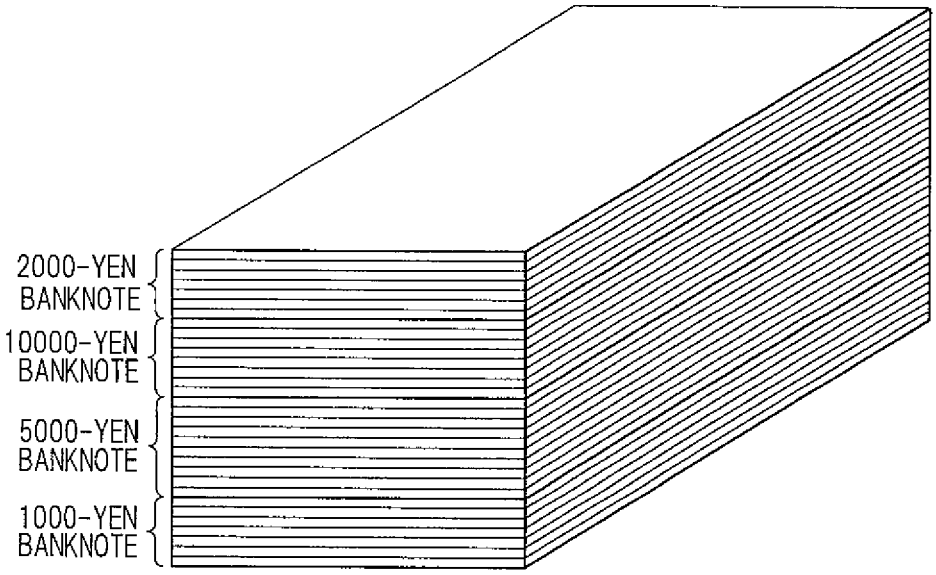
FIG. 11 is an explanatory view showing a structure of a bundle of banknotes of more than one denominations, which are placed on a placement unit, in the banknote deposit apparatus according to the second embodiment of the present invention.

When a deposit process of banknotes P of plural denominations is performed in the banknote deposit apparatus, a bundle of the banknotes P to be placed on the placement unit 20 is formed by superposing bundles of banknotes P, which have been stored by denomination in a register drawer of a register. Namely, since the bundles of banknotes, which have been stored by denomination, are superposed one on another and are placed on the placement unit 20, the bundle of banknotes P placed on the placement unit 20 have layers by denomination. Specifically, 1000-yen banknotes, 2000-yen banknotes, 5000-yen banknotes and 10000-yen banknotes are stored by denomination in the register drawer of the register, and bundles of these banknotes of the respective denominations are superposed one on another and placed on the placement unit 20. To be more specific, as shown in FIG. 11, the bundle of banknotes P are placed on the placement unit 20 such that a layer of 1000-yen banknotes, a layer of 5000-yen banknotes, a layer of 10000-yen banknotes and a layer of 2000-yen banknotes are formed in this order from below. Thus, the banknotes P placed on the placement unit 20 are taken in by the reception unit 25 to the inside of the housing 1, in the order of 1000-yen banknote, 5000-yen banknote, 10000-yen banknote and 2000-yen banknote.

In addition, before the banknotes P placed on the placement unit 20 are taken in by the reception unit 25 to the inside of the housing 1, an operator firstly inputs a denomination of taken-out banknotes P to be taken out from the stacking unit 60 to the outside of the housing 1 through the front opening 61, and the number of the taken-out banknotes P for each denomination, through the respective input keys 5*b* of the display and input unit 5, and the setting unit 52 sets information of the taken-out banknotes P based on the inputted information (STEP 1 in FIG. 8). To be specific, the operator inputs the batch number and the number of times of taking-out operations when the taken-out banknotes P to be taken out to the outside of the housing 1 are taken out in a batch. As shown in FIG. 7, the information of the taken-out banknotes P set by the setting unit 52 is displayed on the monitor 5*a* of the display and input unit 5.

The process is described in more detail with reference to FIG. 7. For example, the setting unit 52 sets 1000-yen and 5000-yen as denominations of the taken-out banknotes P to be taken out to the outside of the housing 1, and sets the number of 1000-yen banknotes to be taken out as one hundred, and the number of 5000-yen banknotes to be taken out as ten. The batch number of 1000-yen banknotes is set as twenty, and the number of times of taking-out operations (the number of bundles of banknotes P) is set as five. The batch number of 5000-yen banknotes is set as five, and the number of times of taking-out operations (the number of bundles of banknotes P) is set as two. On the other hand, regarding the 2000-yen banknotes and the 10000-yen banknotes, 2000-yen and 10000-yen are not set as denominations of banknotes P to be taken out to the outside of the housing 1.

Before the banknotes P placed on the placement unit 20 are taken in by the reception unit 25 to the inside of the hosing 1, the font opening 61 is closed by the front shutter unit 62.

When the operator presses down the start/stop key of the display and input unit 5, the banknotes P placed on the placement unit 20 are taken in, one by one, by the reception unit 25 to the inside of the housing 1. Specifically, the 1000-yen banknotes are firstly taken in, one by one, by the reception unit 25 to the inside of the housing 1. Then, for each time when the number of 1000-yen banknotes having been sent to the stacking unit 60 reaches the batch number (specifically, e.g., twenty) set by the setting unit 52, the front shutter unit 62 opens the front opening 61, so that the operator can take out the bundle of twenty 1000-yen banknotes from the stacking unit 60 through the front opening 61. Then, when the number of times of taking-out operations of 1000-yen banknotes reaches the number of times of taking-out operations (specifically, e.g., five) set by the setting unit 52, there is succeedingly performed an operation in which the 1000-yen banknote remaining on the placement unit 20 is taken in by the reception unit 25 to the inside of the housing 1 and transported to the stacking unit 60 via the transport unit 30. While this operation is being performed, the front shutter unit 62 keeps the front opening 61 closed. Thereafter, after all the 1000-yen banknotes placed on the placement unit 20 have been taken to the inside of the housing 1, all the 1000-yen banknotes stacked in the stacking unit 60 are transported to the storing box 70 by the clamping and transporting mechanism 10 (STEP 2 in FIG. 8).

Then, the 5000-yen banknotes are taken in, one by one, by the reception unit 25 to the inside of the housing 1. Similarly to the 1000-yen banknotes, for each time when the number of 5000-yen banknotes having been sent to the stacking unit 60 reaches the batch number (specifically, e.g., five) set by the setting unit 52, the front shutter unit 62 opens the front opening 61, so that the operator can take out the bundle of five 5000-yen banknotes from the stacking unit 60 through the front opening 61. Then, when the number of times taking-out operations of 5000-yen banknotes reaches the number of times of taking-out operations (specifically, e.g., two) set by the setting unit 52, there is succeedingly performed an operation in which the 5000-yen banknote remaining on the placement unit 20 is taken in by the reception unit 25 to the inside of the housing 1 and transported to the stacking unit 60 via the transport unit 30. While this operation is being performed, the front shutter unit 62 keeps the front opening 61 closed. Thereafter, after all the 5000-yen banknotes placed on the placement unit 20 have been taken to the inside of the housing 1, all the 5000-yen banknotes stacked in the stacking unit 60 are transported to the storing box 70 by the clamping and transporting mechanism 10 (STEP 3 in FIG. 8).

Then, 10000-yen banknotes are taken in, one by one, by the reception unit 25 to the inside of the housing 1. Differently from the 1000-yen banknotes and the 5000-yen banknotes, the front shutter 62 keeps the front opening 61 closed, so that the 10000-yen banknotes having been sent to the stacking unit 60 cannot be taken out to the outside of the housing 1. After all the 10000-yen banknotes placed on the placement unit 20 have been taken to the inside of the housing 1, all the 10000-yen banknotes stacked in the stacking unit 60 are transported to the storing box 70 by the clamping and transporting mechanism 10 (STEP 4 in FIG. 8).

Then, the 2000-yen banknotes are taken in, one by one, by the reception unit 25 to the inside of the housing 1. Similarly to the 10000-yen banknotes, the front shutter unit 62 keeps the front opening 61 closed, so that the 2000-yen banknotes having been sent to the stacking unit 60 cannot be taken out to the outside of the housing 1. After all the 2000-yen banknotes placed on the placement unit 20 have been taken to the inside of the housing 1, all the 2000-yen banknotes stacked in the stacking unit 60 are transported to the storing box 70 by the clamping and transporting mechanism 10 (STEP 5 in FIG. 8).

While the operations shown in the above STEP 2 to STEP 5 are being performed, as shown in FIG. 9, the monitor 5*a* of the display and input unit 5 is configured to show count information of the banknotes P. More specifically, the monitor 5*a* is configured to display a deposit sum obtained by adding the sum of the taken-out banknotes P which have been taken out from the stacking unit 60 to the outside of the housing 1 through the front opening 61, and the sum of the stored banknotes P which are stored in the storing box 70, and the deposit number for each denomination, and a total sum of the banknotes of all the denominations (1,064,000 yen) (see the field of "counted sum" in FIG. 9). In addition, the monitor 5*a* is configured to display the number of taken-out banknotes P for each denomination, which have been taken out from the stacking unit 60 to the outside of the housing 1 through the front opening 6, and the number of bundles of the taken-out banknotes P in the batch taking-out operation (see the field of "preparation number" in FIG. 9). In addition, the monitor 5*a* is configured to display the number of stored banknotes P for each denomination (see the filed of "stored number" in FIG. 9) which are stored in the storing box 70, and a total sum of the stored banknotes P of all the denominations (914,000 yen, see the field of "cassette amount-of-money data" in FIG. 9) which are stored in the storing box 70, respectively.

In addition, the operator can give a command for causing the printing unit 6 to print the display screen image of the monitor 5*a* shown in FIG. 9, to the control unit 150 through the display and input unit 5. When such a command is given, the display screen image of the monitor 5*a* shown in FIG. 9 is printed.

In addition, when 1000-yen banknotes or 5000-yen banknotes are taken in by the reception unit 25 to the inside of the housing 1, before the number of times of taking-out operations of 1000-yen banknotes or 5000-yen banknotes reaches the number of times of taking-out operations, there is a case in which all the 1000-yen banknotes or 5000-yen banknotes placed on the placement unit 20 are taken to the inside of the housing 10. This means that the total number of the banknotes stacked in the stacking unit 60 is smaller than the number of taken-out banknotes P set by the setting unit 52. In this case, this information is displayed on the monitor 5*a* of the display and input unit 5. Specifically, the field of the number of taken-out banknotes P is inversely displayed on the monitor 5*a*. In addition, in this case, this information may be printed by the printing unit 6.

As described above, according to the banknote deposit apparatus in this embodiment, the setting unit 52 sets a denomination of taken-out banknotes P to be taken out to the outside of the housing 1 and the number of the taken-out banknotes P for each denomination. When the banknotes P, whose denomination has been set by the setting unit 52 and the number corresponds to the set number, are stacked in the stacking unit 60, the front opening 61 is opened by the front shutter unit 62. When the banknotes P, whose denomination is other than the denomination having been set by the setting unit 52, is stacked in the stacking unit 60, the banknotes stacked in the stacking unit 60 are moved to the storing box 70 by the clamping and transporting mechanism 10. To be more specific, the setting unit 52 can set the batch number when the taken-out banknotes P to be taken out to the inside of the housing 1 are taken out in a batch. For each time when the banknotes P, whose denomination has been set by the setting unit 52 and the number corresponds to the set batch number, are stacked in the stacking unit 60, the front shutter unit 62 opens the front opening 61. In addition, when the banknotes P, whose denomination has been set by the setting unit 52 but the number exceeds the number having been set by the setting unit 52, are stacked in the stacking unit 60, the surplus banknote P is moved to the storing box 70 by the clamping and transporting mechanism 10.

Thus, even when a denomination of banknotes P to be deposited is only a specific denomination (e.g., 1000-yen or 5000-yen), since the banknotes P of such a specific denomination can be taken out from the outside of the housing 1, the volume of the storing box 70 can be reduced. In addition, since the deposit process and the change-fund preparation process can be simultaneously performed, the process time can be decreased as a whole.

In the banknote deposit apparatus in this embodiment, the control unit 150 is configured to calculate a deposit sum, by adding a sum of banknotes which have been taken out from the stacking unit 60 to the outside of the housing 1 through the front opening 61, and a sum of banknotes which are stored in the storing box 70 (see FIG. 9). Thus, the sum of the banknotes which have not been stored into the storing box 70 but have been taken out to the outside of the housing 1 can be included in the deposit sum.

In addition, in the banknote deposit apparatus in this embodiment, in the process of stacking banknotes P whose denomination has been set by the setting unit 52 in the stacking unit 60, when the total number of the banknotes P stacked in the stacking unit 60 does not reach the number having been set by the setting unit 52, the display and input unit 5 is configured to display this information. In addition, in this case, this information may be printed by the printing unit 6 (see STEP 11 in FIG. 6).

The banknote deposit apparatus in this embodiment is not limited to the above embodiment, but can be variously modified.

For example, when the banknotes P stacked in the stacking unit 60 are taken out from the stacking unit 60 to the outside of the housing 1 through the front opening 61, the aforementioned batch taking-out operation may not be performed. In this case, the setting unit 52 sets only a denomination of the taken-out banknotes P to be taken out from the stacking unit 60 to the outside of the housing 1 through the front opening 61, and the number of the taken-out banknotes P for each denomination. In addition, in this case, when the banknotes P, whose denomination has been set by the setting unit 52 and the number corresponds to the set number, are stacked in the stacking unit 60, the front shutter unit 62 opens the front opening 61, and the taken-out banknotes P are taken out from the stacking unit 60. Then, the front shutter unit 62 closes the front opening 61, and all the banknotes P stacked in the stacking unit 60 thereafter are moved to the storing box 70.

An alternative example of the banknote deposit apparatus according to this embodiment is described with reference to the flowchart shown in FIG. 10.

In the banknote deposit apparatus according to this alternative example, the setting unit 52 does not set a denomination of taken-out banknotes P to be taken out from the stacking unit 60 to the outside of the housing 1 through the front opening 61 and the number of the taken-out banknotes P for each denomination, but sets a sum of stored banknotes P to be stored in the storing box 70. Until a sum of banknotes P stored in the storing box 70 reaches the sum having been set by the setting unit 52, banknotes P stacked in the stacking unit 60 are moved to the storing box 70 by the clamping and transporting mechanism 10. When the sum of the banknotes P stored in the storing box 70 reaches the sum having been set by the setting unit 52, the control unit 150 controls the front shutter unit 62 and the clamping and transporting mechanism 10 such that the front shutter unit 62 opens the front opening 61.

The process is described in more detail with reference to the flowchart shown in FIG. 10. Before banknotes P placed on the placement unit 20 are taken in by the reception unit 25 to the inside of the housing 1, an operator firstly inputs a sum of stored banknotes P to be stored in the storing box 70, through the respective input keys 5*b* of the display and input unit 5, and the setting unit 52 sets information of the stored banknotes P based on the inputted information (STEP 1 in FIG. 10).

Before the banknotes P placed on the placement unit 20 are taken in by the reception unit 25 to the inside of the housing 1, the front opening 61 is closed by the front shutter unit 62.

Figure 10:
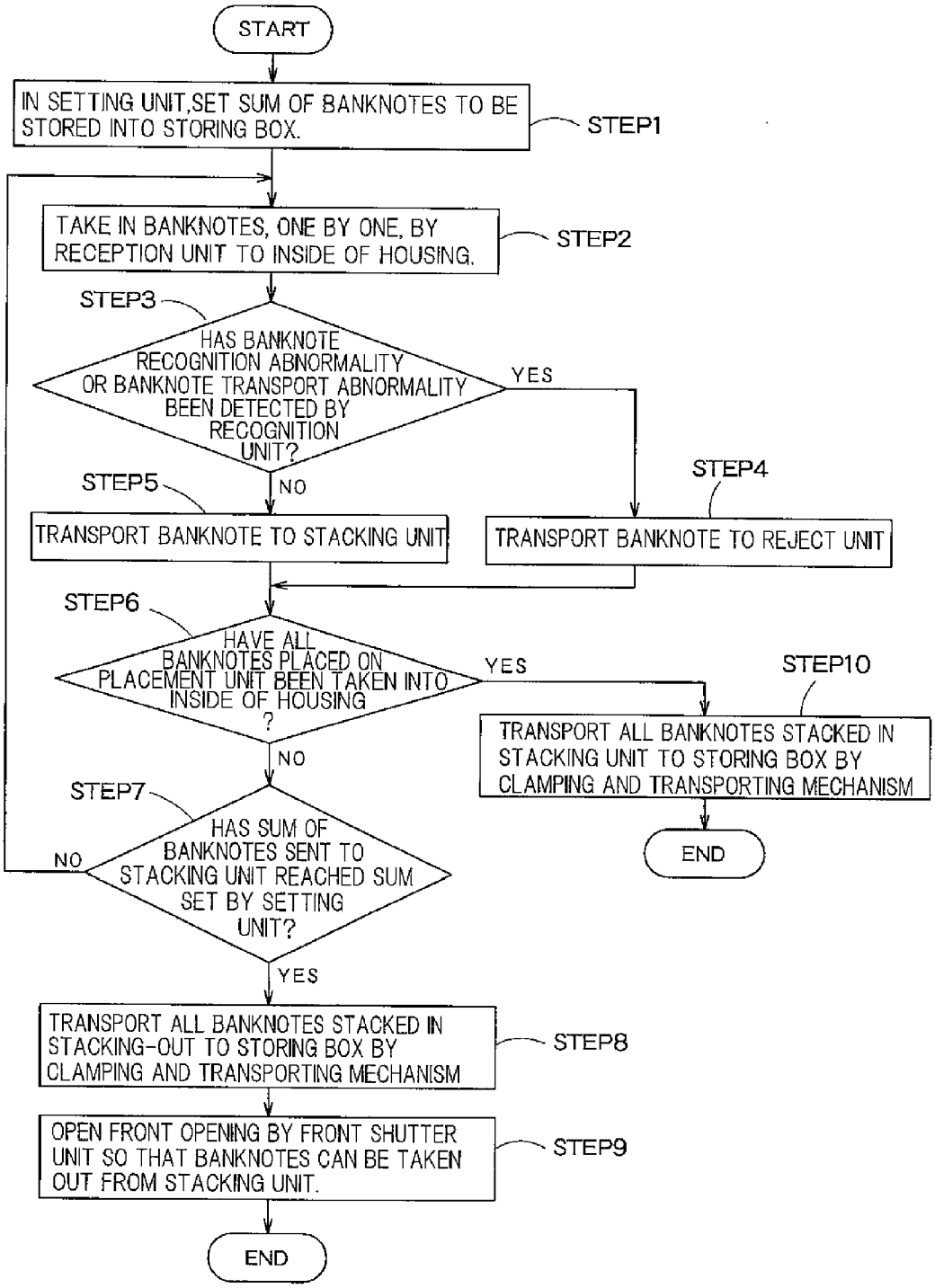
FIG. 10 is a flowchart showing an operation of a banknote deposit apparatus according to an alternative example in the second embodiment of the present invention.

When the operator presses down the start/stop key of the display and input unit 5, the banknotes P placed on the placement unit 20 are taken in, one by one, by the reception unit 25 to the inside of the housing 1, and are transported by the transport unit 30 (STEP 2 in FIG. 10). At this time, the banknotes P transported by the transport unit 30 are recognized and counted by the recognition unit 40 disposed on the transport unit 30 (STEP 3 in FIG. 10). If the recognition abnormality and/or the transport abnormality occur while the banknotes P are transported by the transport unit 30 ("YES" of STEP 3 in FIG. 10), the banknote P is transported to the reject unit 65 (STEP 4 in FIG. 10). On the other hand, when neither the recognition abnormality nor the transport abnormality occurs ("NO" of STEP 3 in FIG. 10), the banknotes P being transported by the transport unit 30 are transported to the stacking unit 60 (STEP 5 in FIG. 10). Until the sum of the banknotes P having been sent to the stacking unit 60 reaches the sum having been set by the setting unit 52, the operations shown in STEP 2 to STEP 5 in FIG. 10 are repeatedly performed ("NO" of STEP 7 in FIG. 10).

On the other hand, when the sum of the banknotes P having been sent to the stacking unit 60 exceeds the sum having been set by the setting unit 52 ("YES" of STEP 7 in FIG. 10), the banknotes P stacked in the stacking unit 60 are transported to the storing box 70 by the clamping and transporting mechanism 10 (STEP 8 in FIG. 10). Thereafter, the front shutter unit 62 opens the front opening 61, so that the banknotes P having been sent to the stacking unit 60 can be taken out to the outside of the housing 1 through the front opening 61 (STEP 9 in FIG. 10).

The setting unit 52 may set a denomination of taken-out banknotes P to be taken out to the outside of the housing 1 after the banknotes P whose sum has been set by the setting unit 52 have been stored into the storing box 70, and the batch number of the taken-out banknotes P to be taken out in a batch. In this case, after the banknotes P stacked in the stacking unit 60 have been transported to the storing box 70 by the clamping and transporting unit 10, the front opening 61 is kept closed by the front shutter unit 62. The control unit 150 controls the process such that, for each time when the banknotes P, whose denomination has been set by the setting unit 52 and the number corresponds to the set batch number, are stacked in the stacking unit 60, the front opening 61 is opened by the front shutter unit 62. At this time, when the number of the banknotes P stacked in the stacking unit 60 does not reach the batch number, this information is displayed on the monitor 5*a* of the display and input unit 5.

Finally, the control unit 150 calculates a deposit sum by adding a sum of the banknotes which have been taken out from the stacking unit 60 to the outside of the housing 1 through the front opening 61, and a sum of the banknotes which are stored in the storing box 70. The calculated deposit sum is stored in the memory unit 154, displayed on the monitor 5*a* of the display and input unit 5, printed by the printing unit 6, or transmitted to the external apparatus by the interface unit 56.

Before the sum of the banknotes P having been sent to the stacking unit 60 exceeds the sum having been set by the setting unit 52, there is a possibility that all the banknotes P placed on the placement unit 20 are taken to the inside of the housing 1 ("YES" of STEP 6 in FIG. 10). This means that the total sum of the banknotes P stacked in the stacking unit 60 is smaller than the sum having been set by the setting unit 52. In this case, all the banknotes P stacked in the stacking unit 60 are transported to the storing box 70 by the clamping and transporting mechanism 10 (STEP 10 in FIG. 10). In addition, information to the effect that the total sum of the banknotes P stacked in the stacking unit 60 is smaller than the sum having been set by the setting unit 52 is displayed on the monitor 5*a* of the display and input unit 5. Specifically, the field of the sum of stored banknotes P is inversely displayed on the monitor 5*a*. In addition, in this case, this information may be printed by the printing unit 6. When all the banknotes P placed on the placement unit 20 are taken to the inside of the housing 1 before the sum of the banknotes P having been sent to the stacking unit 60 exceeds the sum having been set by the setting unit 52 ("YES" of STEP 6 in FIG. 10), instead of storing the banknotes P stacked in the stacking unit 60 to the storing box 70, the front opening 61 may be opened by the front shutter unit 62 so that the banknotes P having been sent to the stacking unit 60 can be taken out to the outside of the housing 1 through the front opening 61.

In the banknote deposit apparatus performing the operations shown in the flowchart of FIG. 10, as described above, the control unit 150 is configured to calculate a deposit sum by adding a sum of banknotes which have been taken out from the stacking unit 60 to the outside of the housing 1 through the front opening 61, and a sum of banknotes which are stored in the storing box 70. Thus, the sum of the banknotes which have been taken out to the inside of the housing 1 can be included in the deposit sum.

Third Embodiment

A third embodiment of the present invention will be described herebelow with reference to the drawings. FIGS. 12 to 18 are views showing a banknote deposit apparatus according to this embodiment. In the below description of the third embodiment, the same units as those of the first and second embodiments are shown by the same reference numbers, and description thereof is omitted.

Figure 12:
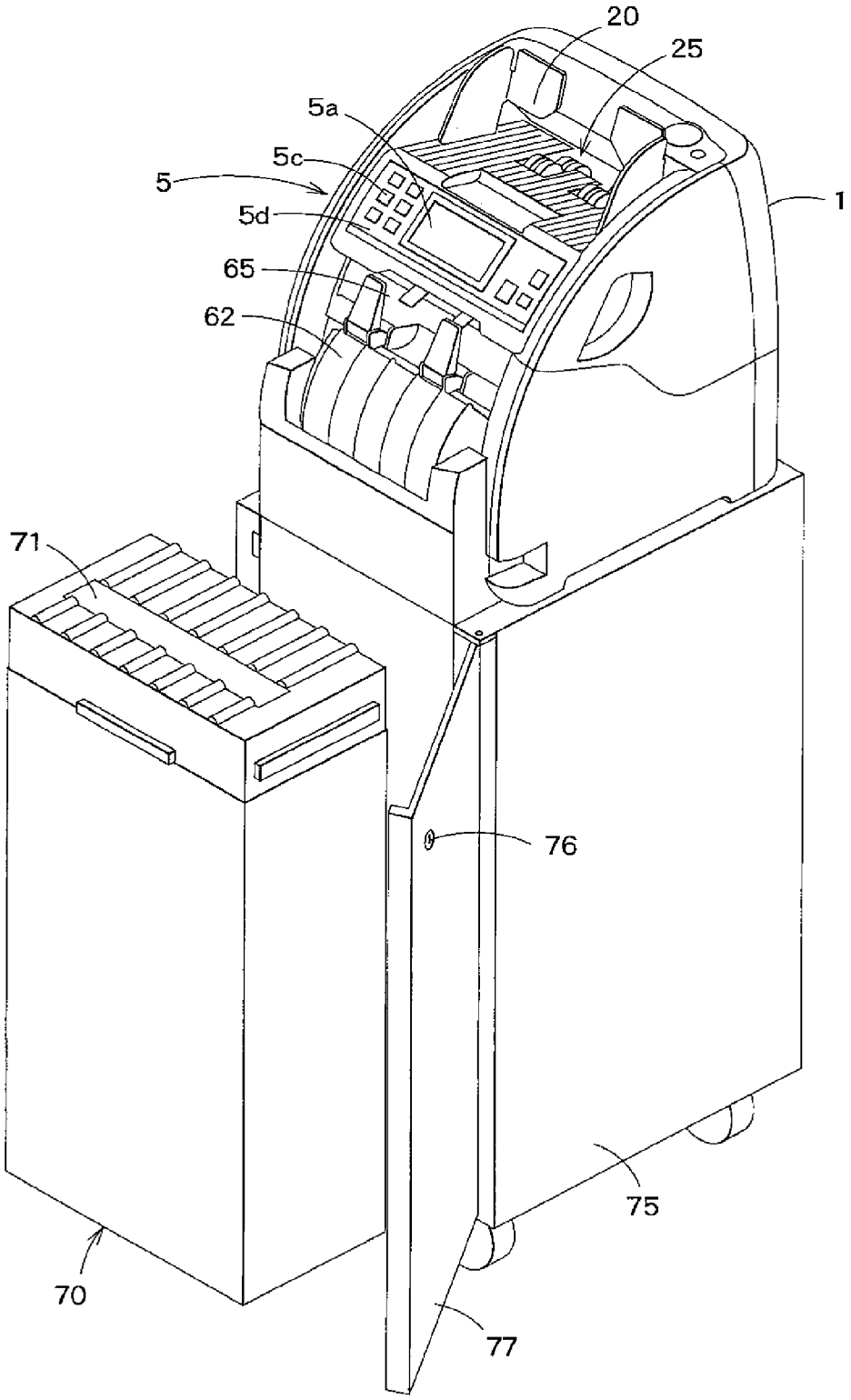
FIG. 12 is a perspective view of a banknote deposit apparatus according to a third embodiment of the present invention.

As shown in FIG. 12, by opening a door 77, the storing box (storing cassette) 70 can be loaded into the banknote deposit apparatus and removed therefrom. The removal of the storing box 70 is carried out by a clerk or a security staff (collecting staff) of an armoured car company to which a collecting operation is charged. The storing box 70 removed by a clerk is stored in a safe room or the like in a shop. The storing box 70 removed by a security staff is transported to a cash process center. There is a case in which the security staff collects only money in the storing box 70, and reloads the storing box 70 into the apparatus.

Figure 13:
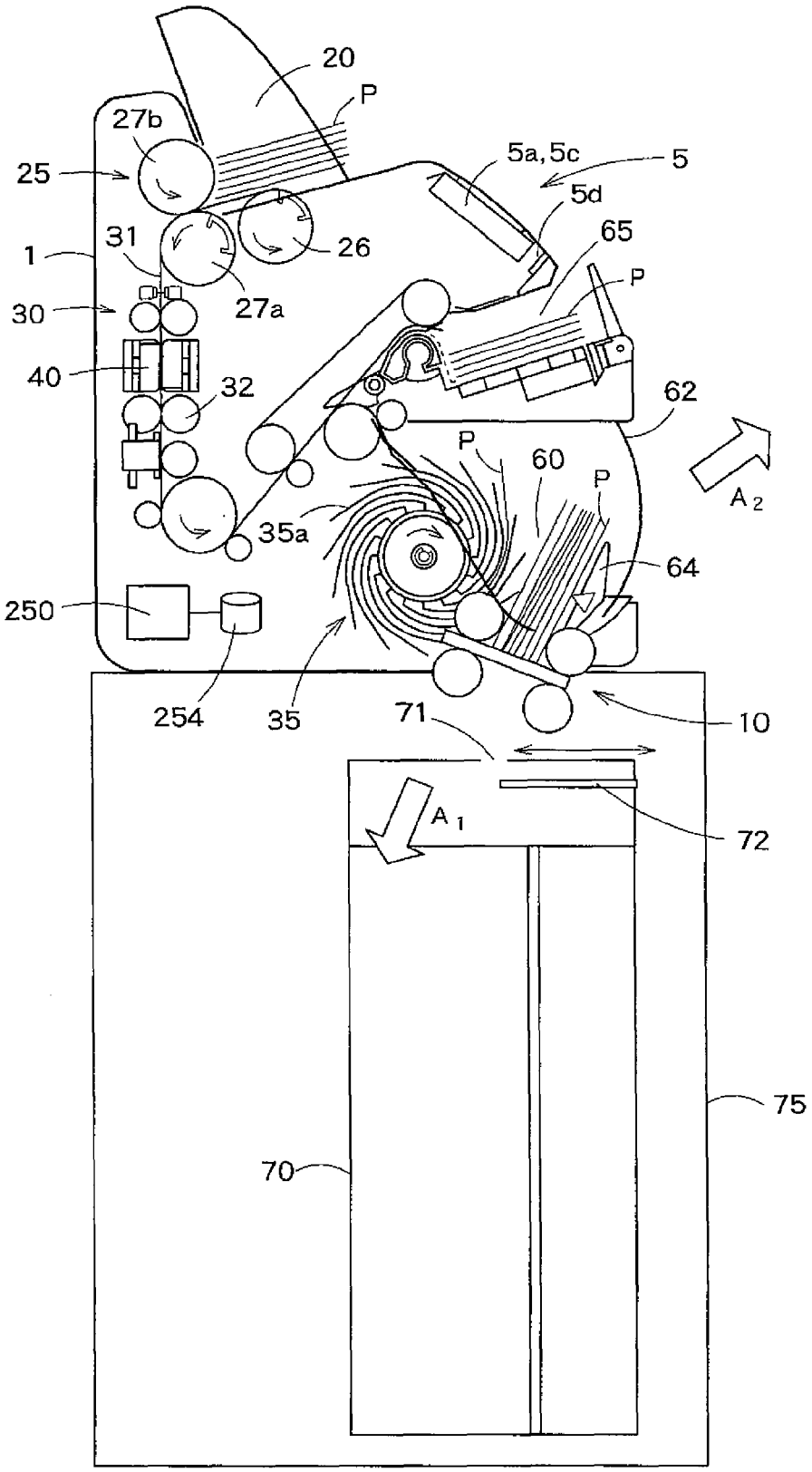
FIG. 13 is a lateral sectional view showing a structure of the banknote deposit apparatus shown in FIG. 12.

As shown in FIGS. 12 and 13, the housing 1 of the money deposit apparatus is provided with the display and input unit 5 including a display unit 5*a* having a function for displaying predetermined information and a command receiving unit 5*c* having a function for enabling data input. The command receiving unit 5*c* is composed of a plurality of input keys 5*b* by which an operator inputs various commands, and a slit-like card reader (reading unit) 5*d* for reading out ID information of an operator. The reading unit 5*d* notifies a control unit 250 (described below) of the read-out ID information. The ID information shows whether an operator is a clerk or a security staff (collecting staff).

Figure 14:
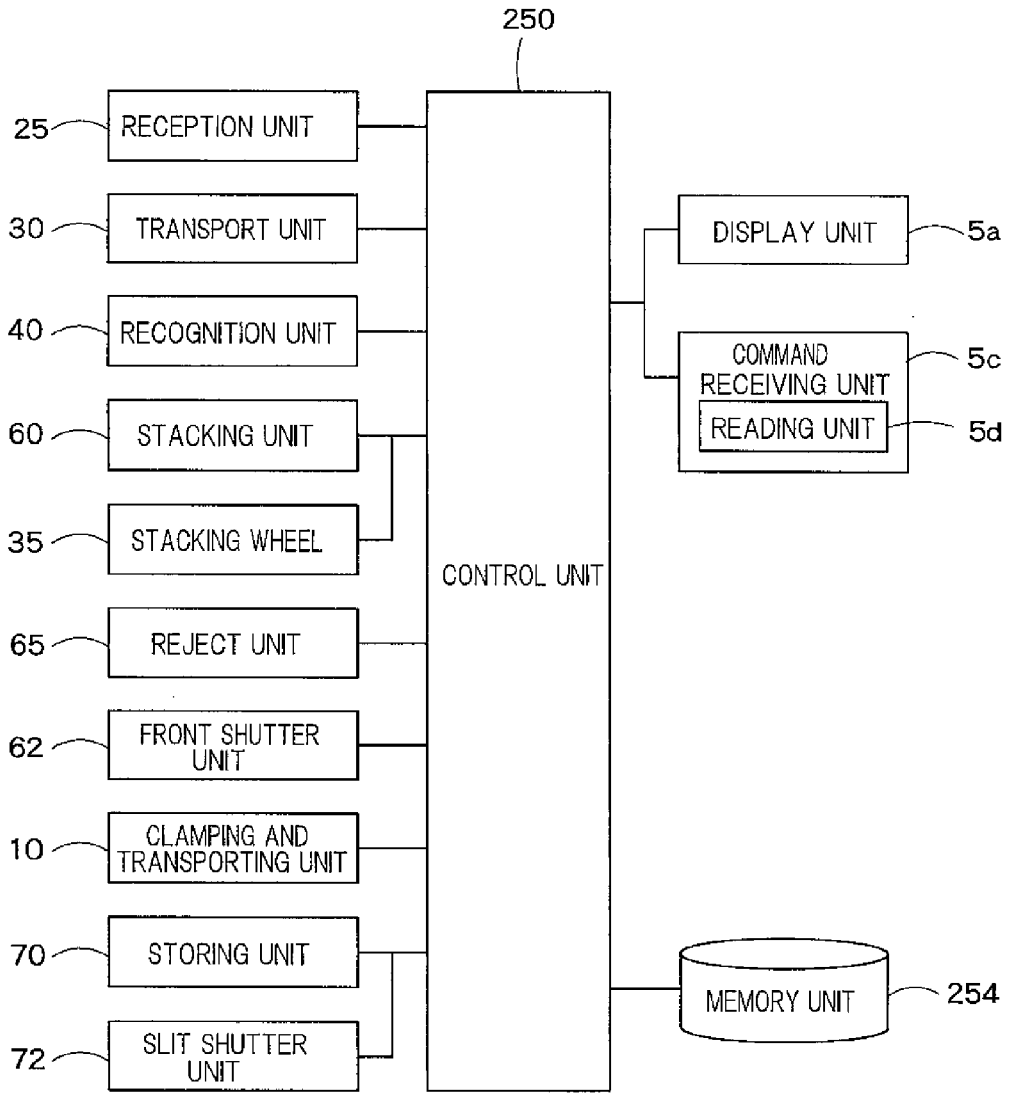
FIG. 14 is a functional block view of the banknote deposit apparatus shown in FIG. 12.

The banknote deposit apparatus in this embodiment is provided with the control unit 250 shown in FIGS. 13 and 14, in place of the control unit 50 of the banknote deposit apparatus according to the first embodiment. The control unit 250 is configured to control the respective constituent elements of the money deposit apparatus so as to control these constituent elements. As shown in FIG. 14, the control unit 250 is connected to the respective units of the banknote deposit apparatus in the third embodiment. Based on a banknote recognition result by the recognition unit 40, the control unit 250 controls the transport unit 30 such that a normal banknote is transported to the stacking unit 60 and that a reject banknote is transported to the reject unit 65. The control unit 250 may cause the display unit 5*a* to display the result by which the banknote is judged as abnormal. The control unit 250 can detect loading and removal of the storing box 70.

The control unit 250 can write a count result by the recognition unit 40 into a memory unit 254, as amount-of-money information of money stored in the storing box 70. In writing of the count result, when another amount-of-money information has been already stored in the memory unit 254, the control unit 250 adds the count result to the amount-of-money information and updates the amount-of-money information. In addition, the control unit 250 can delete amount-of-money information stored in the memory unit 254. The amount-of-money information includes, for example, a denomination of money, the number thereof and a total sum.

The display unit 5*a* can display a count result by the recognition unit 40 and amount-of-money information of the storing box 70.

The command receiving unit 5*c* receives from an operator a storing command for storing a banknote stacked in the stacking unit 60 to the storing box 70. In addition, the command receiving unit 5*c* receives from an operator a returning command for returning a banknote stacked in the stacking unit 60. In addition, the command receiving unit 5*c* receives from an operator a command for maintaining or deleting amount-of-money information stored in the memory unit 254 in accordance with the removal of the storing box 70.

Based on a command from an operator which is received by the command receiving unit 5*c*, the control unit 250 maintains amount-of-money information stored in the memory unit 254 or deletes the same, in accordance with the removal of the storing box 70. It is possible that a nonvolatile memory is disposed on the memory unit 254, and that the amount-of-money information to be maintained in the memory unit 254 is written in the nonvolatile memory. In this case, the amount-of-money information can be maintained even when a power of the money deposit apparatus is turned off.

In a case where the amount-of-money information is maintained in the memory unit 254, when the removed storing box 70 is reloaded into the money deposit apparatus, a count result of money deposited after the reloading can be added to the amount-of-money data of the memory unit 254. Thus, deposit data after reloading of the storing box 70 into the money deposit apparatus can be handled succeedingly to the deposit data before the removal of the storing box 70.

Based on ID information of an operator who removes the storing box 70, which has been notified from the reading unit 5*d*, the control unit 250 may maintain/delete amount-of-money information stored in the memory unit 254. For example, when an operator who removes the storing box 70 is a clerk, the control unit 250 maintains the amount-of-money information stored in the memory unit 254 in accordance with the removal of the storing box 70. This is because, in a case where a clerk removes the storing box 70, it is considered that there is a possibility that, after the storing box 70 has been stored in a cash room or the like in a shop, the storing box 70 is reloaded into the money deposit apparatus so as to perform a deposit process succeedingly to the deposit process before the removal of the storing box 70.

On the other hand, in a case where a security staff (collecting staff) removes the storing box 70, the control unit 250 deletes the amount-of-money information stored in the memory unit 254 in accordance with the removal of the storing box 70. This is because, in a case where a security staff removes the storing box 70, the storing box 70 (or money in the storing box 70) is transported to a cash process center, whereby it is considered that it is not necessary to succeedingly use the amount-of-money information stored in the memory unit 254.

As described above, according to the money deposit apparatus in this embodiment, even when the storing box 70 is removed, the memory unit 254 can maintain amount-of-money information of money in the storing box 70. Thus, during a time period in which the money deposit apparatus is unavailable, such as night, the storing box 70 can be safely stored in a cash room or the like, while during a time period in which the money deposit apparatus is available, such as daytime, a count result of deposit money can be handled succeedingly to the amount-of-money information before the safety box 70 is removed. Since it is sufficient for the money deposit apparatus to have a minimum thief-proof property during a time period in which the money deposit apparatus is available, such as daytime, a cost for the apparatus can be reduced.

Figure 15:
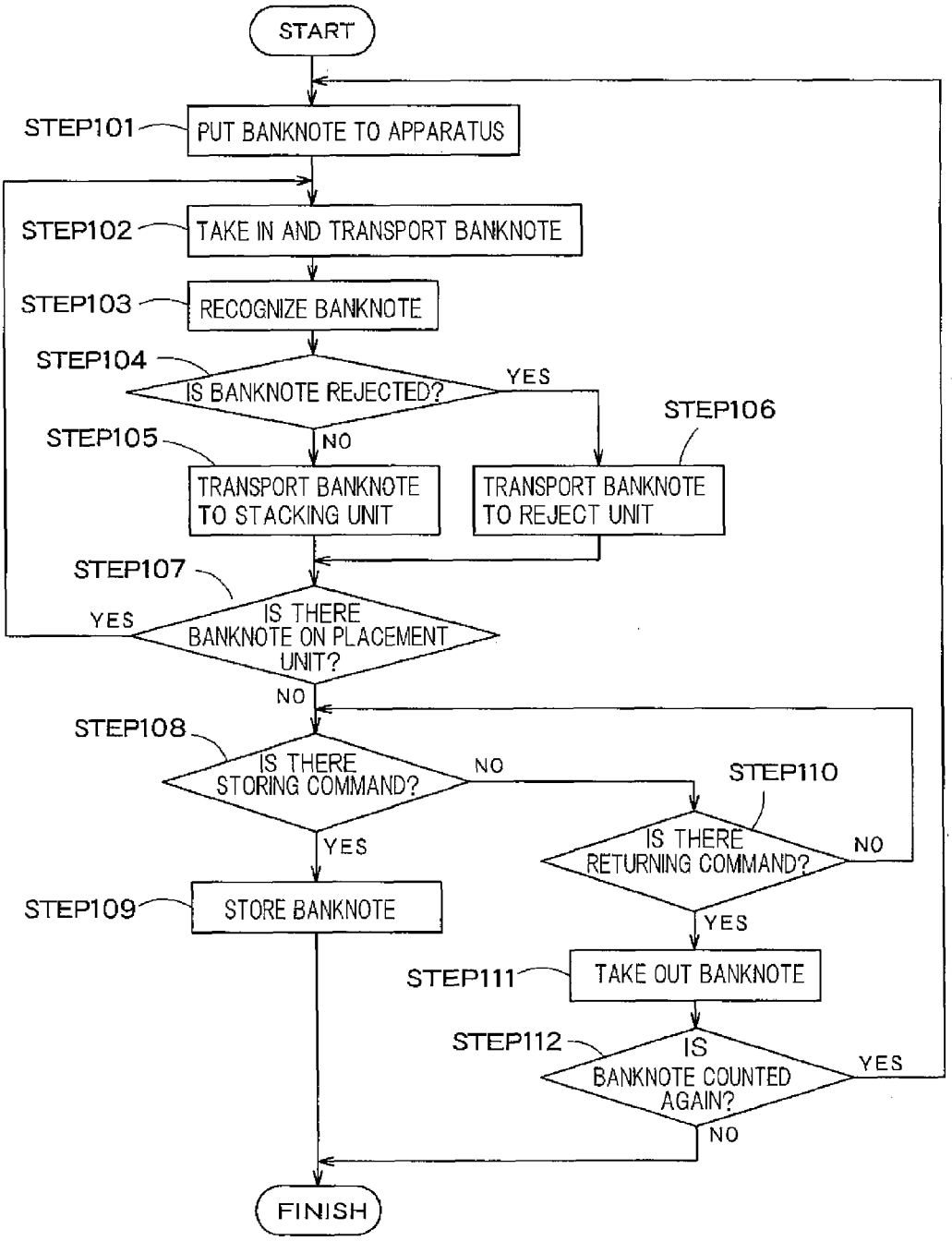
FIG. 15 is a flowchart for explaining a deposit process in the banknote deposit apparatus shown in FIG. 12.

A money deposit process using such a money deposit apparatus is described with reference to the flowchart shown in FIG. 15.

(STEP 101) Banknotes to be deposited are put into the placement unit 20.

(STEP 102). The banknotes are taken in, one by one, by the reception unit 25 into the apparatus, and are transported by the transport unit 30.

(STEP 103) The recognition unit 40 recognizes and counts the banknotes.

(STEP 104) When the banknote is judged as a reject banknote by the recognition unit 40, the process proceeds to STEP 106. When the banknote is judged as a normal banknote, the process proceeds to STEP 105.

(STEP 105) The banknote is transported to the stacking unit 60 so as to be stacked.

(STEP 106) The banknote is transported to the reject unit 65.

(STEP 107) When there remains a banknote in the placement unit 20, the process returns to STEP 102. When there remains no banknote, the process proceeds to STEP 108.

(STEP 108) When the command receiving unit 5*c* receives the storing command from an operator, the process proceeds to STEP 109. When there is no storing command from an operator, the process proceeds to STEP 110.

(STEP 109) The banknotes stacked in the stacking unit 60 are stored into the storing box 70. At this time, the control unit 250 writes the count result by the recognition unit 40 into the memory unit 254. When the memory unit 254 stores amount-of-money information corresponding to the storing box 70, the control unit 250 adds the count result to the amount-of-money information. When the memory unit 254 does not store amount-of-money information corresponding to the storing box 70, the control unit 250 writes the count result as amount-of-money information of the storing box 70 into the memory unit 254.

(STEP 110) When the command receiving unit 5*c* receives the returning command from an operator, the process proceeds to STEP 111. When there is no returning command from an operator, the process returns to STEP 108.

(STEP 111) The front shutter unit 62 is opened, and the banknotes stacked in the stacking unit 60 are taken out.

(STEP 112) When the banknotes having been taken out in STEP 111 are counted again, the process returns to STEP 101. When the banknotes are not counted again, the process is finished.

When ID information of an operator is read out, the operation is performed, for example, before STEP 101 in which the banknotes are put into the apparatus. In addition, when a sum of the deposit banknotes is previously known, the sum (declared sum) may be inputted by using the input key 5*b* or the like before STEP 101, and a comparison result between the declared sum and the count result may be displayed on the display unit 5*a* between STEP 107 and STEP 108.

Next, a removal process of the storing box 70 is described with reference to the flowchart shown in FIG. 16.

(STEP 201) The reading unit 5*d* reads out ID information of an operator who removes the storing box 70, and notifies the control unit 250 of the ID information.

(STEP 202) When the operator who removes the storing box 70 is a clerk, the process proceeds to STEP 203. When the operator who removes the storing box 70 is not a clerk (when the operator is a collecting staff such as a security staff), the process proceeds to STEP 204.

(STEP 203) The storing box 70 is removed. The memory unit 254 maintains amount-of-money information.

(STEP 204) The storing box 70 is removed. In accordance with the removal of the storing box 70, the control unit 250 deletes amount-of-money information stored in the memory unit 254.

Figure 16:
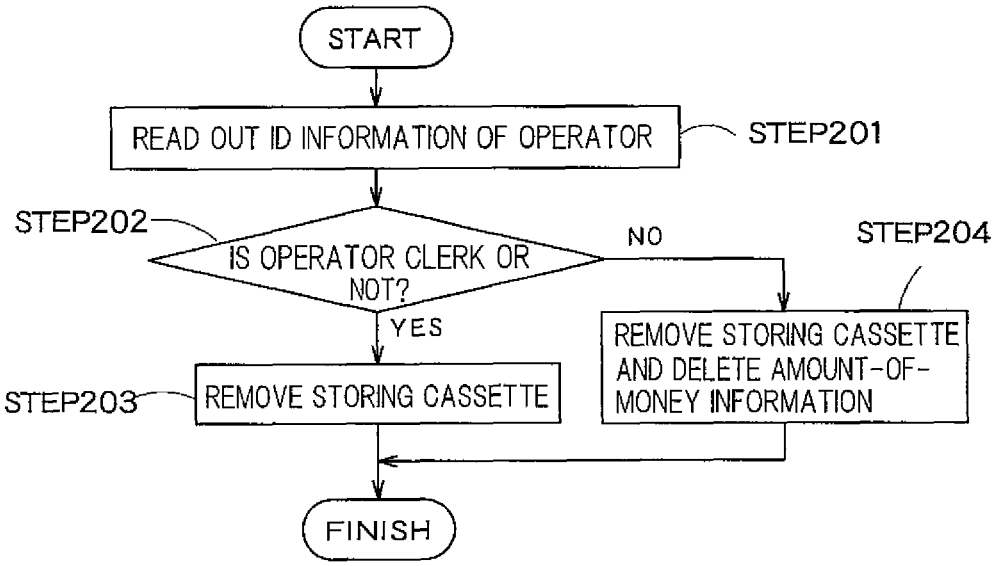
FIG. 16 is a flowchart showing a storing-box taking-out process in the banknote deposit apparatus shown in FIG. 12.

In the flowchart shown in FIG. 16, based on the ID information having been read out in STEP 201, it is selected whether the amount-of-money information stored in the memory unit 254 is maintained or deleted in accordance with the removal of the storing box 70. However, a command for maintaining/deleting the amount-of-money information may be given through the command receiving unit 5*c*. When the command receiving unit 5*c* receives the command for maintaining the amount-of-money information stored in the memory unit 254, the process proceeds to STEP 203. When the command receiving unit 5*c* receives the command for deleting the amount-of-money information stored in the memory unit 254, the process proceeds to STEP 204.

As described above, according to this embodiment, it is possible to store data (amount-of-money information) of money in the storing box taken out from the apparatus body, and to succeedingly perform a deposit process after reloading of the storing box. In addition, by separately storing the storing box in a case room or the like, the thief-proof property can be assured. In addition, since it is sufficient for the apparatus body to have a minimum thief-proof property, a cost for the apparatus can be reduced.

Figure 17:
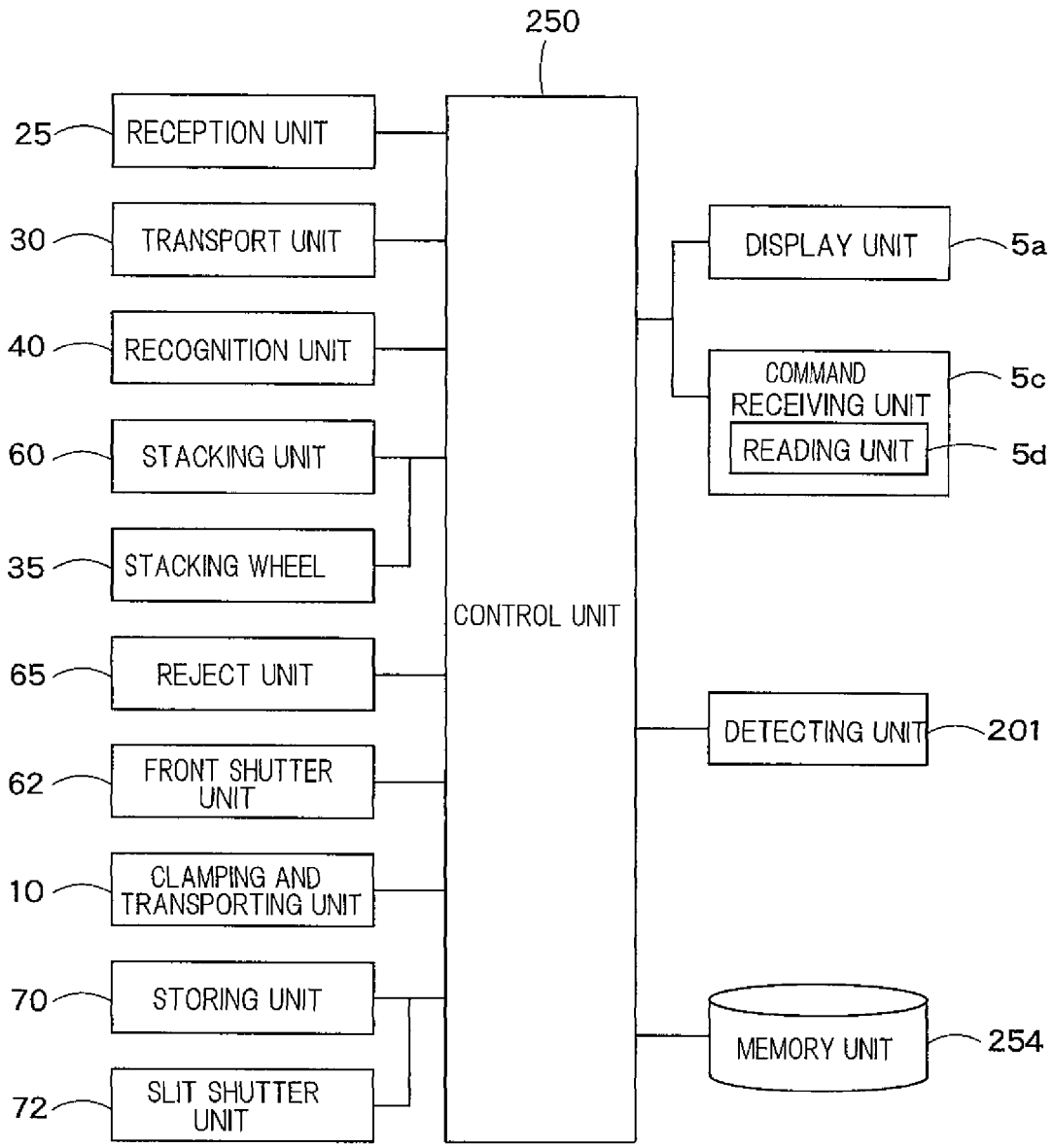
FIG. 17 is a functional block view of a money deposit apparatus according to an alternative example in the third embodiment of the present invention.

Next, an alternative example of the third embodiment will be described herebelow. FIG. 17 is a functional block view of a money deposit apparatus according to this alternative example. The money deposit apparatus shown in FIG. 17 differs from the money deposit apparatus shown in FIGS. 13 and 14 in that there is provided a detecting unit 201 configured to detect recognition information of the storing box. In FIG. 17, the same units as those of the money deposit apparatus shown in FIGS. 13 and 14 are shown by the same reference numbers, and description thereof is omitted.

In the money deposit apparatus shown in FIG. 17, a plurality of storing boxes are prepared, and at least any one of them is loaded into the money deposit apparatus. The plurality of storing boxes are configured, for example, to store deposit money for each register or to store deposit money for each shop.

The plurality of storing boxes respectively have recognition information. For example, each of the storing boxes is provided with a tag having unique recognition information. The detecting unit 201 is a tag reader that reads out the recognition information from the tag. The recognition information of the storing box may be anything by which the detecting unit 201 can identify a certain storing box among the plurality of storing boxes. For example, the recognition information may be a position of a magnet or a position of a projection disposed on the storing box.

The memory unit 254 is configured to store amount-of-money information for each of the plurality of storing boxes. For example, as shown in FIG. 18, the memory unit 254 stores, for each of the three storing boxes C1 to C3, a denomination of money stored therein, the number thereof and a total sum thereof.

When the control unit 250 writes the count result of the deposit money in the memory unit 254, the control unit 250 adds the count result to amount-of-money information corresponding to the loaded storing box. When the memory unit 254 does not store the amount-of-money information corresponding to the loaded storing box, the control unit 250 newly writes the count result of the deposit money, as amount-of-money information of the loaded storing box. In addition, when the memory unit 254 does not store the amount-of-money information corresponding to the loaded storing box, the control unit 250 may cause the display unit 5*a* to display the fact that the storing box is a new storing box which does not store any amount-of-money information.

Figure 18:
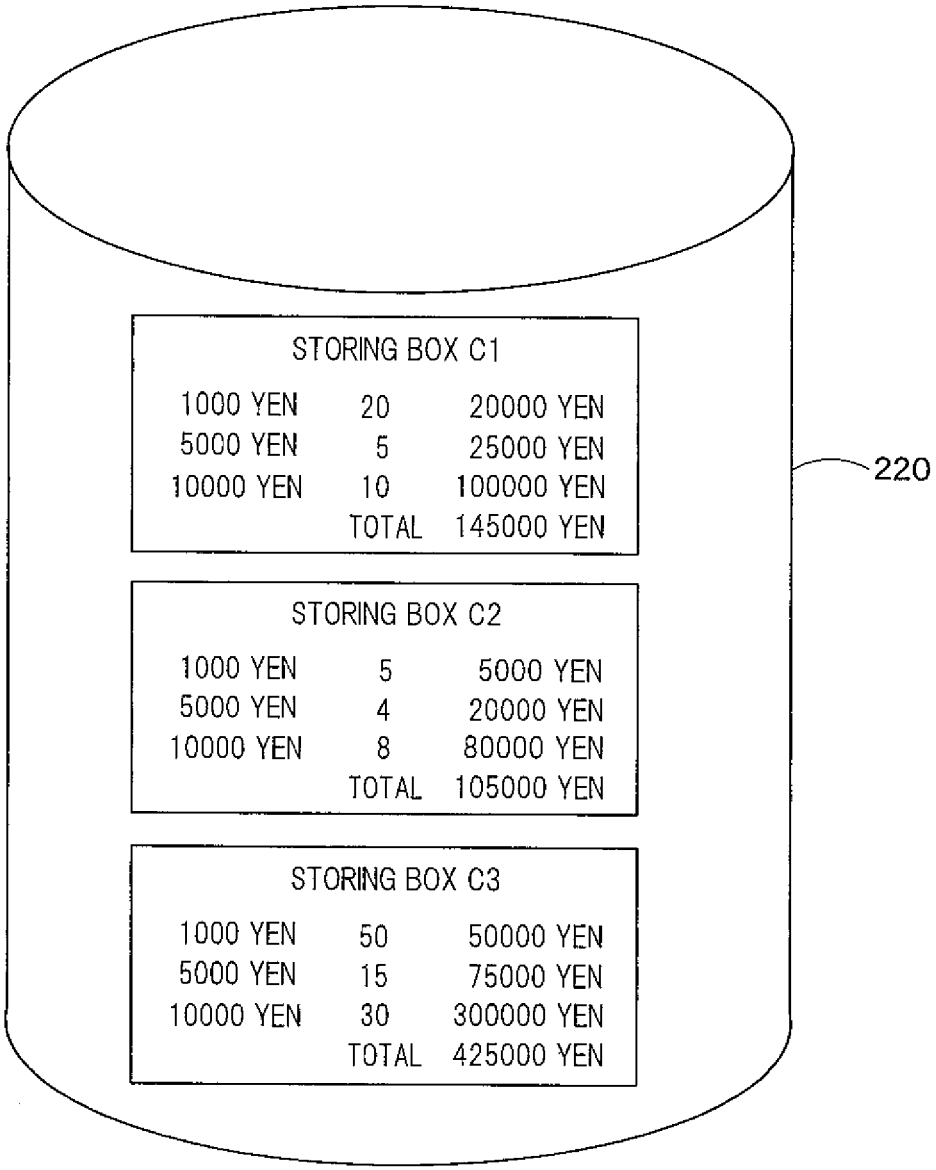
FIG. 18 is a view showing an example of amount-of-money information stored in a memory unit in the money deposit apparatus shown in FIG. 17.

The display unit 5*a* may display the amount-of-money information shown in FIG. 18 stored in the memory unit 254.

Similarly to the banknote deposit apparatus shown in FIGS. 13 and 14, when the storing box is removed from the apparatus, the amount-of-money information stored in the memory unit 254 is maintained/deleted, based on a command received by the command receiving unit 5*c*.

By maintaining the amount-of-money information of the storing box removed from the apparatus in the memory unit 254, a deposit process can be performed by separately using the plurality of storing boxes.

Although the above description for the third embodiment has been described by taking the example in which the money deposit apparatus performs a banknote deposit process, the money deposit apparatus can similarly perform a coin deposit process. In addition, the money deposit apparatus can perform both the banknote deposit process and the coin deposit process. In this case, storing boxes may be respectively provided for banknotes and coins, or banknotes and coins may be stored in one storing box. The memory unit 254 can store amount-of-money information for respective banknotes and coins.

In the above description for the third embodiment, the command receiving unit 5*c* receives the command for maintaining or deleting the amount-of-money information of the memory unit 254 in accordance with the removal of the storing box 70. However, the command receiving unit 5*c* may receive only either one of commands. For example, the command receiving unit 5*c* receives only the command for maintaining the amount-of-money information of the memory unit 254 in accordance with the removal of the storing box 70. Deletion of amount-of-money information in accordance with the removal of the storing box 70 is set as a standard. Thus, only when the command receiving unit 5*c* receives the command for maintaining the amount-of-money information, the amount-of-money information is maintained in accordance with the removal of the storing box 70.

The money deposit apparatus may be provided with a printing unit configured to print the number of deposit money and a sum thereof. For example, in accordance with storing of money into the storing box, the number of the deposit money and a sum thereof are printed. This printing may be carried out in the course of the deposit process (in the course of counting). Thus, an operator can confirm details of the deposit money at a desired timing. Such a structure is suitable for a case in which the display screen of the display unit 5*a* is small so that only one item such as a total sum can be displayed.

Fourth Embodiment

A fourth embodiment of the present invention will be described herebelow with reference to the drawings. FIGS. 19 to 25 are views showing a banknote deposit apparatus according to this embodiment. In the below description of the fourth embodiment, the same units as those of the third embodiment are shown by the same reference numbers, and description thereof is omitted.

Figure 19:
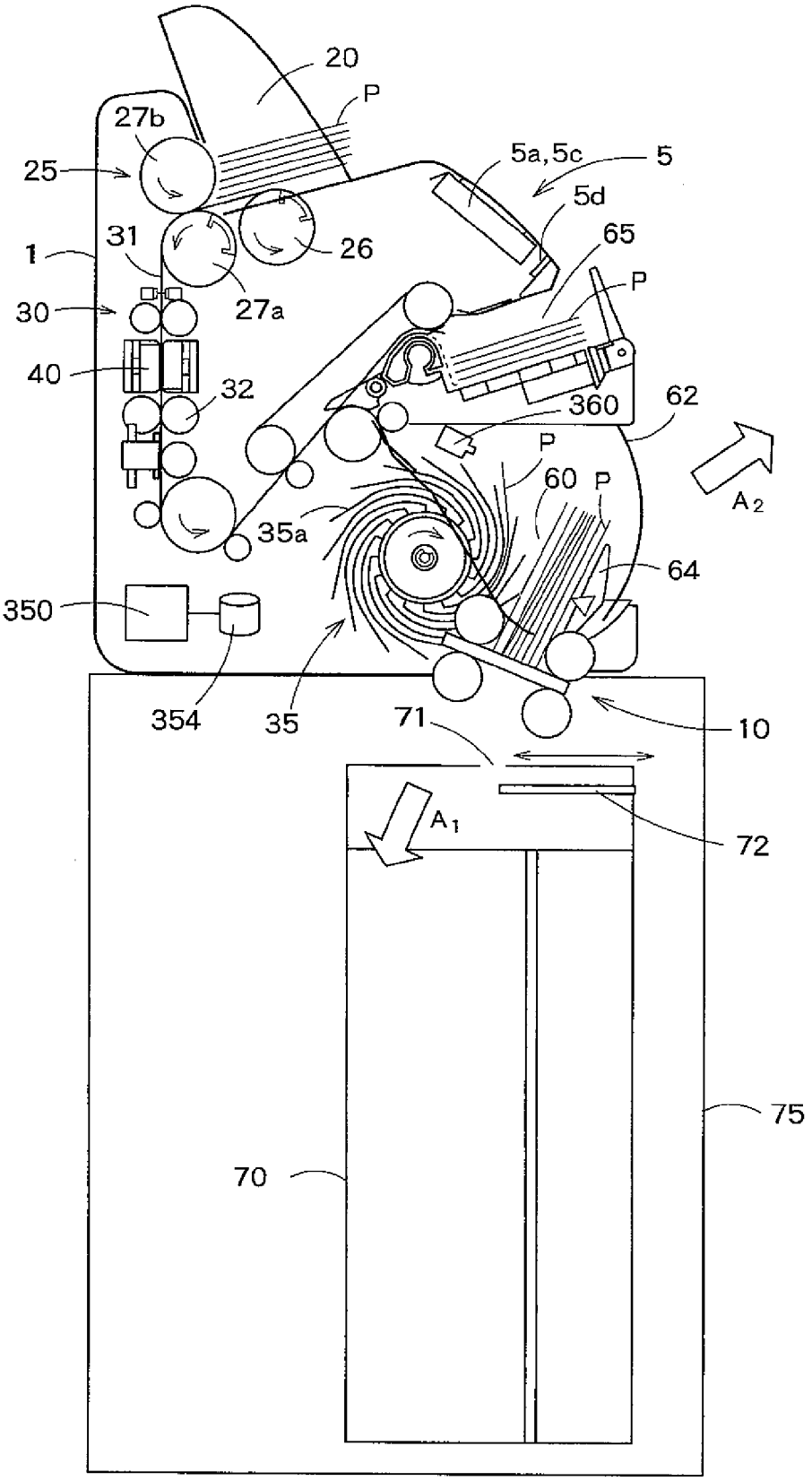
FIG. 19 is a lateral sectional view showing a structure of a banknote deposit apparatus according to a fourth embodiment of the present invention.

As shown in FIG. 19, the stacking unit 60 is provided with an imaging unit 360 configured to image a stacked position of a banknote P in the stacking unit 60. The imaging unit 360 is a CCD camera, for example. A camera is suited for imaging a spacious space where the stacking wheel 35 is disposed. In addition, the stacking unit 60 is provided with a light source (not shown) that is lighted when the imaging unit 360 obtains an image. The imaging unit 360 is disposed opposedly to the front shutter unit 62 with respect to the support unit 64. The imaging unit 360 can image a banknote P supported by the support unit 64. In addition, the imaging unit 360 can image the banknote P, as well as image a surface (rear surface) of the front shutter unit 62 on a side facing the inside of the housing 1.

Figure 21:
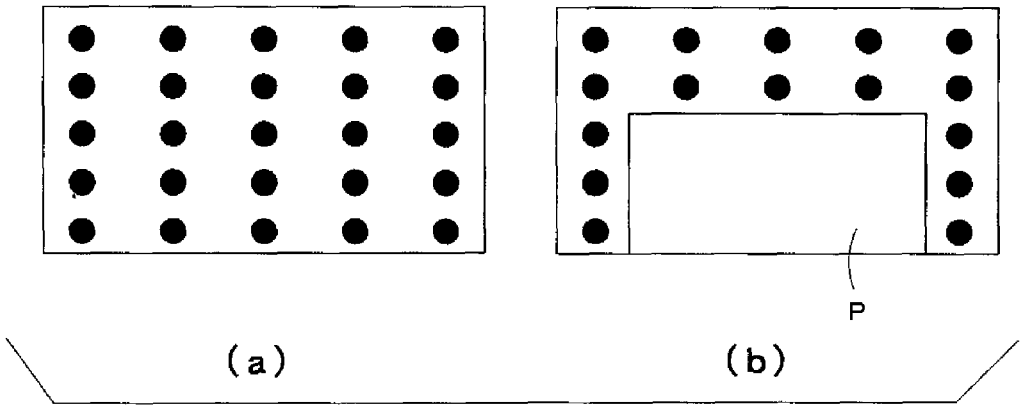
FIG. 21 is a view showing an example of dot patterns drawn on a front shutter unit, in the fourth embodiment of the present invention.

As shown in FIG. 21(*a*), dot patterns are drawn on the rear surface of the front shutter unit 62. When the stacked state of banknotes P in the stacking unit 60 is normal, an image obtained by the imaging unit 360 is an image as shown in FIG. 21(*b*).

Figure 22:
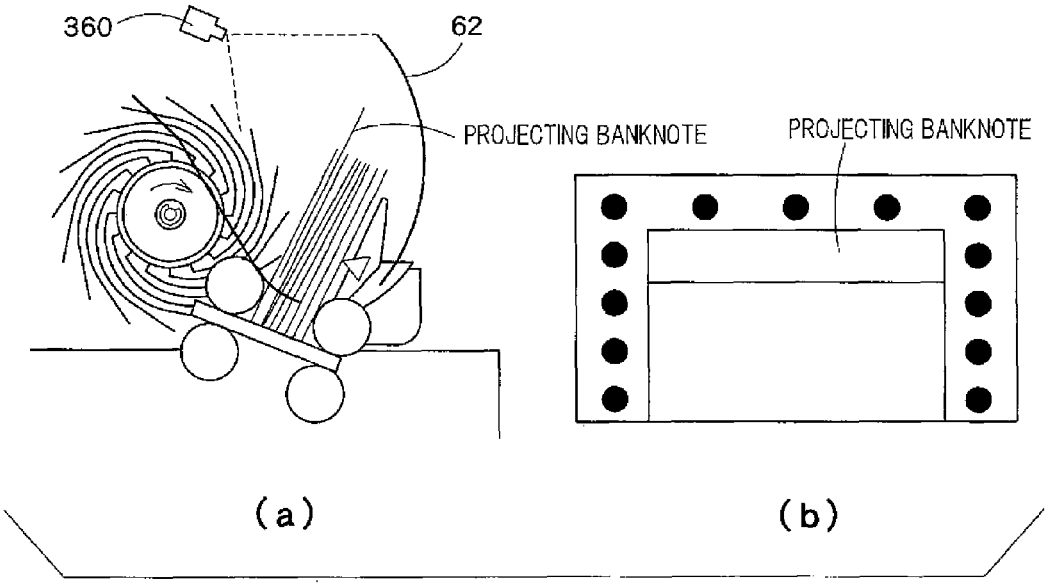
FIG. 22 is a view showing an example of an image in the fourth embodiment of the present invention.

On the other hand, when the stacked state of banknotes P is abnormal, for example, when there is a projecting banknote deviated from the normal stacked position shown in FIG. 22(*a*), an image obtained by the imaging unit 360 is an image as shown in FIG. 22(*b*).

As understood from FIGS. 22(*a*) and 22(*b*), as compared with the normal case, when the banknote stacked state is abnormal, the number of dots on the image obtained by the imaging unit 360 is smaller. In this embodiment, normality/abnormality of the stacked state of the banknotes P in the stacking unit 60 is judged based on the number of dots.

Figure 20:
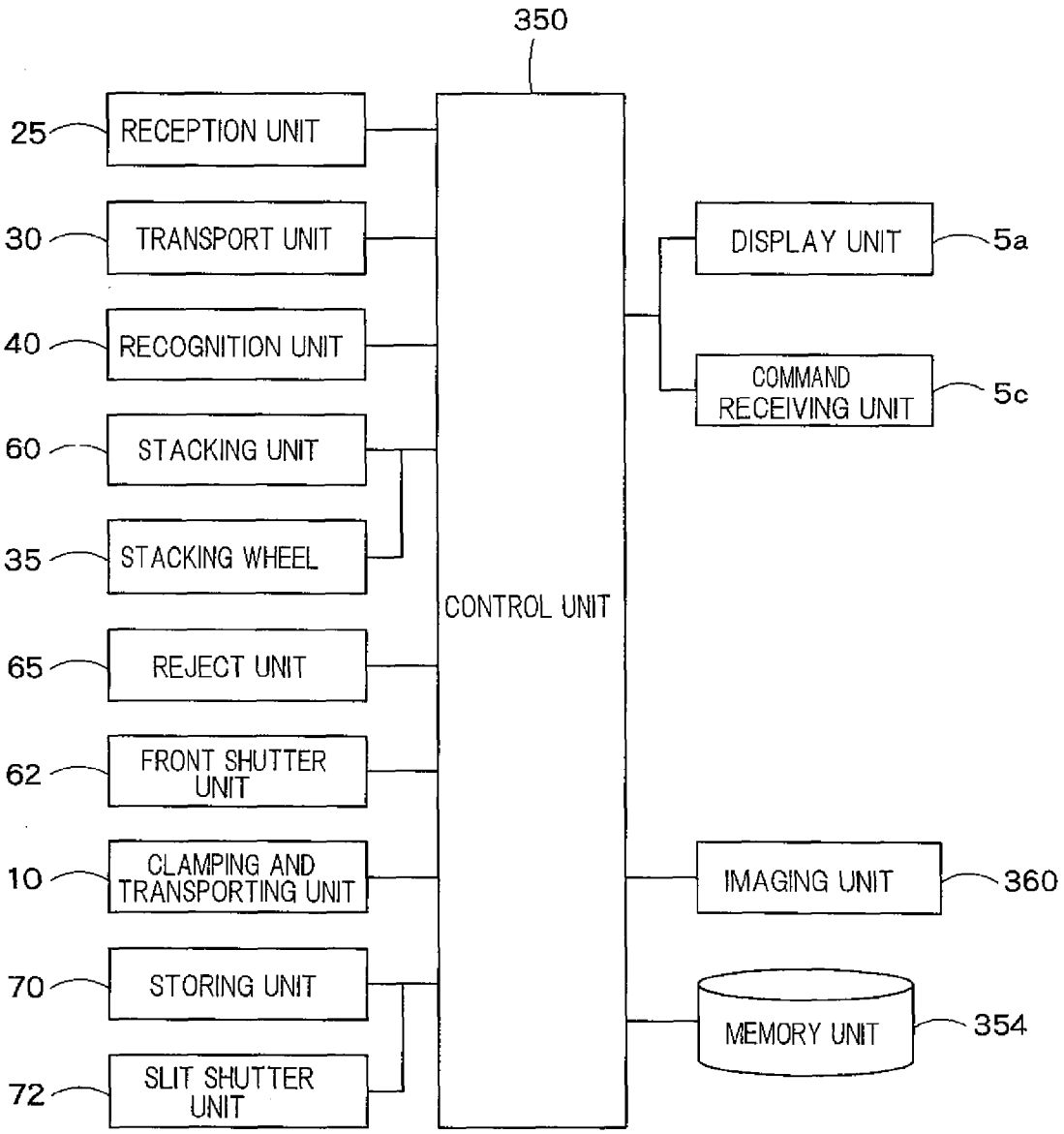
FIG. 20 is a functional block view of the banknote deposit apparatus shown in FIG. 19.

The banknote deposit apparatus in this embodiment is provided with a control unit 350 as shown in FIGS. 19 and 20, in place of the control unit 250 of the banknote deposit apparatus according to the third embodiment. The control unit 350 is configured to control the respective constituent elements of the banknote deposit apparatus in the fourth embodiment. The control unit 350 causes the imaging unit 360 to obtain an image. Based on the number of dot patterns of the rear surface of the front shutter unit 62 shown in the obtained image, the control unit 350 judges whether the stacked state of banknotes in the stacking unit 60 is normal or abnormal. For example, the number of dots on an obtained image when banknotes are normally stacked is previously set. The state where banknotes are normally stacked is a state where the stacked banknotes are contained in a predetermined area, so that there occurs no problem when the stacked banknotes are moved to the storing box 70.

Figure 23:
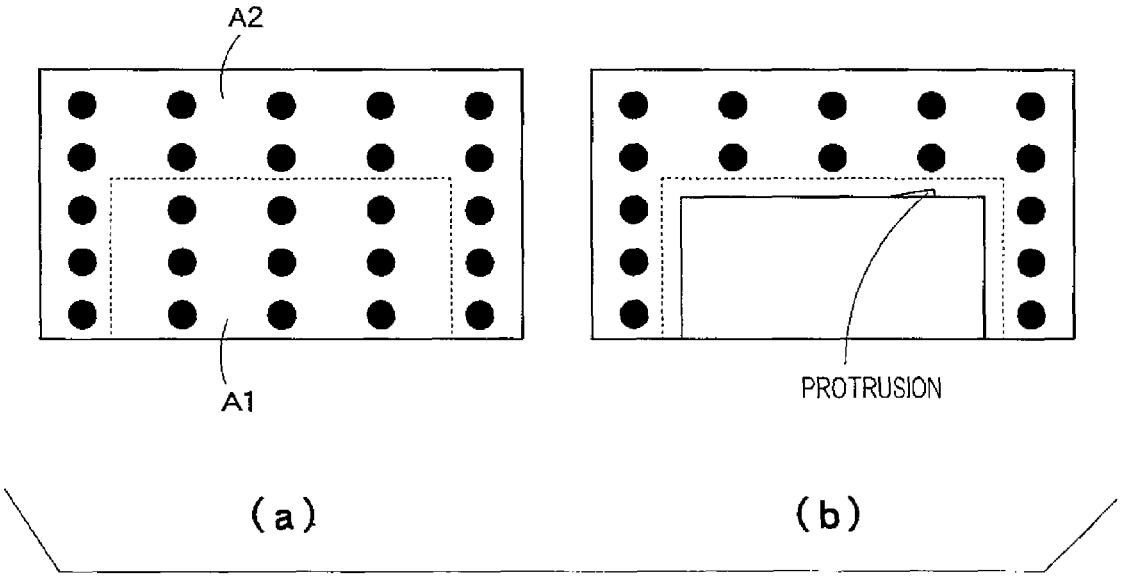
FIG. 23 is a view showing an example of an image, in the fourth embodiment of the present invention.

For example, there occurs no problem when banknotes are contained in a predetermined area A1 shown in FIG. 23(*a*), and the number of dots in an area A2 serves as a threshold value when judging the stacked state. As shown in FIG. 23(*b*), even when there is a banknote that slightly protrudes, as long as the banknote is contained in the predetermined area A1, it can be said that the banknote is normally stacked.

When the number of dots on the obtained image is not less than the threshold value, the control unit 350 judges that the stacked state of the banknotes in the stacking unit 60 is normal. On the other hand, when the number of dots on the obtained image is less than the threshold value, the control unit 350 judges that the stacked state of the banknotes in the stacking unit 60 is abnormal. The control unit 350 can cause the display unit 5*a* to display the judgment result.

The command receiving unit 5*c* receives from an operator the storing command for storing the banknotes stacked in the stacking unit 60 into the storing box 70. In addition, the command receiving unit 5*c* receives from an operator the returning command for returning the banknotes stacked in the stacking unit 60.

A banknote deposit process by using such a banknote deposit apparatus is described with reference to the flowchart shown in FIG. 24.

(STEP 301) Banknotes to be deposited are put into the placement unit 20.

(STEP 302) The banknotes are taken in, one by one, by the reception unit 25 into the apparatus, and are transported by the transport unit 30.

(STEP 303) The recognition unit 40 recognizes and counts the banknotes.

(STEP 304) When the banknote is judged as a reject banknote by the recognition unit 40, the process proceeds to STEP 306. When the banknote is judged as a normal banknote, the process proceeds to STEP 305.

(STEP 305) The banknote is transported to the stacking unit 60 so as to be stacked therein.

(STEP 306) The banknote is transported to the reject unit 65.

(STEP 307) When there remains a banknote in the placement unit 20, the process returns to STEP 302. When there remains no banknote, the process proceeds to STEP 308.

(STEP 308) The imaging unit 360 images the banknotes stacked in the stacking unit 60 and the rear surface of the front shutter unit 62.

(STEP 309) The control unit 350 obtains an image having been obtained by the imaging unit 360 in STEP 308, and judges the banknote stacked state in the stacking unit 60. When the number of dots on the image is not less than a predetermined threshold value, the control unit 350 judges that the stacked state is normal. when the number of dots on the image is less than the threshold value, the control unit 350 judges that the stacked state is abnormal. The judgment result is displayed on the display unit 5*a*.

When the stacked state is judged as normal, the process proceeds to STEP 310. When the stacked state is judged as abnormal, the process proceeds to STEP 313.

(STEP 310) The control unit 350 causes the display unit 5*a* to display the banknote recognition and count result by the recognition unit 40. When the operator confirms the displayed count result and determines the deposit, the process proceeds to STEP 311. When the operator does not determine the deposit, the process proceeds to STEP 312.

(STEP 311) The command receiving unit 5*c* receives the storing command from the operator. Base on the storing command, the banknotes stacked in the stacking unit 60 are stored into the storing box 70. In addition, the control unit 350 writes the deposit determination sum into the memory unit 354.

(STEP 312) The command receiving unit 5*c* receives the returning command from the operator.

(STEP 313) The control unit 350 causes the front shutter unit 62 to be opened. Then, the banknotes stacked in the stacking unit 60 are taken out.

In this manner, in the banknote deposit apparatus according to this embodiment, before the deposit is determined, the stacked state of the banknotes in the stacking unit 60 is confirmed, and after the deposit has been determined, the normally stacked banknote are transported to and stored in the storing box 70 by the clamping and transporting mechanism 10. Thus, it is possible to prevent occurrence of problem in that a banknote to be moved to the storing box 70 remains in the stacking unit 60, etc. In addition, by preventing occurrence of problem after the deposit determination, a frequency at which error releasing operations are performed can be decreased and occurrence of miscalculation of cash can be prevented.

Figure 24:
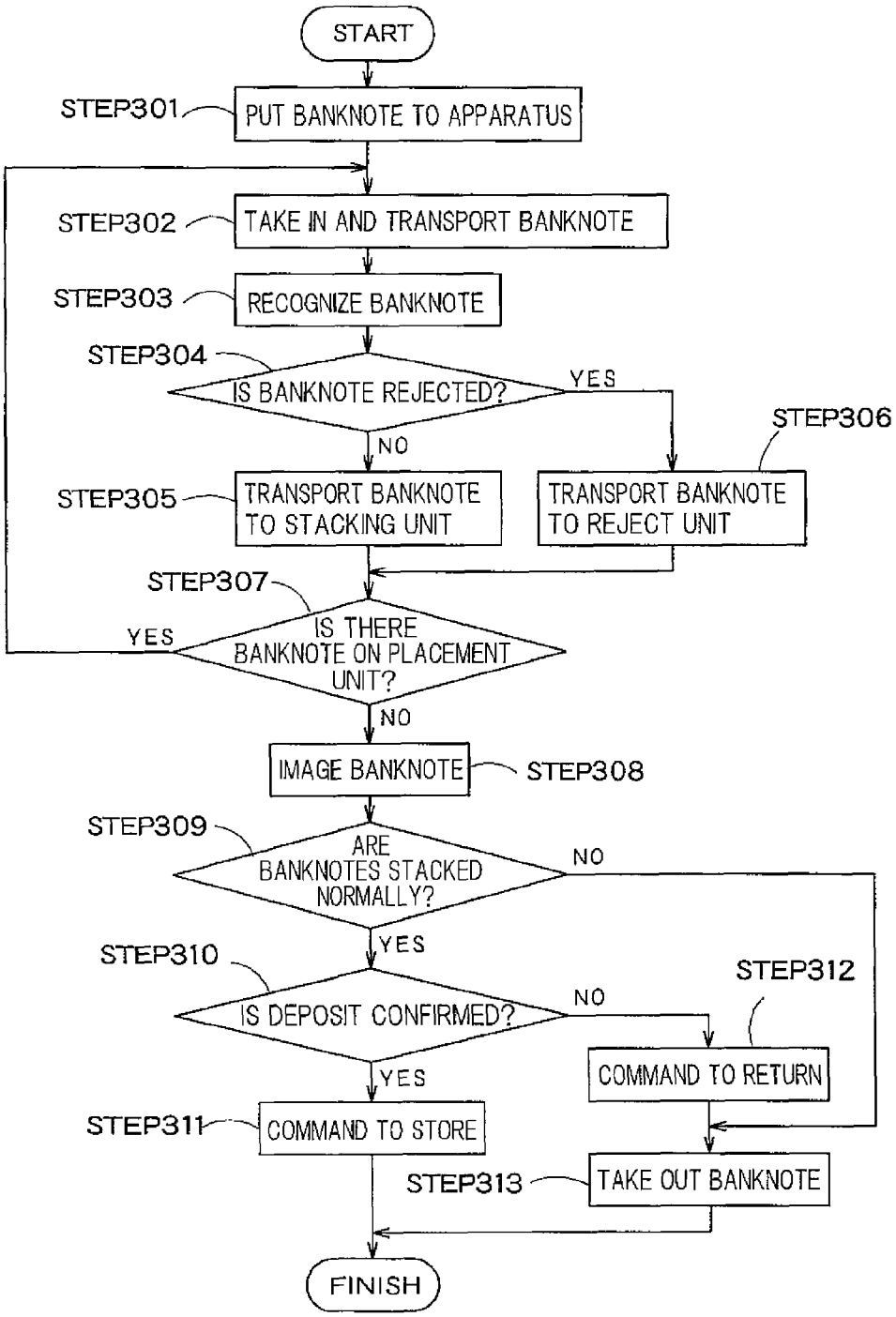
FIG. 24 is a flowchart for explaining a deposit process in the banknote deposit apparatus shown in FIG. 19.

In the deposit process in the above embodiment, when the judgment result is abnormal in STEP 309 of the flowchart shown in FIG. 24, the following process is possible. Namely, the judgment result is displayed on the display unit 5*a*, and the process proceeds to STEP 312 so as to wait an input of the returning command from the operator.

The control unit 350 may change the threshold value of the number of dots on the obtained image that is used for judging the banknote stacked state, depending on a type (size) of the stacked banknotes.

After the banknotes stacked in the stacking unit 60 have been moved to the storing box 70 so as to be stored therein, the control unit 350 may detect whether there remains a banknote in the stacking unit 60. In this case, the control unit 350 firstly causes the imaging unit 360 to image the inside of the vacant stacking unit 60 upon the start of the operation of the banknote deposit apparatus, and the control unit 350 writes the obtained image as a standard image into the memory unit 354. After the banknotes in the stacking unit 60 have been stored into the storing box 70, the control unit 350 causes the imaging unit 360 to image the inside of the stacking unit 60. Then, by comparing the obtained image and the standard image stored in the memory unit 354 with each other, the control unit 350 detects whether there is a remaining banknote or not. For example, a difference between the two images is extracted, and the difference image is subjected to a gray conversion. Thus, the presence of a remaining banknote can be detected from a rate of a black color.

When the front shutter unit 62 is opened, the imaging unit 360 may image the outside through the opening. In addition, the image obtained at this timing may be transmitted to a management center. Since the outside condition of the banknote deposit apparatus can be imaged, the thief-proof performance can be improved.

In the above embodiment, before the deposit process, the control unit 350 may cause the imaging unit 360 to image the dot patterns on the rear surface of the front shutter unit 62, and the control unit 350 may detect whether the front shutter unit 62 is opened or not, based on the number of dots on the obtained image. When the number of the imaged dots is smaller than the number of dots which are imaged when the front shutter unit 62 is completely closed, it can be seen that the front shutter unit 62 is not completely closed.

Figure 25:
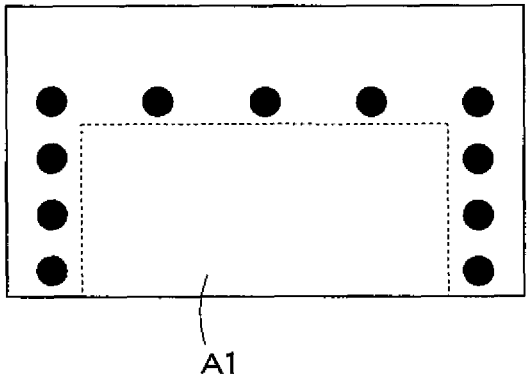
FIG. 25 is a view showing an example of the dot patterns drawn on the front shutter unit, in the fourth embodiment of the present invention.

The above embodiment has been described by taking the example in which the dot patterns are drawn on the whole rear surface of the front shutter unit 62. However, since it is sufficient to know whether the banknotes stacked in the stacking unit 60 are contained in the predetermined area A1 shown in FIG. 23(*a*) or not, the dot patterns may be drawn only the boundary portion of the predetermined area A1, as shown in FIG. 25.

In addition, the dot patterns may be finer dots than those illustrated example, with a narrower interval therebetween. In this case, it goes without saying that the abnormality in the banknote stacked state can be more precisely detected.

In addition, the patterns drawn on the rear surface of the front shutter unit 62 is not limited to the dot patterns, but may be any type of patterns as long as it can be seen whether the banknotes stacked in the stacking unit 60 are contained in the predetermined area A1 or not.

In addition, the following method is possible. For example, an image of normally stacked banknotes for each denomination or for each size is previously stored as a standard image. By matching an obtained image and the standard image, it can be judged whether the banknotes are normally stacked or not.

An operator may enclose a check, a coupon, an unfit note or a coin into an envelope, and may put the envelope into the stacking unit 60 through the opening opened by the front shutter unit 62, so that the envelope is stored into the storing box 70. At this time, the operator inputs details of the check or the like enclosed in the envelope, by using the input keys 5*b* disposed on the command receiving unit 5*c*. In addition, a unique number (recognition information) is printed on the envelope, and the unique number is also inputted.

When the envelope is put into the stacking unit 60, the imaging unit 360 images the envelope. Then, the control unit 350 reads out the unique number from the obtained image, and compares the unique number with the unique number inputted by the operator. When the comparison result is mismatched, the control unit 350 outputs an error display or an alarm signal. When the comparison result is matched, the control unit 350 causes the envelope in the stacking unit 60 to be stored into the storing box 70, and writes the unique number inputted by the operator in combination with the detailed information, into the memory unit 354.

By comparing the unique number read out from the image of the imaged envelope with the unique number manually inputted, an input mistake of the unique number can be prevented. In addition, the control unit 350 can detect that an object other than an envelope is put into the stacking unit 60, and can notify the operator of the detection result.

The comparison between the unique numbers of the envelope may not be performed, and the unique number read out from the obtained image and the detailed information inputted by the operator may be written into the memory unit 354. In this case, the manual input of the unique number of the envelope can be omitted.

Fifth Embodiment

A fifth embodiment of the present invention will be described herebelow with reference to the drawings. FIGS. 26 to 34 are views showing a banknote deposit apparatus according to this embodiment. In the below description of the fifth embodiment, the same units as those of the third embodiment are shown by the same reference numbers, and description thereof is omitted.

In the banknote deposit apparatus in this embodiment, a payment-information specifying medium can be put into the stacking unit 60 through the opening opened by the front shutter unit 62. The payment-information specifying medium is a medium on which at least a payment destination such as an account number of a banking establishment and a payment sum to the payment destination are described, and is a payment form, for example. Not only a digit and a character but also a bar code is described on the payment information including the payment designation and the payment sum. In addition, the clamping and transporting mechanism 10 is configured to transport the payment-information specifying medium having been put into the stacking unit 60 to the storing box 70 so as to be stored therein.

Figure 26:
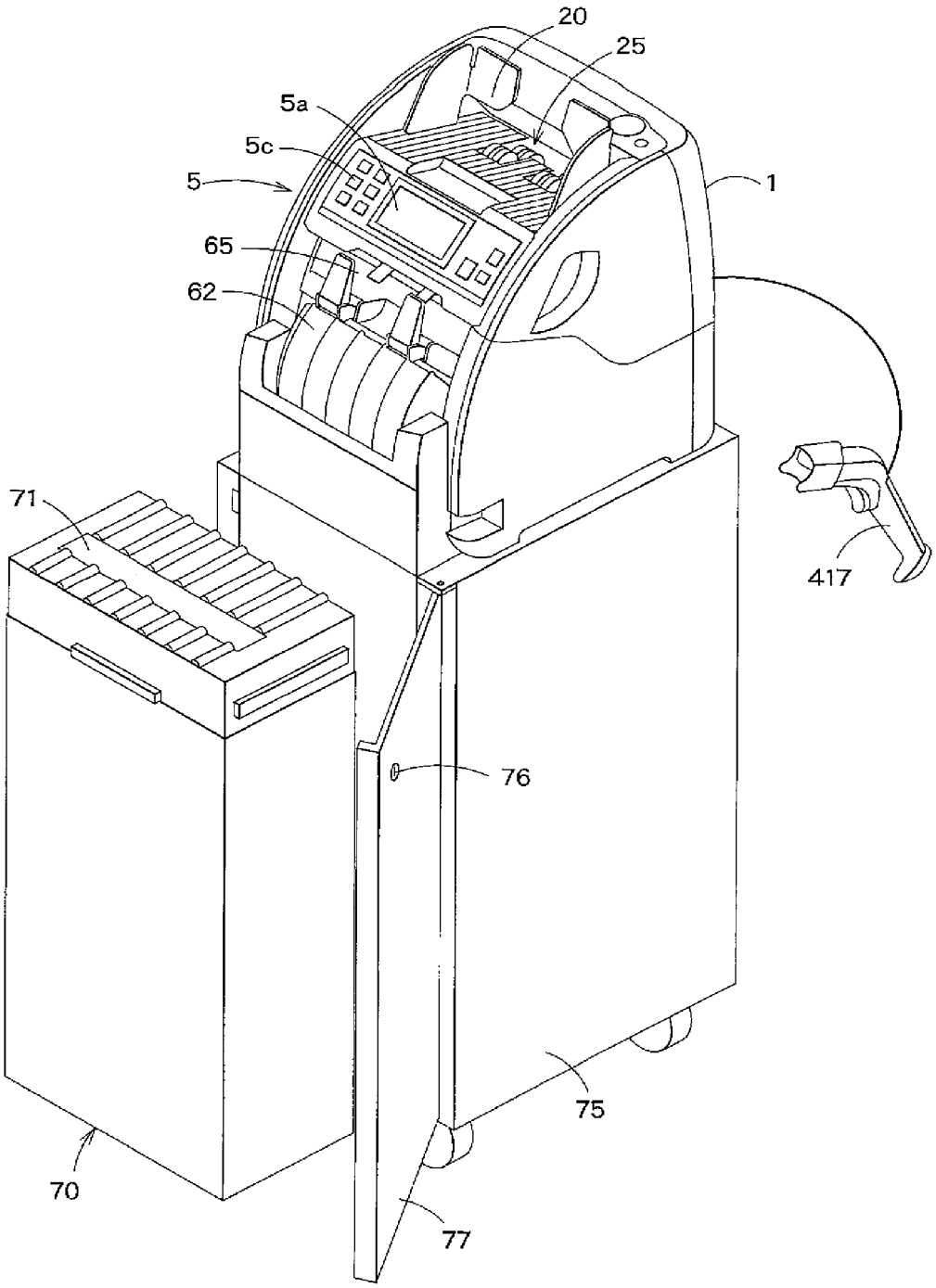
FIG. 26 is a perspective view showing a banknote deposit apparatus according to a fifth embodiment of the present invention.

As shown in FIG. 26, connected to the housing 1 of the banknote deposit apparatus is a reading unit 417 such as a handy-type bar-code reader. The reading unit 417 is configured to read out the payment information described on the payment-information specifying medium. The payment information read out by the reading unit 417 is obtained by a control unit 450 (described below).

Figure 27:
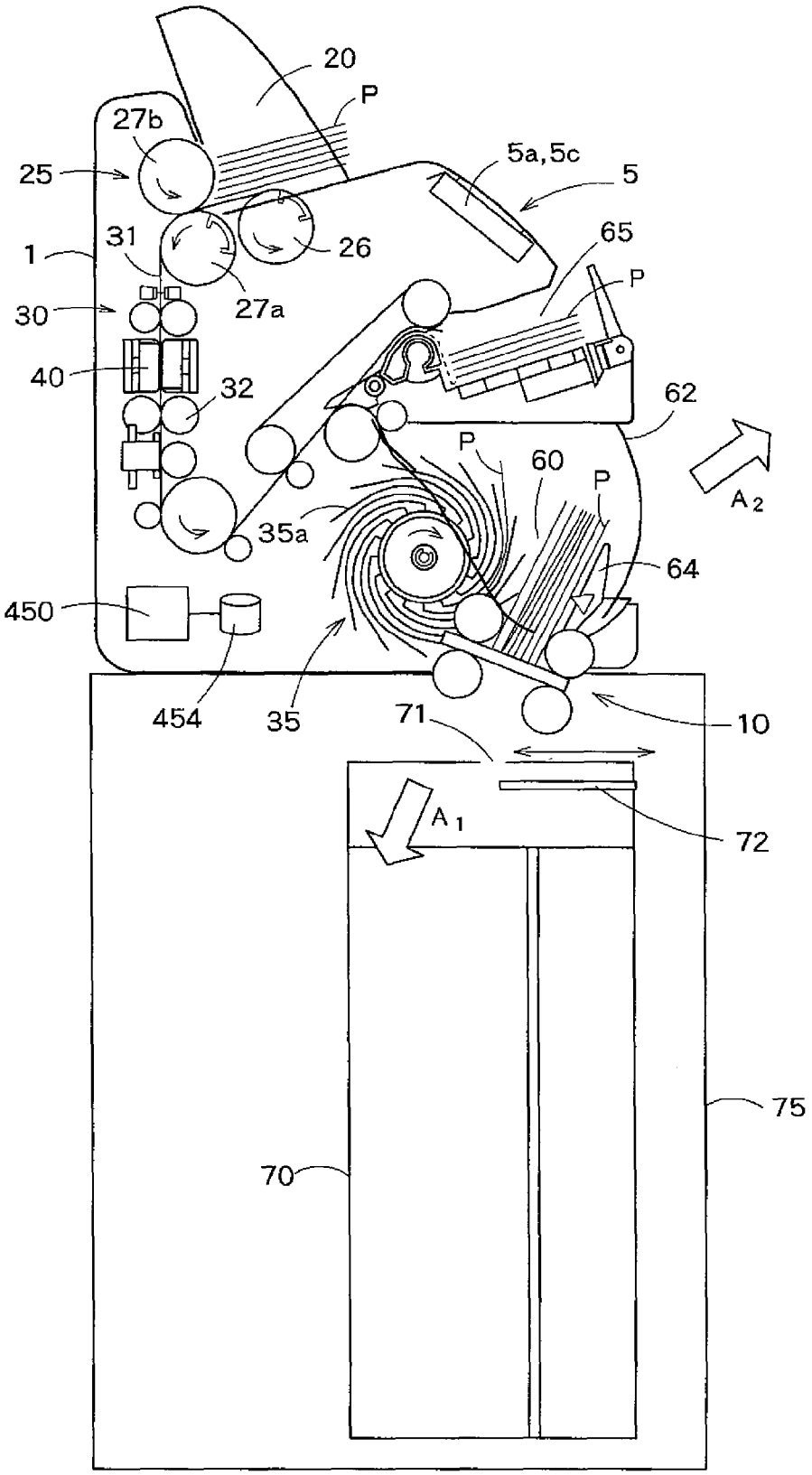
FIG. 27 is a lateral sectional view showing a structure of the banknote deposit apparatus shown in FIG. 26.
Figure 28:
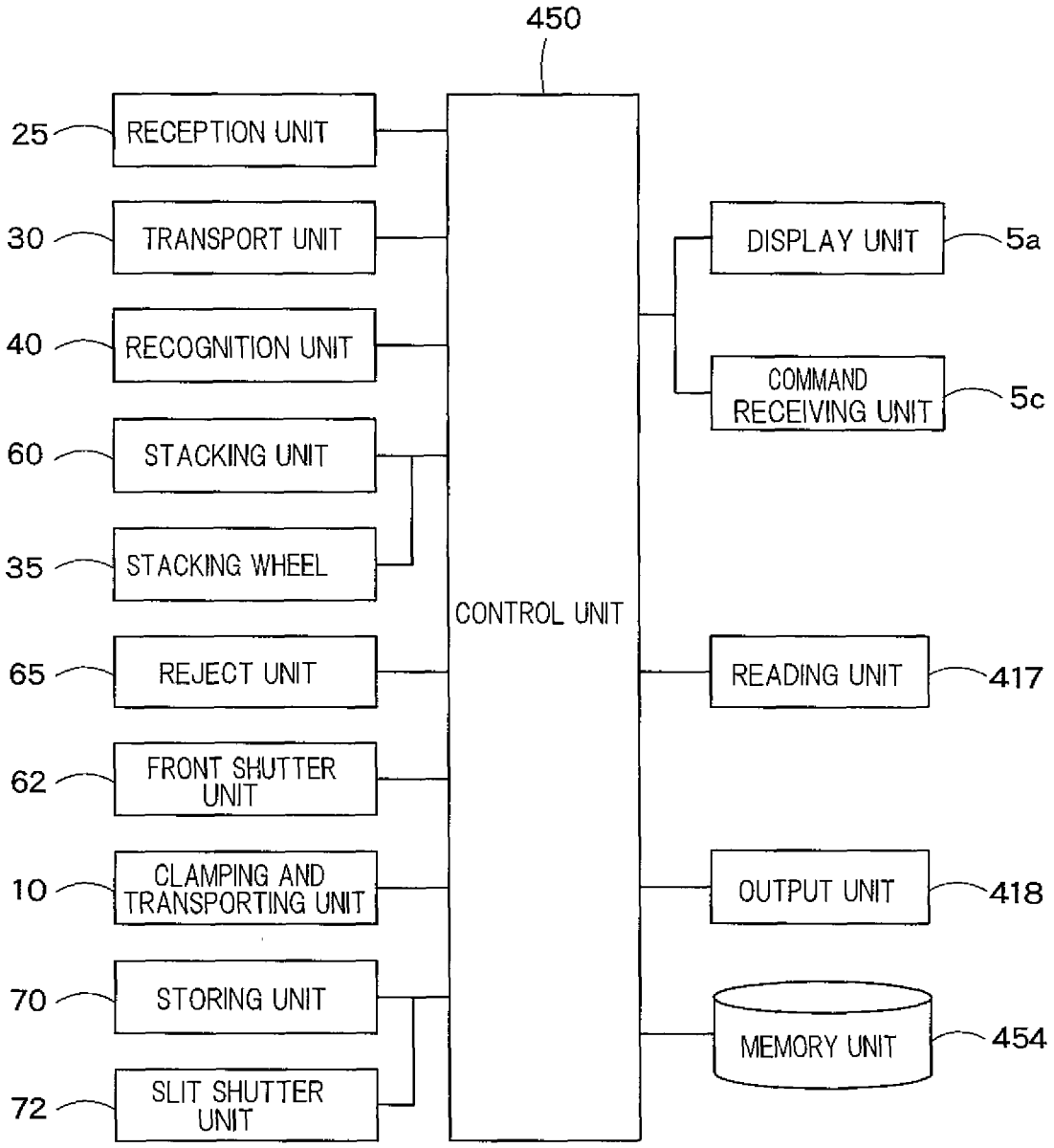
FIG. 28 is a functional block view of the banknote deposit apparatus shown in FIG. 26.

The banknote deposit apparatus in this embodiment is provided with the control unit 450 shown in FIGS. 27 and 28, in place of the control unit 250 of the banknote deposit apparatus according to the third embodiment. The control unit 450 is configured to control the respective constituent elements of the banknote deposit apparatus in the fifth embodiment. As shown in FIG. 28, the control unit 450 is connected to the respective units of the banknote deposit apparatus so as to control them. Based on a banknote recognition result by the recognition unit 40, the control unit 450 controls the transport unit 30 such that a normal banknote is transported to the stacking unit 60 and that a reject banknote is transported to the reject unit 65. The control unit 450 may cause the display unit 5*a* to display the result by which the banknote is judged as abnormal.

In addition, the control unit 450 is configured to write the payment information read out by the reading unit 417 into the memory unit 454 and to output the payment information to the outside via an output unit 418. The output unit 418 transmits the payment information to a server of an armoured car company charging a collecting operation of the storing box 70.

The command receiving unit 5*c* receives from an operator a storing command for storing a banknote and a payment-information specifying medium stacked in the stacking unit 60 into the storing box 70. In addition, the command receiving unit 5*c* receives from an operator a returning command for returning a banknote stacked in the stacking unit 60. In addition, the command receiving unit 5*c* receives a command for switching a deposit mode in which a banknote is deposited and a payment mode in which payment information is read out and a payment-information specifying medium is stored.

Figure 29:
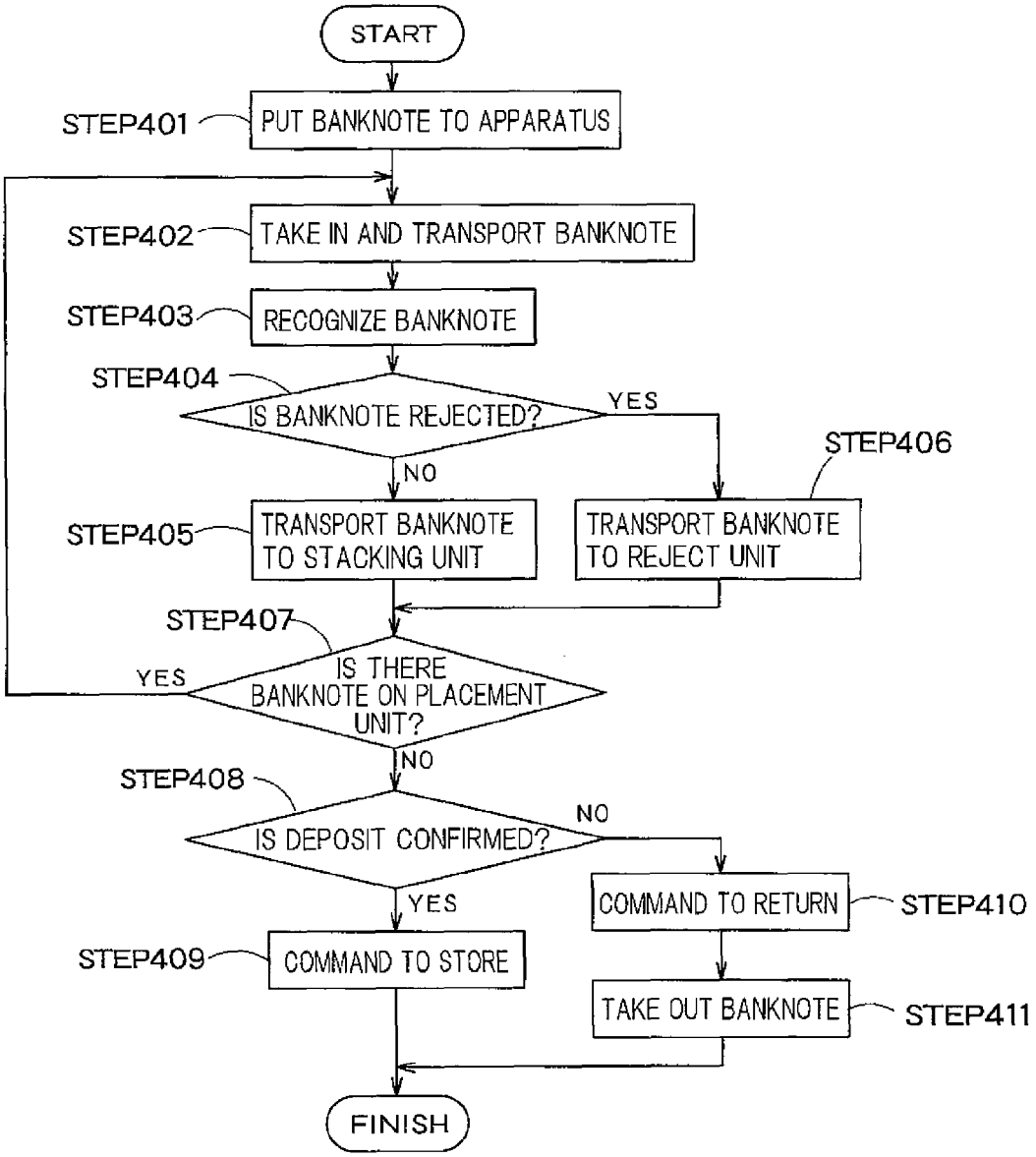
FIG. 29 is a flowchart for explaining a deposit process in the banknote deposit apparatus shown in FIG. 26.

A banknote deposit process by using such a banknote deposit apparatus is described with reference to the flowchart shown in FIG. 29.

(STEP 401) An operator switches a mode to the deposit mode through the command receiving unit 5*c*, and puts banknotes to be deposited into the placement unit 20.

(STEP 402) The banknotes are taken in, one by one, by the reception unit 25 into the apparatus, and are transported by the transport unit 30.

(STEP 403) The recognition unit 40 recognizes and counts the banknotes.

(STEP 404) When the banknote is judged as a reject banknote by the recognition unit 40, the process proceeds to STEP 406. When the banknote is judged as a normal banknote, the process proceeds to STEP 405.

(STEP 405) The banknote is transported to the stacking unit 60 so as to be stacked therein.

(STEP 406) The banknote is transported to the reject unit 65.

(STEP 407) When there remains a banknote in the placement unit 20, the process returns to STEP 402. When there remains no banknote, the process proceeds to STEP 408.

(STEP 408) The control unit 450 causes the display unit 5*a* to display the banknote recognition and count result by the recognition unit 40. When the operator confirms the displayed count result and determines the deposit, the process proceeds to STEP 409. When the operator does not determine the deposit, the process proceeds to STEP 410.

(STEP 409) The command receiving unit 5*c* receives the storing command from the operator. Base on the storing command, the banknotes stacked in the stacking unit 60 are stored into the storing box 70. In addition, the control unit 450 writes the deposit determination sum into the memory unit 454.

(STEP 410) The command receiving unit 5*c* receives the returning command from the operator.

(STEP 411) The control unit 450 causes the front shutter unit 62 to be opened. Then, the banknotes stacked in the stacking unit 60 are taken out.

Figure 30:
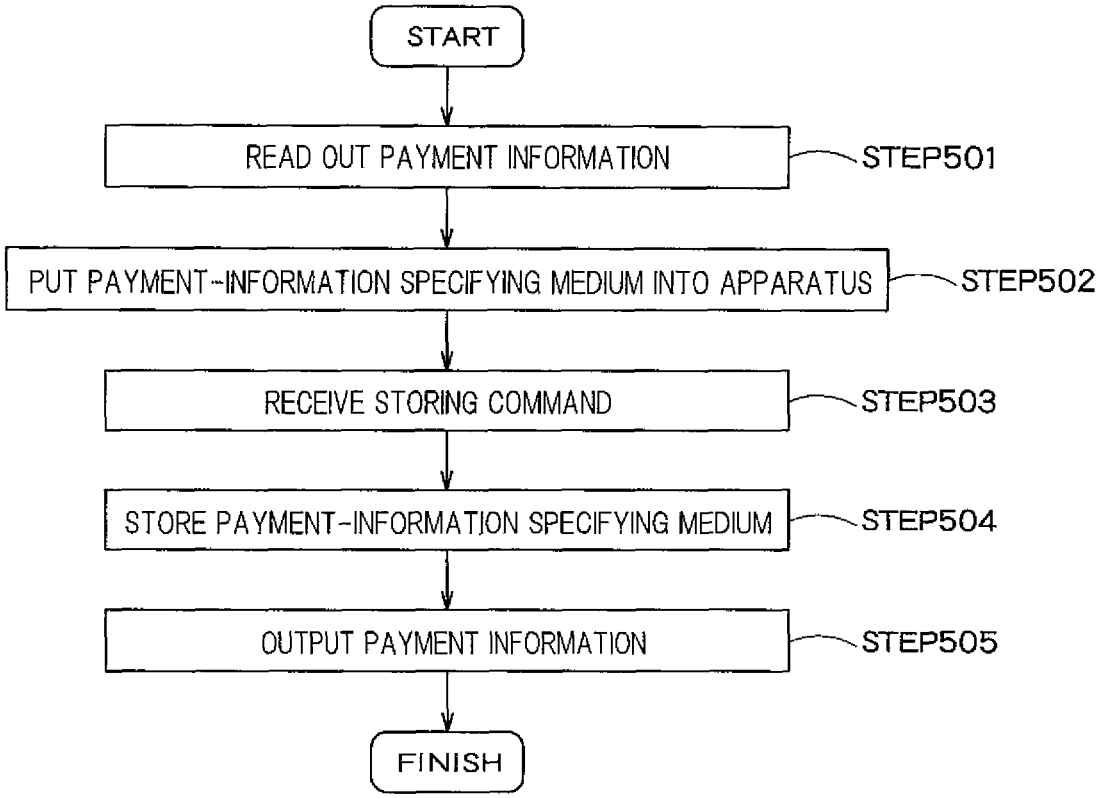
FIG. 30 is a flowchart for explaining a storing process of a payment-information specifying medium, in the banknote deposit apparatus shown in FIG. 26.

Next, a procedure for storing the payment-information specifying medium into the storing box 70 is described with reference to the flowchart shown in FIG. 30.

(STEP 501) An operator switches a mode to the payment mode through the command receiving unit 5*c*, and causes the reading unit 417 to read out the payment information of the payment-information specifying medium.

(STEP 502) When the control unit 450 receives the payment information from the reading unit 417, the control unit 450 causes the front shutter unit 62 to be opened. The operator puts the payment-information specifying medium into the stacking unit 60 through the opening opened by the front shutter unit 62. At this time, the control unit 450 may cause the display unit 5*a* to display the payment information, such that the operator confirms the payment information.

(STEP 503) The command receiving unit 5*c* receives the storing command from the operator.

(STEP 504) The payment-information specifying medium in the stacking unit 60 is transported to the storing unit 70 so as to be stored therein.

(STEP 505) The output unit 418 transmits the payment information having been read out in STEP 501 to the server of the armoured car company.

Based on the payment information received from the output unit 418, the armoured car company carries out a payment on behalf of the user (store or the like) of the banknote deposit apparatus. For example, the armoured car company carries out the payment with the use of cash in the storing box 70 of the banknote deposit apparatus, which has been collected from the store or the like. Alternatively, upon receipt of the payment information, the armoured car company may quickly advance the payment on behalf of the user, and may receive later the sum corresponding to the advance payment from the cash in the collected stored box 70.

The user (store or the like) of the banknote deposit apparatus can pay public fees and/or salary of a worker, by using cash deposited in the apparatus. In addition, when the armoured car company carries out the payment on behalf of the user, a labor of the user (store or the like) for the payment can be omitted.

In the banknote deposit apparatus according to this embodiment, the payment information is not manually inputted by the operator, but is read out by the reading unit 417 and processed. Thus, the banknote deposit apparatus can accurately obtain the payment information and can prevent a mistake during the payment operation. In addition, since the payment-information specifying medium (debit note or the like) whose payment information has been read out is stored in the storing box 70 together with cash having been put into and deposited in the stacking unit 60, it is not necessary to separately manage the debit note. Thus, an operation load required for managing the debit note can be reduced.

The above embodiment has been described by taking the example in which the handy-type bar-code reader is used as the reading unit 417. However, the bar-code reader may be integrated with the housing 1 of the banknote deposit apparatus.

Figure 31:
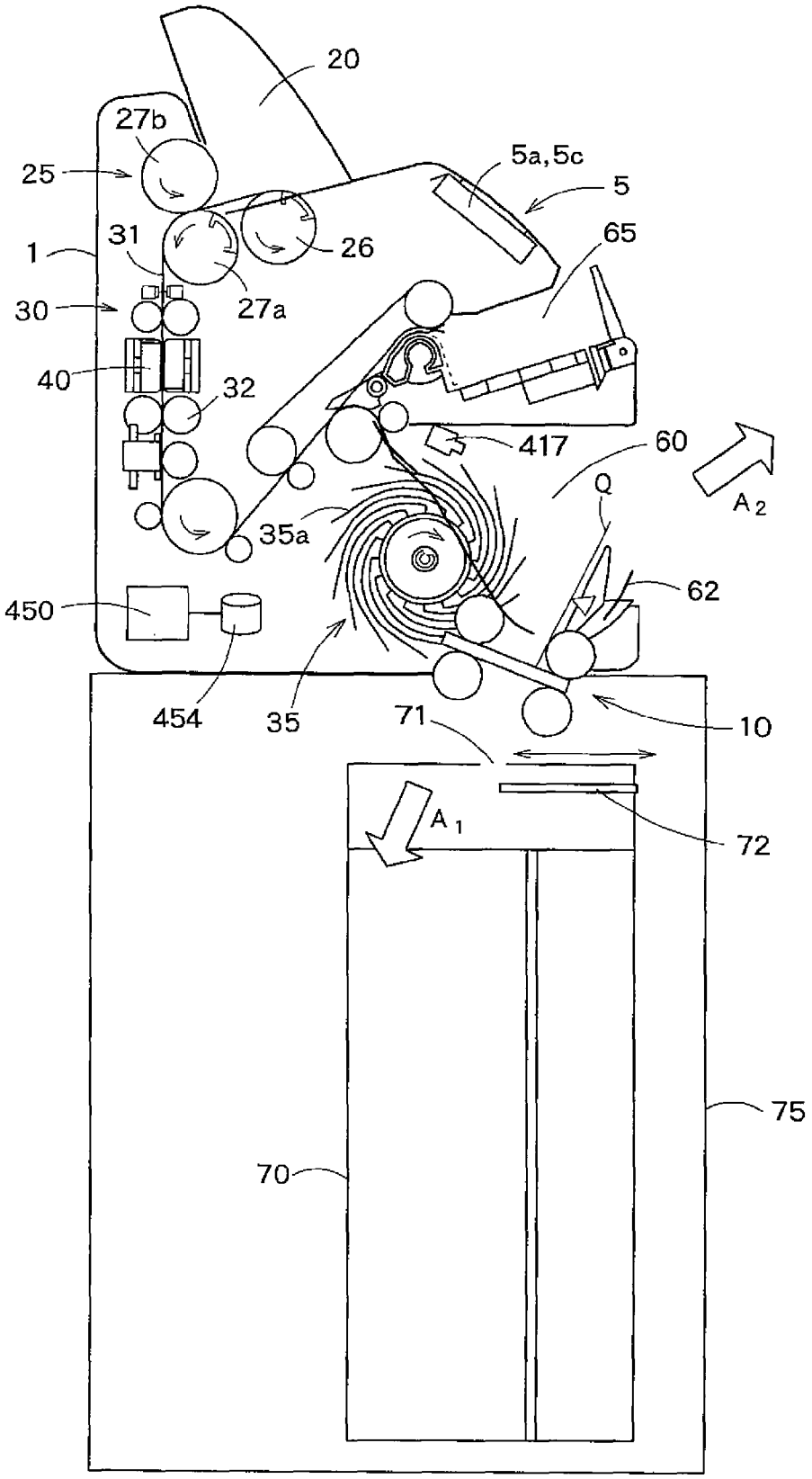
FIG. 31 is a lateral sectional view showing a structure of a banknote deposit apparatus according to an alternative example in the fifth embodiment of the present invention.

Next, an alternative example of the banknote deposit apparatus according to this embodiment is described with reference to FIGS. 31 and 32. FIG. 31 shows a section of the banknote deposit apparatus according to the alternative example. This alternative example differs from the banknote deposit apparatus shown in FIGS. 26 to 28 in that, not the bar-code reader, but imaging means disposed on the stacking unit 60 serves as the reading unit 417. In FIG. 31, the same units as those of the banknote deposit apparatus shown in FIG. 27 are shown by the same reference numbers, and description thereof is omitted.

The imaging means is configured to image a payment-information specifying medium Q having been put into the stacking unit 60, and to transmit the obtained image to the control unit 450. The imaging means is a CCD camera, for example. In addition, the stacking unit 60 is provided with a light source (not shown) that is lighted when the imaging means obtains an image.

The control unit 450 extracts payment information from the image obtained by the imaging means. For example, the control unit 450 extracts a character from the obtained image, and specifies a payment destination and a payment sum. In this manner, the payment information of the payment-information specifying medium is read out.

Figure 32:
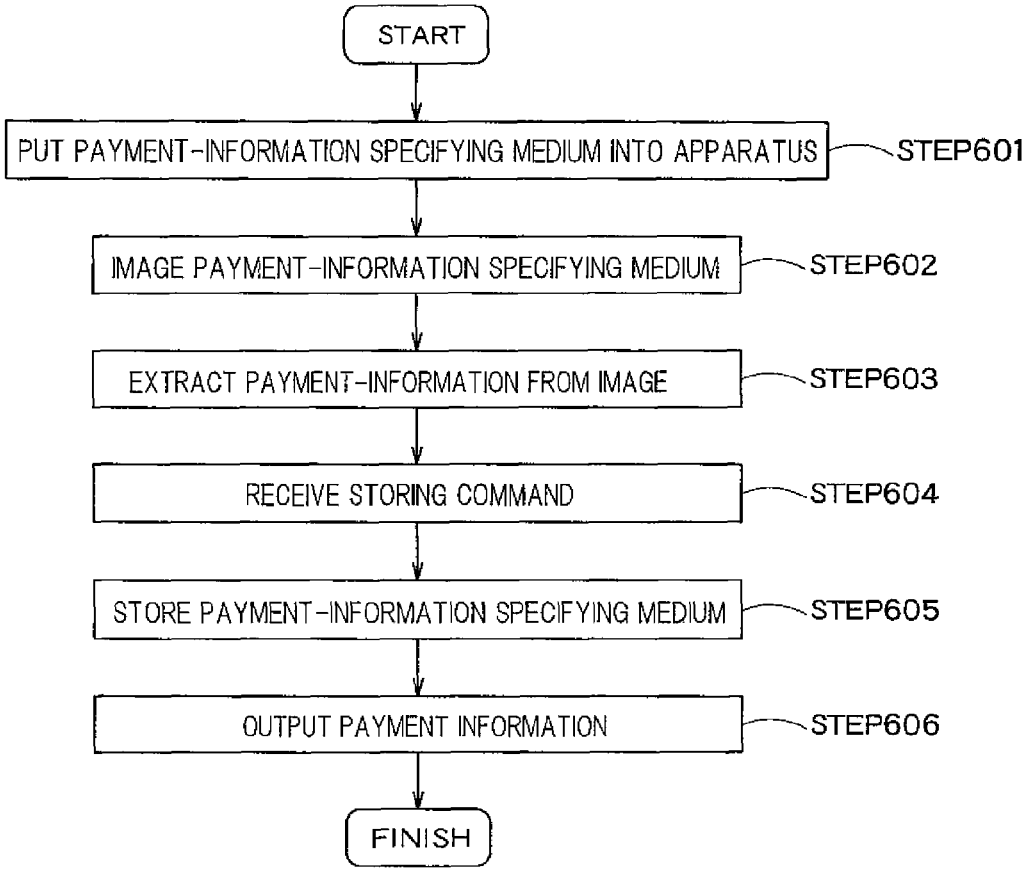
FIG. 32 is a flowchart for explaining a storing process of a payment-information specifying medium, in the banknote deposit apparatus shown in FIG. 31.

FIG. 32 is a flowchart for explaining a procedure for storing a payment-information specifying medium into the storing box 70, by using the banknote deposit apparatus according to the alternative example.

(STEP 601) When an operator switches a mode to the payment mode through the command receiving unit 5*c*, the control unit 450 causes the front shutter unit 62 to be opened. The operator puts the payment-information specifying medium into the stacking unit 60 through the opening opened by the front shutter unit 62.

(STEP 602) The imaging means (reading unit 417) disposed in the stacking unit 60 images the payment-information specifying medium, and transmits the obtained image to the control unit 450.

(STEP 603) The control unit 450 extracts the payment information from the obtained image, and writes the payment information into the memory unit 454. At this time, the control unit 450 may cause the display unit 5*a* to display the payment information, such that the operator can confirm the payment information.

(STEP 604) The command receiving unit 5*c* receives the storing command from the operator.

(STEP 605) The payment-information specifying medium in the stacking unit 60 is transported to the storing box 70 so as to be stored therein.

(STEP 606) The output unit 418 transmits the payment information extracted in STEP 603 to the server of the armoured car company.

Also according to this method, the armoured car company can obtain the payment information. Thus, the armoured car company can carry out a payment on behalf of the user (shop or the like) of the banknote deposit apparatus. For example, the armoured car company carries out the payment with the use of cash in the storing box 70 of the banknote deposit apparatus, which has been collected from the shop or the like. Alternatively, upon receipt of the payment information, the armoured car company may quickly advance the payment on behalf of the user, and may receive later the sum corresponding to the advance payment from the cash in the collected stored box 70.

Similarly to the banknote deposit apparatus shown in FIGS. 26 to 28, the user (store or the like) of the banknote deposit apparatus according to this alternative example can pay public fees and/or salary of a worker, by using cash deposited in the apparatus. In addition, when the armoured car company carries out the payment on behalf of the user, a labor of the user (store or the like) for the payment can be omitted.

In the banknote deposit apparatus according to the alternative example, the payment information is not manually inputted by the operator, but is read out by the reading unit 417 (imaging means) and processed. Thus, the banknote deposit apparatus can accurately obtain the payment information and can prevent a mistake during the payment operation. In addition, since the payment-information specifying medium (debit note or the like) whose payment information has been read out is put into the stacking unit 60 and stored in the storing box 70, it is not necessary to separately manage the debit note. Thus, an operation load required for managing the debit note can be reduced.

In the above alternative example, when there are a plurality of payment-information specifying media to be read out, the payment-information specifying media are put into the stacking unit 60 one by one, and imaged one by one.

Figure 33:
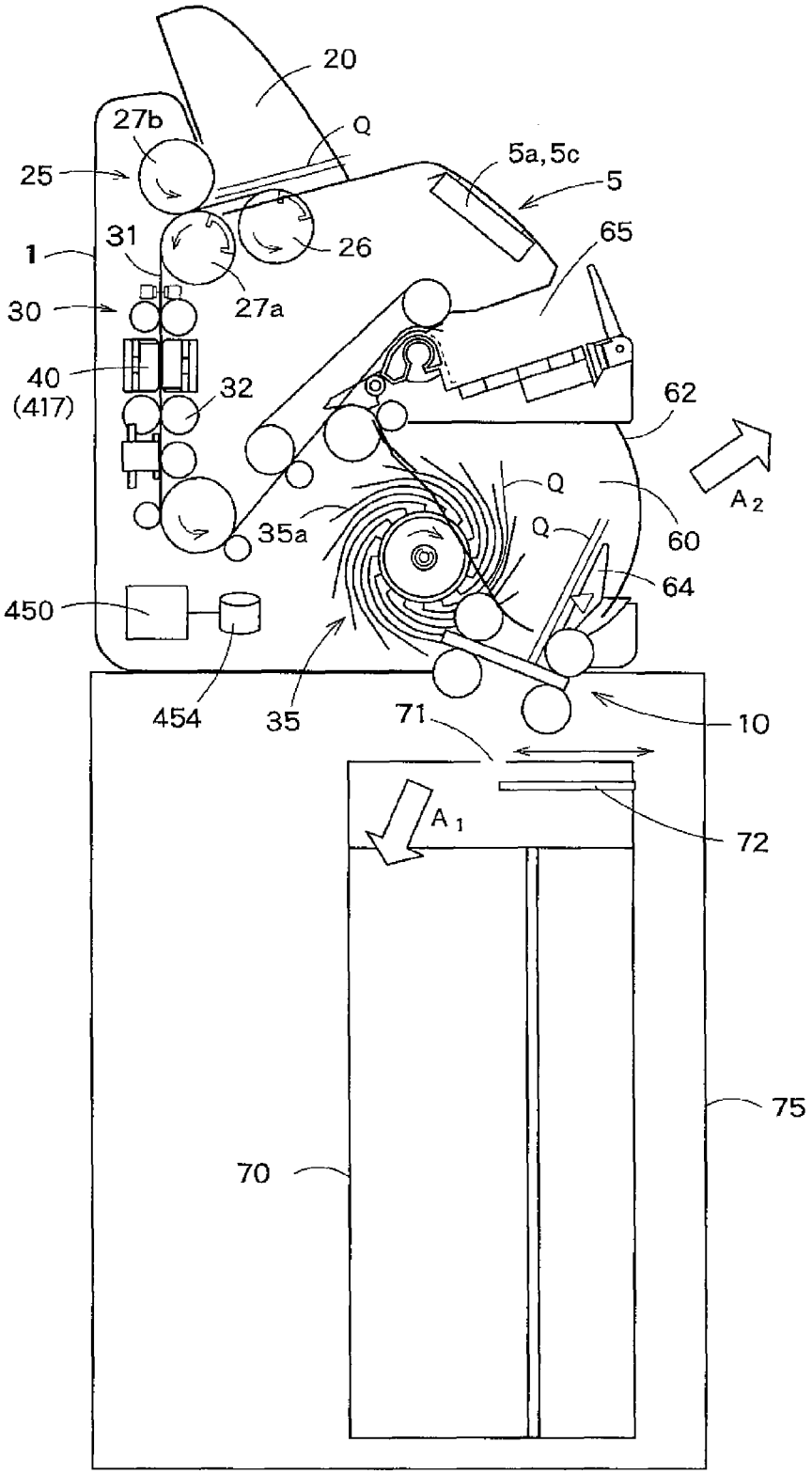
FIG. 33 is a lateral structural view showing a structure of a banknote deposit apparatus according to a further alternative example in the fifth embodiment of the present invention.

Next, a further alternative example of the banknote deposit apparatus according to this embodiment is described with reference to FIGS. 33 and 34. FIG. 33 shows a section of the banknote deposit apparatus according to the further alternative example. The banknote deposit apparatus according to this alternative example differs from the banknote deposit apparatus shown in FIGS. 26 to 28 in that the reading unit 417 is included in the recognition unit 40. In FIG. 33, the same units as those of the banknote deposit apparatus shown in FIG. 27 are shown by the same reference numbers, and description thereof is omitted.

In this alternative example, the payment-information specifying medium Q is placed on the placement unit 20, and is taken in by the reception unit 25. The transport unit 30 transports the payment-information specifying medium Q having been taken in by the reception unit 25 to the stacking unit 60. The stacking unit 60 stacks the payment-information specifying medium Q having been transported by the transport unit 30.

The reading unit 417 in the recognition unit 40 reads out the payment information from the payment-information specifying medium Q having been taken in by the reception unit 25. Namely, the recognition unit 40 has a function for reading out the payment information. For example, the recognition unit 40 (reading unit 417) reads out the payment information from a bar code described on the payment-information specifying medium. The recognition unit 40 notifies the control unit 450 of the read-out payment information.

Figure 34:
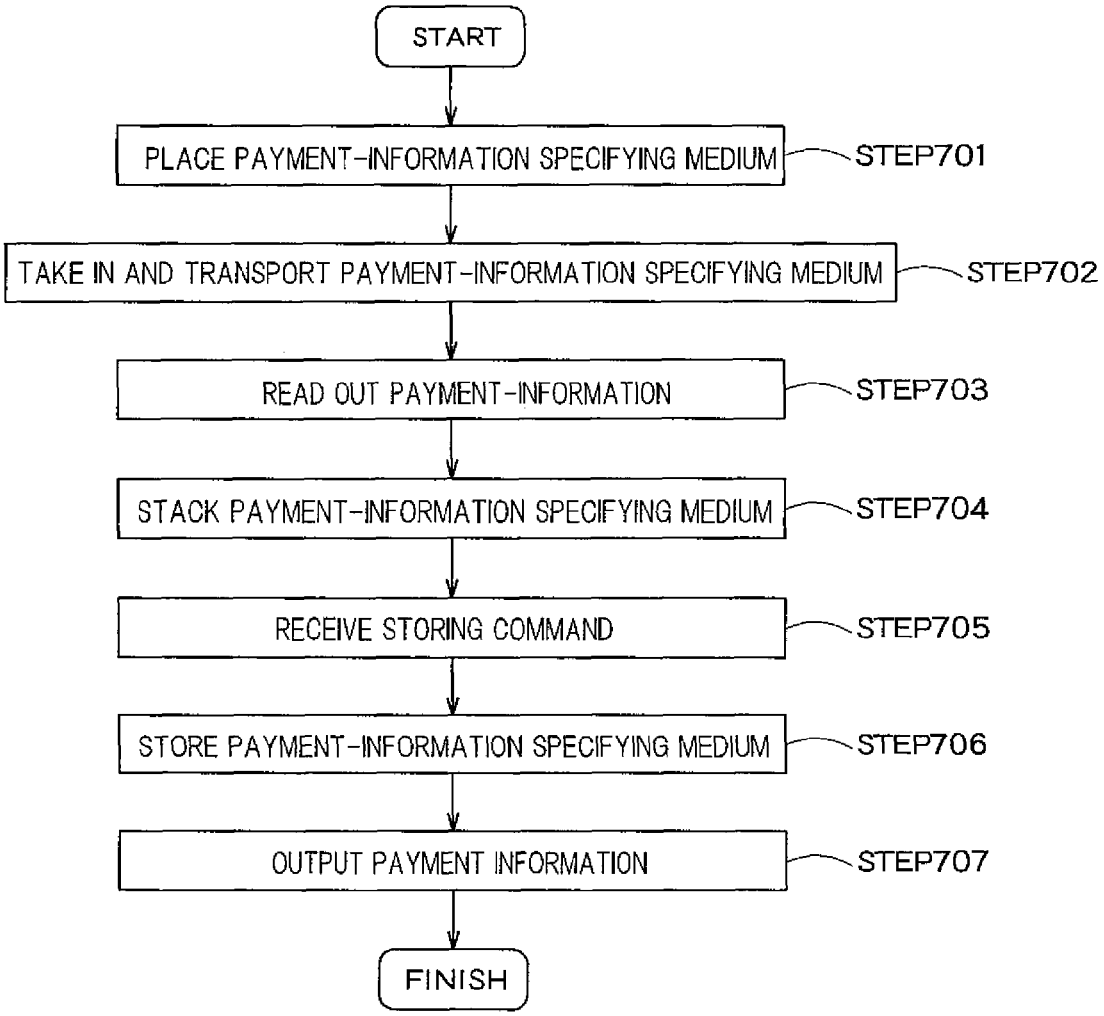
FIG. 34 is a flowchart for explaining a storing process of a payment-information specifying medium, in the banknote deposit apparatus shown in FIG. 33.

FIG. 34 is a flowchart for explaining a procedure for storing the payment-information specifying medium into the storing box 70, by using the banknote deposit apparatus according to the alternative example.

(STEP 701) An operator switches a mode to the payment mode through the command receiving unit 5*c*, and places the payment-information specifying media on the placement unit 20.

(STEP 702) The payment-information specifying media are taken in, one by one, by the reception unit 25 into the apparatus, and are transported by the transport unit 30.

(STEP 703) The recognition unit 40 (reading unit 417) reads out the payment information from the payment-information specifying medium, and writes the payment information into the memory unit 54. At this time, the control unit 450 may cause the display unit 5*a* to display the payment information, such that the operator can confirm the payment information.

(STEP 704) The payment-information specifying media are stacked in the stacking unit 60.

(STEP 705) The command receiving unit 5*c* receives the storing command from the operator.

(STEP 706) The payment-information specifying media in the stacking unit 60 are transported to the storing box 70 so as to be stored therein.

(STEP 707) The output unit 418 transmits the payment information read out in STEP 703 to the server of the armoured car company.

Also according to this method, the armoured car company can obtain the payment information. Thus, the armoured car company can carry out a payment on behalf of the user (store or the like) of the banknote deposit apparatus. For example, the armoured car company carries out the payment with the use of cash in the storing box 70 of the banknote deposit apparatus, which has been collected from the store or the like. Alternatively, upon receipt of the payment information, the armoured car company may quickly advance the payment on behalf of the user, and may receive later the sum corresponding to the advance payment from the cash in the collected stored box 70.

Similarly to the banknote deposit apparatus shown in FIGS. 26 to 28 and the banknote deposit apparatus shown in FIG. 31, the user (store or the like) of the banknote deposit apparatus according to this alternative example can pay public fees and/or salary of a worker, by using cash deposited in the apparatus. In addition, since the armoured car company carries out the payment on behalf of the store, a labor of the user (store or the like) for the payment can be omitted.

In the banknote deposit apparatus according to the alternative example, the payment information is not manually inputted by the operator, but is read out by the recognition unit 40 (reading unit 417) and processed. Thus, the banknote deposit apparatus can accurately obtain the payment information and can prevent a mistake during the payment operation. In addition, since the payment-information specifying medium (debit note or the like) whose payment information has been read out is stored in the storing box 70, it is not necessary to separately manage the debit note. Thus, an operation load required for managing the debit note can be reduced.

A printing unit may be provided on the aforementioned banknote deposit apparatus according to the fifth embodiment, such that a payment sum for each payment destination can be printed. Based on the payment information stored in the memory unit 454, the control unit 450 can calculate a payment sum for each payment denomination. The operator can confirm whether there is a forgotten payment or not from the printed information. In addition, the payment information may be printed, one by one, by the printing unit. The outputted form on which the payment information is printed can be utilized as a temporary receipt when a client requests a payment.

In addition, a storage medium such as an IC tag may be provided on the storing box 70 of the banknote deposit apparatus according to the fifth embodiment, such that the payment information can be written into (outputted to) the storage medium. The armored car company collects the storage medium together with the storing box 70, and carries out a payment on behalf of the user based on the payment information written in the storage medium. In this case, since the banknote deposit apparatus does not need to transmit the payment information to the server of the armoured car company, the communication function of the banknote deposit apparatus can be omitted.

In addition, in the fifth embodiment, the control unit 450 may calculate, base on the payment information, a breakdown of a sum (payment sum) to be used for payment and a sum other than the payment sum, of the cash deposited in the apparatus. The sum other than the payment sum are, for example, sales proceeds in the shop, a commission fee when a client request a payment.

In addition, the banknote deposit apparatus according to the fifth embodiment may performs the following process. Namely, a check and/or a coin is enclosed in an envelop, and the envelop is put into the stacking unit 60, through the opening opened by the front shutter unit 62, so as to be stored in the storing box 70. A sum of the check and/or coin in the envelope is manually inputted through numeric keys (not shown) disposed on the command receiving unit 5*c*. By enabling the deposit with the use of an envelop, a check and so on can be used for paying the payment sum to the armoured car company.

The invention claimed is:

1. A banknote deposit apparatus comprising:

a reception unit configured to take in, one by one, a plurality of banknotes;

a transport unit configured to transport the banknotes having been taken in by the reception unit;

a stacking unit configured to stack the banknotes having been transported by the transport unit;

a recognition unit disposed on the transport unit, the recognition unit being configured to recognize and count the banknotes being transported by the transport unit;

a storing box configured to receive the banknotes stacked in the stacking unit so as to store the banknotes; and a clamping and transporting mechanism configured to clamp surfaces of the banknotes stacked in the stacking unit and to transport the banknotes in a direction parallel to the surfaces of the clamped banknotes and at the same time transport the banknotes downward so as to store the banknotes in the storing box;

wherein a front opening through which the stacked banknotes are taken out from outside, and a front shutter unit configured to open and close the front opening are disposed on a front surface of the stacking unit, wherein the clamping and transporting mechanism includes a slide unit configured to support lower ends of the banknotes that are stacked in the stacking unit, the slide unit configured to be slid to be opened to an unsupporting condition when the banknotes, the lower ends of which were supported by the slide unit, are transported downward in the direction substantially parallel to the clamping surfaces of the clamped banknotes and are stored into the storing box, the clamping and transporting mechanism including a first contacting and transporting unit configured to come into contact with the surface of the banknote located on the rearmost side of the plurality of banknotes when the slide unit is slid to be opened, and a second contacting and transporting unit configured to come into contact with the surface of the banknote located on the frontmost side of the plurality of banknotes when the slide unit is slid to be opened.

2. The banknote deposit apparatus according to claim 1, wherein the clamping and transporting mechanism is configured to clamp surfaces of banknotes located on outermost positions of the plurality of banknotes stacked in the stacking unit, and to collectively transport the plurality of banknotes to the storing box.

3. The banknote deposit apparatus according to claim 1, wherein the storing box is provided with a slit opening through which the banknotes being transported by the clamping and transporting mechanism are taken in.

4. The banknote deposit apparatus according to claim 3, wherein the storing box is provided with a slit shutter unit configured to open and close the slit opening.

5. The banknote deposit apparatus according to claim 1, wherein the stacking unit is configured to stack the banknotes having been transported by the transport unit in a forwardly inclined standing state.

6. The banknote deposit apparatus according to claim 1, wherein when the banknotes are transported by the clamping and transporting mechanism to the storing box, the front shutter unit is unopenable.

7. The banknote deposit apparatus according to claim 1, further comprising a control unit configured to switch a storing mode in which the banknotes having been taken in by the reception unit are transported to the stacking unit by the transport unit, and then the banknotes, having been transported to the stacking unit, are transported to the storing box by the clamping and transporting mechanism, and a counting mode in which the banknotes, having been taken in by the reception unit, are transported to the stacking unit by the transport unit, and the banknotes, having been transported to the stacking unit, can be taken out from outside the banknote deposit apparatus through the front opening after the banknotes have been taken in by the reception unit, without actuating the clamping and transporting mechanism.

* * * * *